US011566451B2

(12) United States Patent
Hall et al.

(10) Patent No.: US 11,566,451 B2
(45) Date of Patent: Jan. 31, 2023

(54) PRODUCT MERCHANDISING SYSTEM WITH ENHANCED SECURITY FEATURES

(71) Applicant: Mobile Tech, Inc., Hillsboro, OR (US)

(72) Inventors: Jude Hall, Hillsboro, OR (US); Hoa Pham, Hillsboro, OR (US); Rod Horner, Hillsboro, OR (US); Peter Schuft, Hillsboro, OR (US); Richard Fan, Hillsboro, OR (US)

(73) Assignee: Mobile Tech, Inc., Hillsboro, OR (US)

( * ) Notice: Subject to any disclaimer, the term of this patent is extended or adjusted under 35 U.S.C. 154(b) by 0 days.

(21) Appl. No.: 17/092,804

(22) Filed: Nov. 9, 2020

(65) Prior Publication Data

US 2021/0140202 A1 May 13, 2021

Related U.S. Application Data

(60) Provisional application No. 62/932,596, filed on Nov. 8, 2019.

(51) Int. Cl.

| | |
|---|---|
| ***E05B 73/00*** | (2006.01) |
| ***A47F 7/00*** | (2006.01) |
| ***A47F 5/00*** | (2006.01) |
| ***G08B 13/14*** | (2006.01) |

(52) U.S. Cl.

CPC ..... *E05B 73/0017* (2013.01); *A47F 5/0081* (2013.01); *A47F 7/00* (2013.01); *E05B 73/0011* (2013.01); *G08B 13/14* (2013.01); *G08B 13/1409* (2013.01); *G08B 13/1445* (2013.01); *G08B 13/1463* (2013.01)

(58) Field of Classification Search

CPC ..... A47F 7/024; A47F 7/00; G08B 13/1409; G08B 13/14; G08B 13/1445; E05B 73/0011

See application file for complete search history.

(56) References Cited

U.S. PATENT DOCUMENTS

| | | | | |
|---|---|---|---|---|
| 9,788,669 | B1 * | 10/2017 | Denby | E05B 73/0041 |
| 2011/0309934 | A1 * | 12/2011 | Henson | G08B 13/1472 340/568.2 |
| 2014/0092531 | A1 * | 4/2014 | Trinh | A47F 7/0246 361/679.01 |
| 2014/0355200 | A1 * | 12/2014 | Thiers | B60R 11/0241 361/679.41 |
| 2020/0399933 | A1 * | 12/2020 | Kelsch | E05B 73/0058 |

* cited by examiner

*Primary Examiner* — Mirza F Alam

(57) ABSTRACT

This disclosure is directed to product merchandising systems that and designed to prevent brute force attempts to steal a product on display. The merchandising systems include security features that enhances the strength of the connection between a puck assembly and a base assembly and between the base assembly and a display surface. The merchandising systems are suited for withstanding brute force pulling attacks on the puck assembly and the base assembly.

19 Claims, 41 Drawing Sheets

PRODUCT MERCHANDISING SYSTEM WITH ENHANCED SECURITY FEATURES

CROSS-REFERENCE TO RELATED APPLICATION

This application claims the benefit of Provisional Application No. 62/932,596, filed Nov. 8, 2019.

TECHNICAL FIELD

The present disclosure is directed to securing systems for merchandising electronic devices.

BACKGROUND

Products are often merchandised to customers using merchandising systems that are designed and constructed to prevent theft of the products on display. FIGS. 1A and 1B show examples of a product display assembly 100 that includes a puck assembly 102 and a base assembly 104. The base assembly 104 can be secured to a display table or a shelf. A tether 110 connects the puck assembly 102 to the base assembly 104. A product such as an electronic device 106 is mounted on a top or upper surface of the puck assembly 102 so that the electronic device 106 can be securely displayed to customers in a store. The electronic device 106 may be a smart phone, a tablet computer, a camera, or a wearable device (e.g., smart watches). The puck assembly 102 is moveable between a rest position shown in FIG. 1A and a lift position shown in FIG. 1B. FIG. 1B also shows a tether 110 that connects the puck assembly 102 to the base assembly 104 when the puck assembly 102 is in the lift position. The tether 110 allows a customer to pick up, hold, and inspect the electronic device. To provide ease of handling, the tether 110 may be a retractable tether that is included as part of a retractable tether assembly.

However, typical display assemblies are unable to resist brute force attempts to steal a product on display. Such attempts include breaking a connection between the puck assembly 102 and the tether 110, breaking a connection between the tether 110 and base assembly 104, and/or breaking a connection between the base assembly 104 and display surface. In one example, a thief grabs the puck assembly 102 and pulls on the puck assembly 102 in an attempt to tear the puck assembly 102 away from the base assembly 104. While pulling on the puck assembly 102, the thief may also apply twisting and shearing forces to the puck assembly 102 and the tether 110. In another example, a thief grabs the base assembly 104 and applies strong pulling, twisting, and/or shearing forces to the base assembly 104 in an attempt to severe a connection between the base assembly 104 and the display surface. Through such brute force attacks, the connection between the puck assembly 102 and the tether 110, the connection between the tether 110 and the base assembly 104, and/or the connection between the base assembly 104 and the display surface may be broken, enabling the thief to make off with the product.

SUMMARY

This disclosure is directed to product merchandising systems that are designed to prevent brute force attempts to steal a product on display. The merchandising systems include security features that enhances the strength of the connection between a puck assembly and a base assembly. In one aspect, a merchandising system includes a puck assembly for mounting the product, a base assembly for retaining the puck assembly, and a tether assembly. The base assembly includes an interior metal frame that resist twisting and pulling forces from a thief attempting to separate the puck assembly with the product from the base assembly. The tether assembly has a tether connected at a first end to a reel located within a recess of the interior meal frame and connected at a second end to a tether connector that is attached to the puck assembly. The system may include a first lock located within the puck assembly that prevents the product from the being removed from the puck, a second that locks down the puck assembly to the base assembly, and third lock that secures the puck assembly to the tether.

DETAILED DESCRIPTION

Figure 1A:
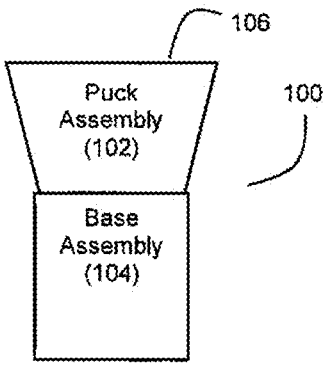
FIGS. 1A and 1B show an example product display assembly.
Figure 1B:
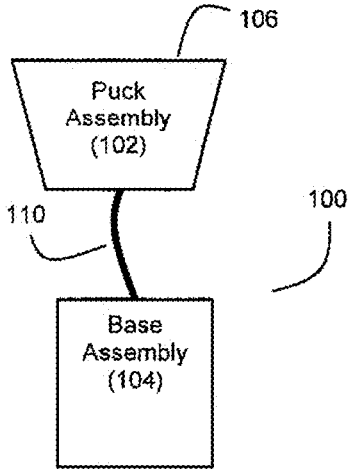
Figure 2A:
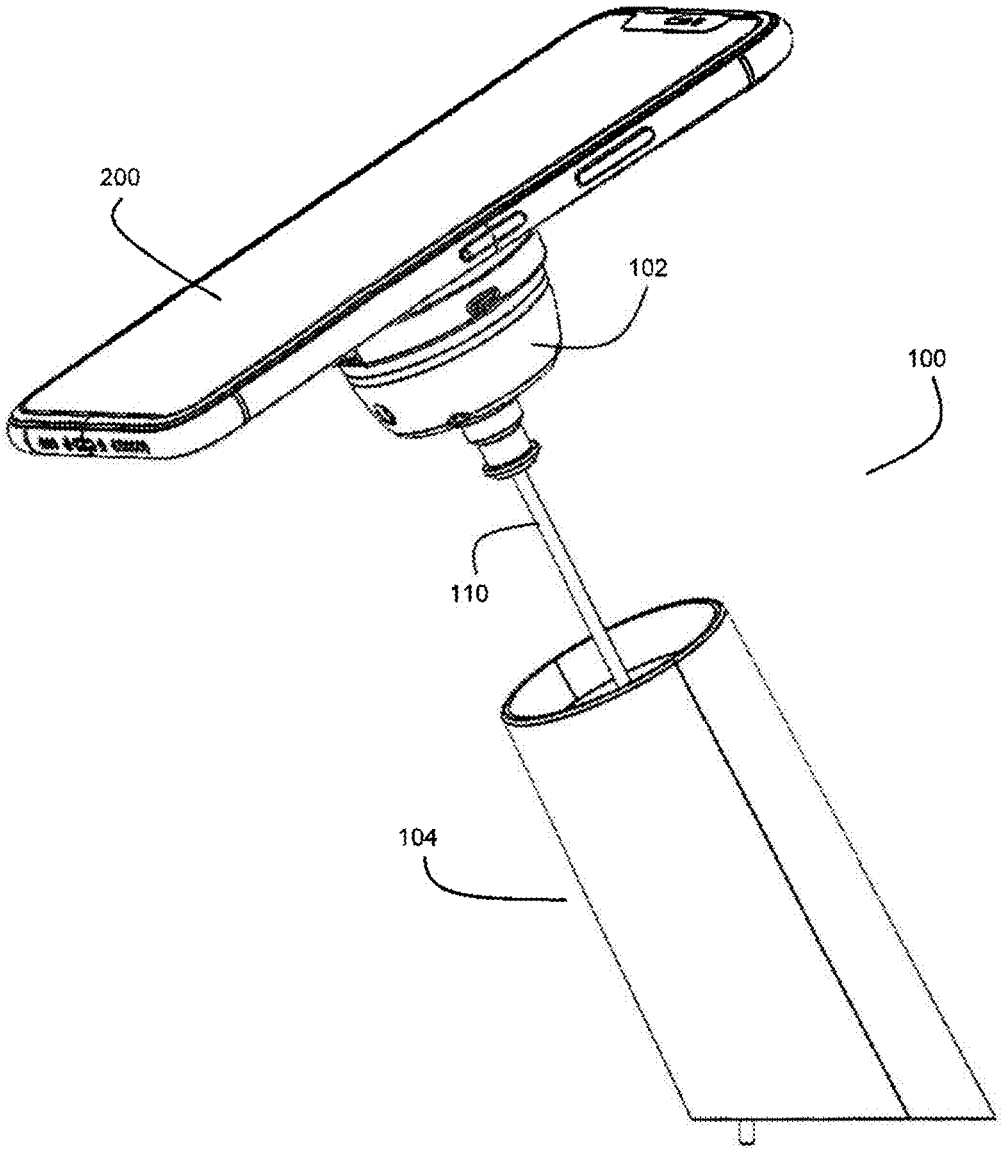
FIGS. 2A and 2B show views of an example product display assembly with one or more enhanced security features.
Figure 2B:
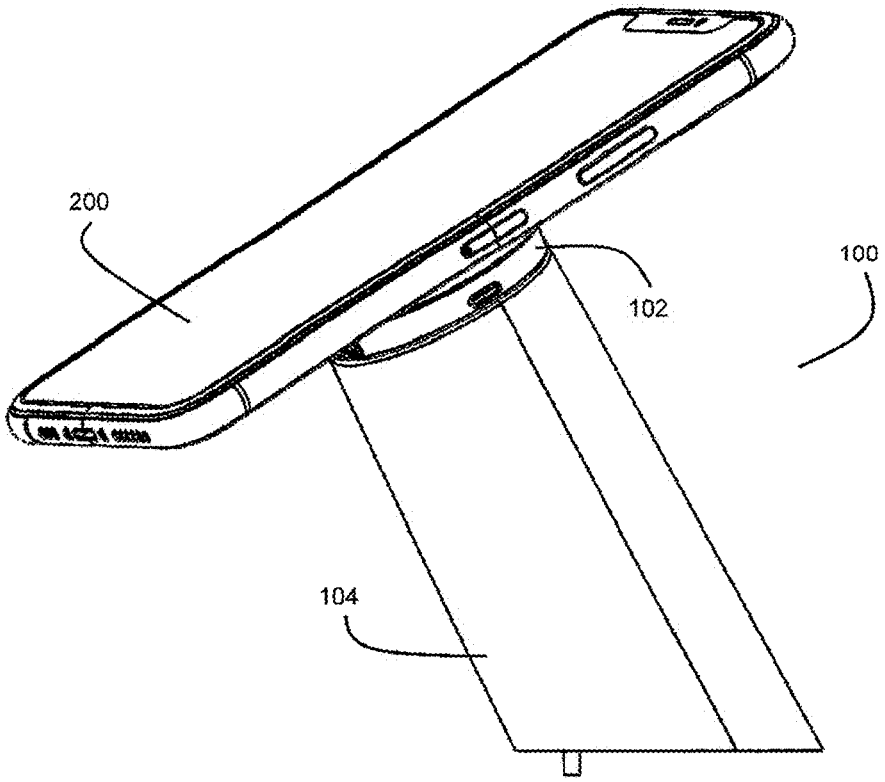

This disclosure is directed to systems for improving the strength of the product display assembly 100 and, in particular, maintain the integrity of the product display assembly 100 in response to a thief applying strong pulling forces on the puck assembly 102 and/or base assembly 104. FIGS. 2A and 2B show example views of an enhanced security product display assembly 100, where the puck assembly 102 is in the lift position relative to the base assembly 104 (see FIG. 2A) and where the puck assembly 102 is in the rest position on the base assembly 104 (see FIG. 2B). Electronic device 200 can be secured to the puck assembly 102 for merchandising to customers. Tether 110 connects the puck assembly 102 and base assembly 104 and can be seen when the puck assembly 102 is in the lift position of FIG. 2A.

For a frame of reference in the discussions below with respect to various components of the disclosed example embodiments for a product display assembly 100, it should be understood that terms such as "upper", "top", "higher", "upward", and the like will refer to a directional relationship that is toward the mounting surface 106 of the puck assembly 102, while terms such as "lower", "bottom", "downward", and the like will refer to a directional relationship that is toward the base assembly 104 or table/surface on which the base assembly is positioned. Length would thus refer to the dimension from an upper portion to a lower portion, and width would refer to the lateral dimension that is orthogonal to the length dimension. Similarly, "vertical" refers to the length dimension for a product display assembly 100 and "horizontal" refers to the width dimension for the product display assembly 100, even if the product display assembly 100 is displayed at a tilted angle (such as shown by FIGS. 2A and 2B).

FIGS. 3-11H show various examples of base assemblies with enhanced security features.

Figure 3:
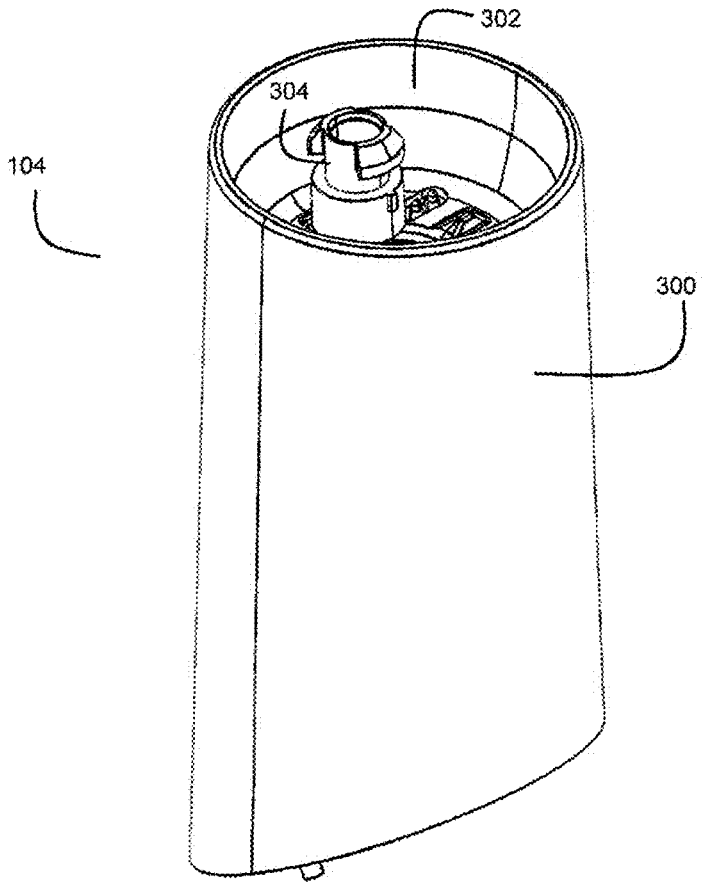
FIG. 3 shows an example base assembly and tether assembly for the product display assembly of FIGS. 2A and 2B.

FIG. 3 shows a perspective view of a base assembly 104 with a tether assembly positioned inside the base assembly. FIG. 3 shows a tether connector 304 located at an end of the tether assembly, where tether connector 304 is positioned inside a recess 302 toward the upper portion of the base assembly 104. Tether connector 304 connect the tether 110 with a puck assembly 102 as discussed below. The base assembly 104 serves as a riser for displaying a product at a post position on a surface such as a display table in a retail store. The base assembly 104 can include a riser sleeve 300 that provides a covering for internal structural components of the base assembly 104, as discussed in greater detail below. Riser sleeve 300 can be formed of a plastic or composite material and can serve a largely decorative purpose. For example, the riser sleeve 300 can be designed to exhibit a desired aesthetically-pleasing appearance for the product display assembly 100. The riser sleeve 300 can be removable from the base assembly 104

Figure 4:
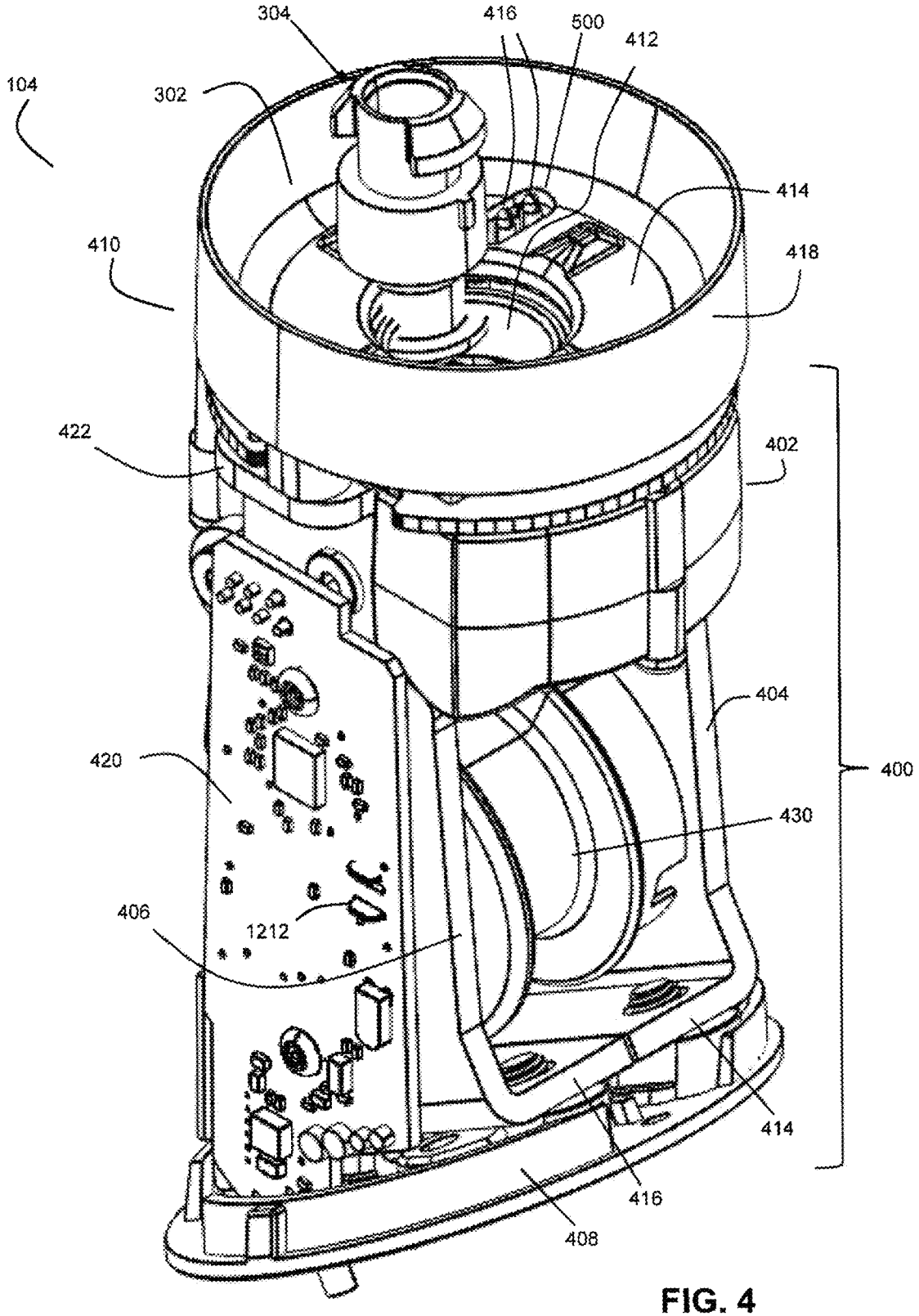
FIG. 4 shows the example base assembly and tether assembly of FIG. 3 with a riser sleeve of the base assembly omitted.

FIG. 4 shows an example view of the base assembly 104 where riser sleeve 300 removed to reveal some of the internal components of the base assembly 104. In order to improve the strength of the base assembly 104, FIG. 4 shows internal components of base assembly 104 include a metal frame 400 that provides structural integrity for the base assembly 104. The metal frame 400 serves as a metal skeleton that resists both pulling and shearing/twisting forces applied to the base assembly 104 either directly or indirectly via pulls/twists on the puck assembly 102 and/or tether 110. The metal frame 400 can be formed from metals, such as aluminum, zinc alloys, or steel (e.g., stainless steel). For example, the metal frame 400 can be formed from die cast aluminum, such as the alloy ADC12 (also known as A383 or 46000).

Metal frame 400 can take any of a number of structural forms or shapes. Metal frame 400 may also include a recess in which a reel 430 of the tether assembly can be positioned, as shown by FIG. 4. In the example of FIG. 4, metal frame 400 comprises a metal crosspiece 402 that defines an upper structure for the metal frame 400, a first metal vertical arm 404, a second metal vertical arm 406, and a metal base plate 408. The reel 430 is positioned within a recess formed between the vertical arms 404 and 406, below the metal crosspiece 402, and above the metal base plate 408. In the example of FIG. 4, the metal crosspiece 402, the first metal vertical arm 404, the metal vertical arm 406, and the metal base plate 408 are separate structures that are secured together via metal screws. In an alternative implementation, the metal frame 400 may be a single one-piece unit.

Figure 8A:
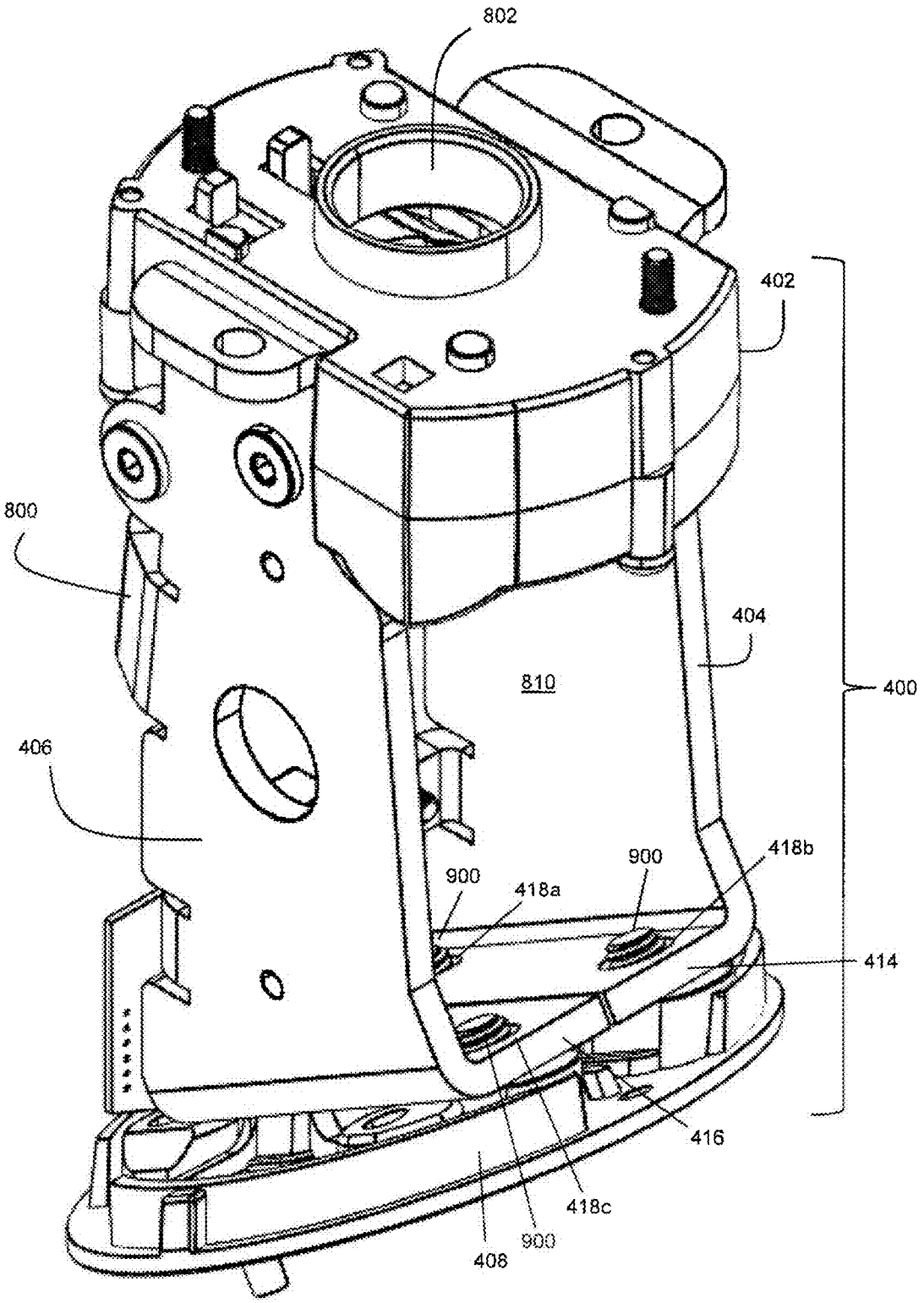
FIG. 8A shows the example base assembly of FIG. 3 with various components removed to show the metal frame of the base assembly.
Figure 8B:
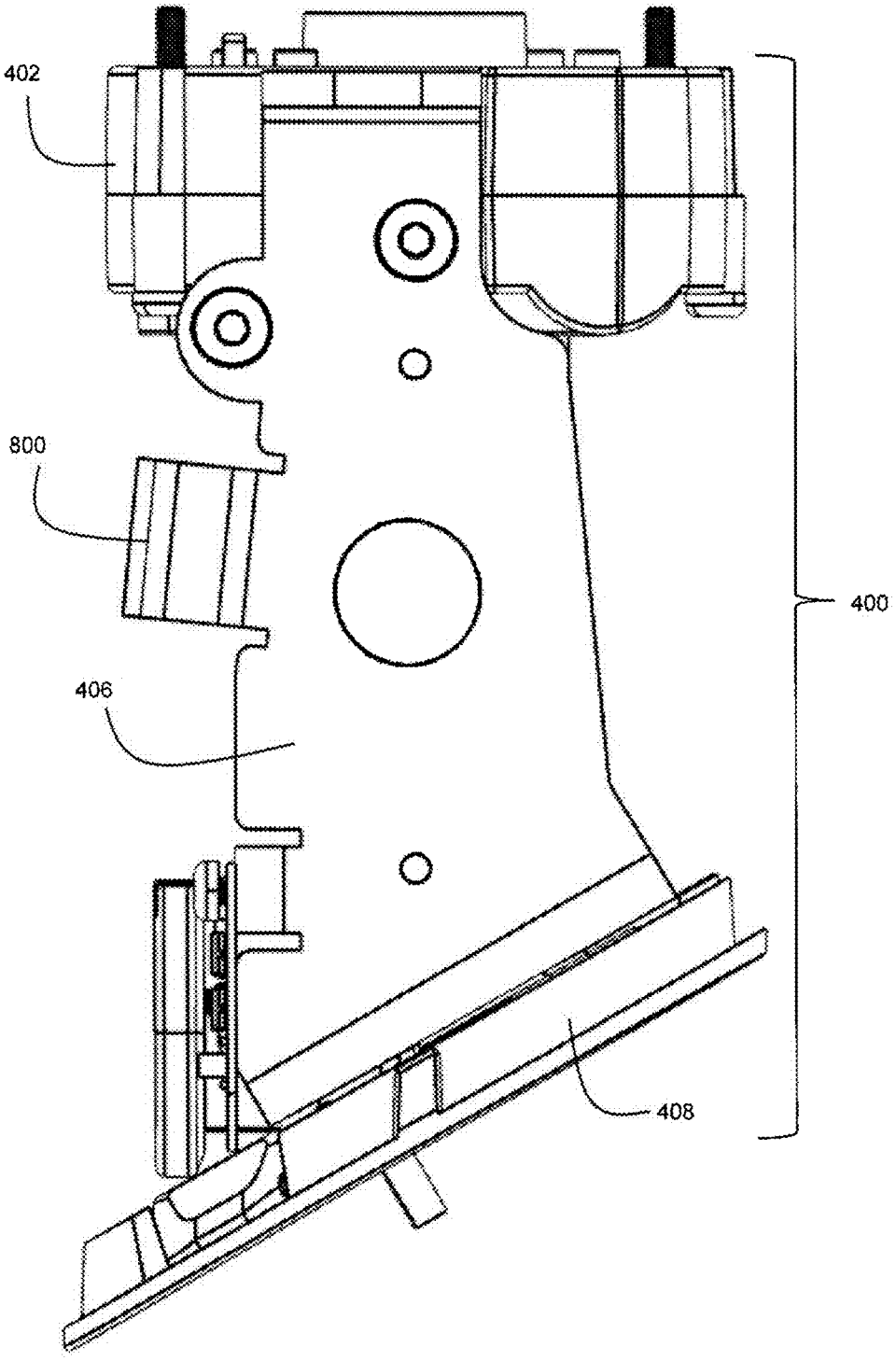
FIG. 8B shows a side view of the base assembly shown in FIG. 8A.
Figure 8C:
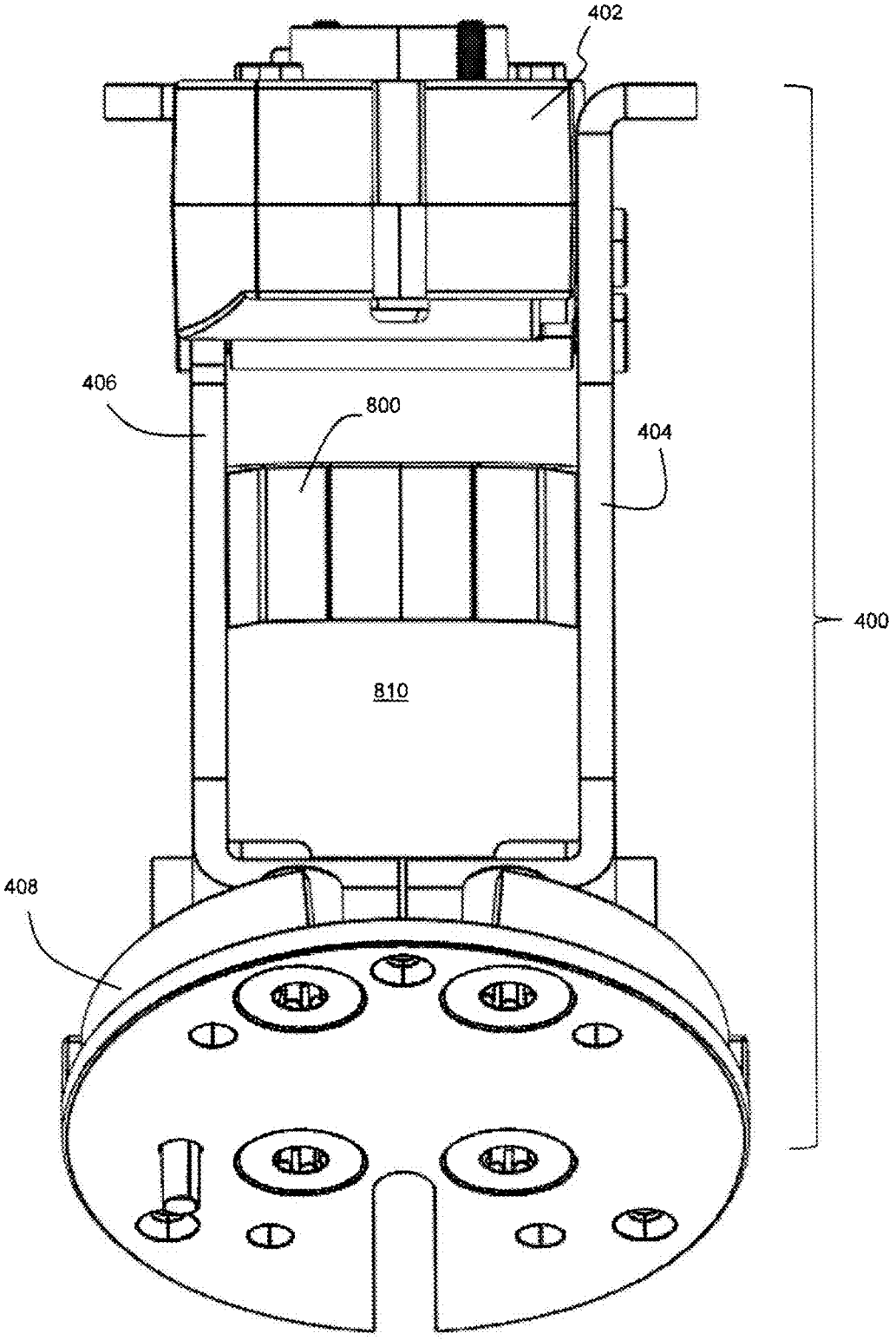
FIG. 8C shows a front view of the base assembly shown in FIG. 8A.
Figure 8D:
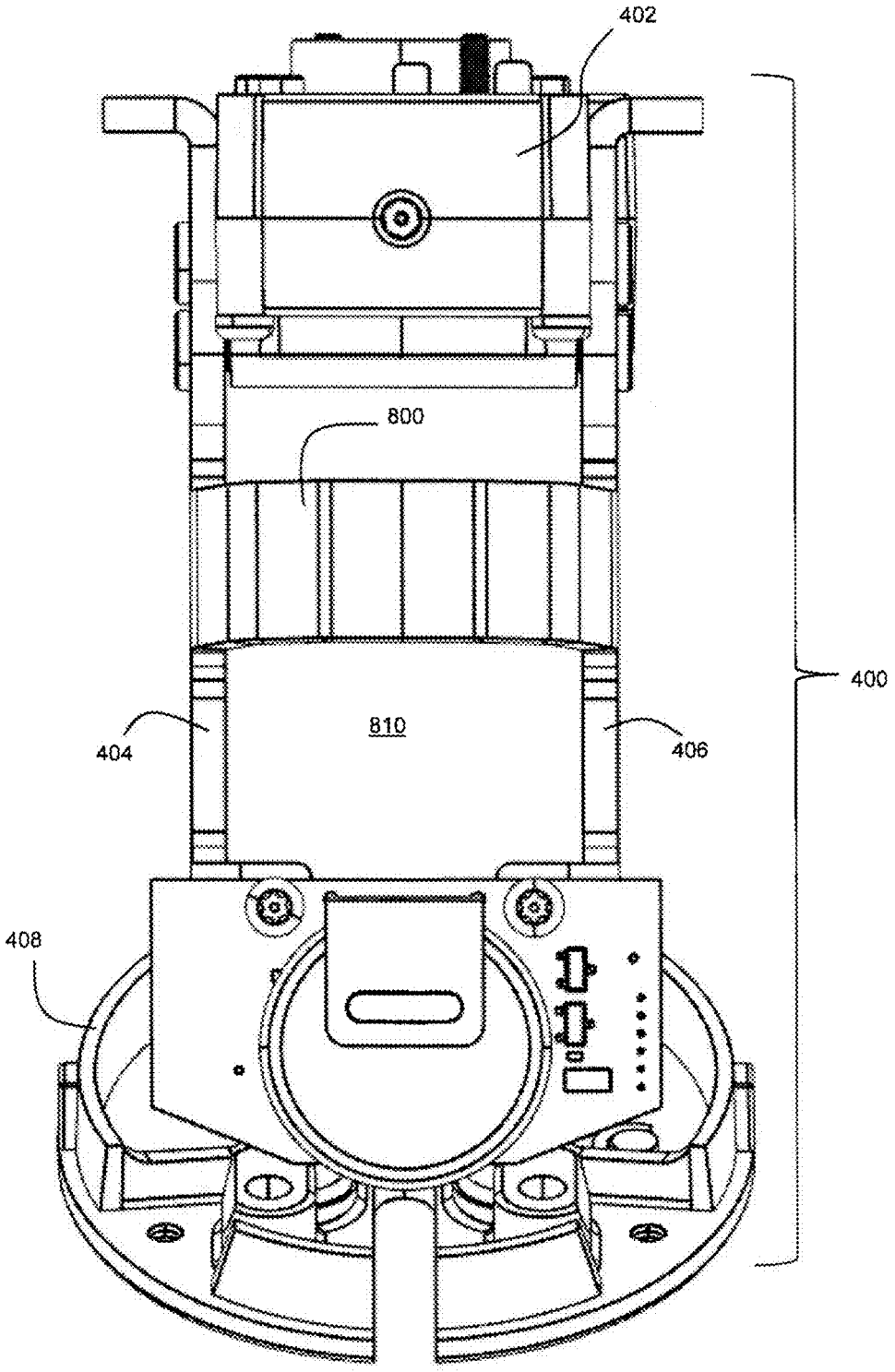
FIG. 8D shows a back view of the base assembly shown in FIG. 8A.

FIGS. 8A-8E show additional views of the metal frame 400 with various other components of the base assembly 104 removed (such as the tether assembly) for ease of viewing. FIG. 8A shows the metal frame recess 810 with the reel 430 shown in FIG. 4 omitted. FIGS. 8A-8D show a metal cross-brace 800 that connects the vertical arms 404 and 406 and provides additional stability for the metal frame 400 in the event of strong twisting/shearing forces applied to the base assembly 104. The metal cross-brace 800 helps to prevent one of the vertical arms 404 and 406 from being displaced relative to the other vertical arm 404 and 406 and allows for insertion of the reel 430. In the example shown in FIGS. 8A-8D, the metal cross-brace 800 is located about midway along the lengths of the vertical the metal frame 400. In the example of FIGS. 8A-8D, the metal cross-brace 800 is located at the back of the metal frame 400 and thus serves as a partial backwall for the metal frame recess 810.

FIGS. 8A-D also show that the vertical arms 404 and 406 can be largely mirrored structures with vertically extending structures. However, the precise dimensions of the vertical arms 404 and 406 can be varied so long as a desired amount of stability for the metal frame 400 is retained. Vertical 404 and 406 arms include flanges 414 and 416, respectively, with screw holes for securing the vertical arms 404 and 406 to the base plate 408. For example, the perspective view in FIG. 8A shows screws inserted into three screw holes 418*a*-418*c*, in which screw holes 418*a* and 418*b* are located in flange 414 and screw hole 418*c* is located in flange 416. Flange 416 includes a second screw hole (not shown) located opposite screw hole 418*a*. Upper portions of the vertical arms 404/406 may include screw holes for securing the vertical arms 404 and 406 to the metal crosspiece 402. Further still, the vertical arms 404 and 406 may include upper flanges with screw holes for attachment to a riser cup 410 as discussed below.

Figure 8E:
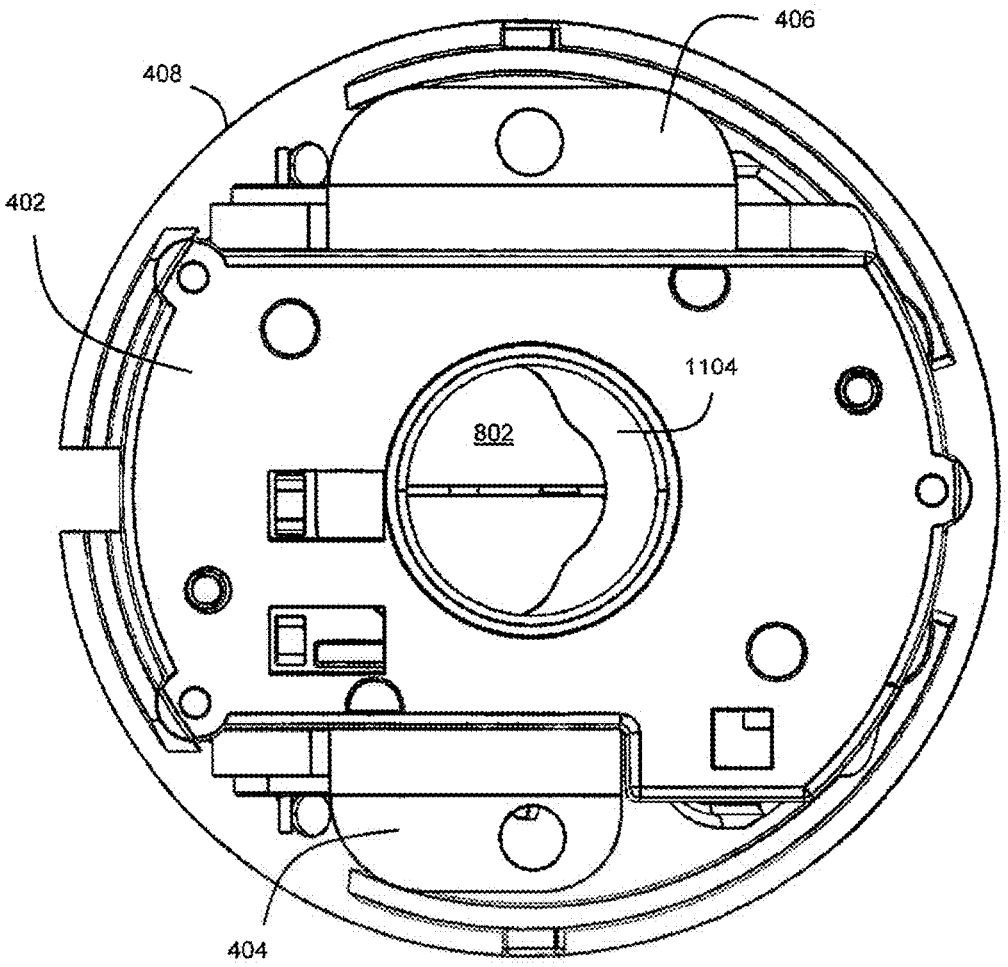
FIG. 8E shows a top view of the base assembly shown in FIG. 8A.

Metal crosspiece 402 includes a metal crosspiece aperture 802 as shown by FIGS. 8A and 8E. Aperture 802 provides a pathway for the tether 110 and at least a portion of the tether connector 304 to pass. FIGS. 8A-8D show the metal crosspiece 402 located between the vertical arms 404 and 406.

Returning to FIG. 4, additional internal components of the base assembly 104 can include a riser cup 410, a first circuit board 420 connected to the outer sidewall of one of the vertical arm 406, and a second circuit board 422 located between the metal crosspiece 402 and the riser cup 410.

The first circuit board 420 can include various circuitry for the base assembly 104, including, but not limited to, power distribution circuitry (for conditioning and transferring power from an external source (e.g., wall or outlet power) for delivery to electronic components in the base assembly 104 and/or puck assembly 102), over voltage protection circuitry, over current protection circuitry, continuity detection circuitry (for detecting whether the puck assembly 102 has been disconnected from the tether 110 and/or whether the tether 110 has been cut), and/or a processor that stores an electronic serial number or other identifier for the base assembly 104.

Figure 6:
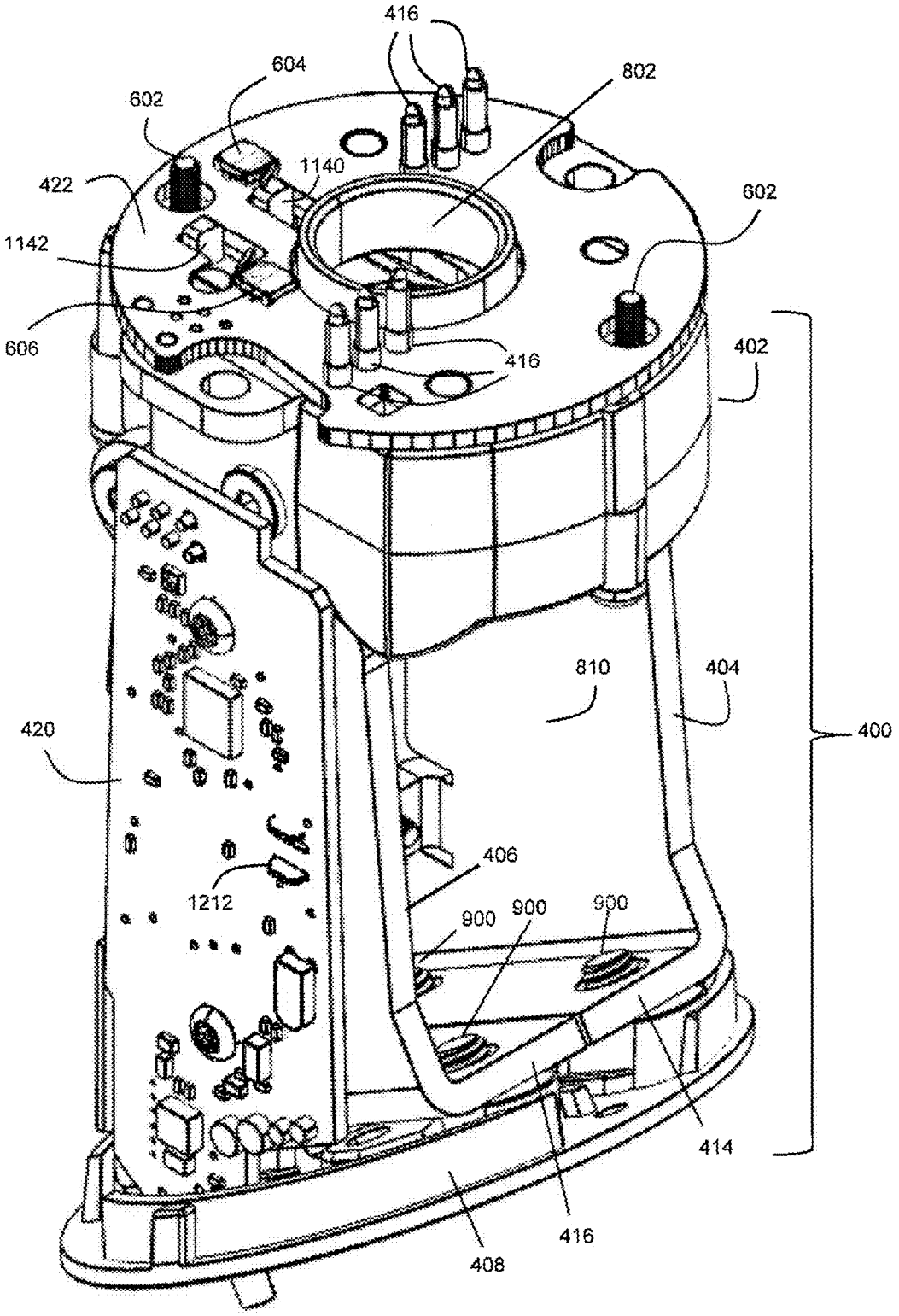
FIG. 6 shows components of an example base assembly.

FIG. 6 shows the second circuit board 422 located on the metal crosspiece 402 with the riser cup 410 omitted, revealing various circuitry, including, but not limited to, motor control circuitry for controlling actuation of a lock as discussed below, lock state detection circuitry, and/or power and/or data pass-through circuitry for transferring power and/or data between the puck assembly 102 and base assembly 104. To support transfer of power and/or data, the second circuit board 422 may include a plurality of contacts 416 that engage with corresponding contacts in the puck assembly 102 when the puck assembly 102 is in the rest position. Such contacts 416 may be pogo pin contacts. The contacts 416 may include power, ground, and data lines.

Figure 5A:
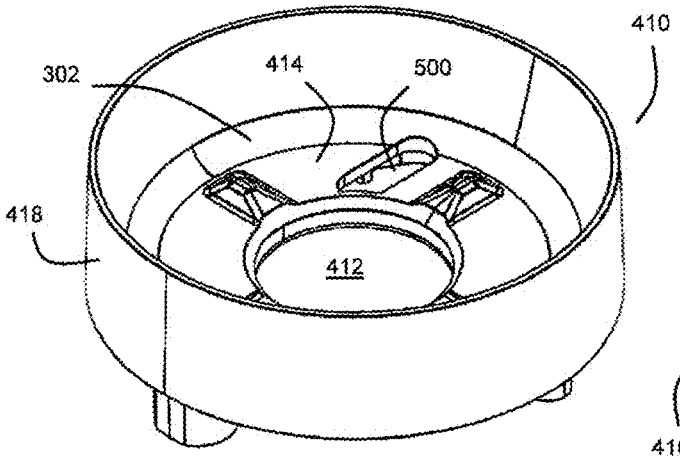
FIGS. 5A-5D show views of an example riser cup for the base assembly of FIG. 3.
Figure 5B:
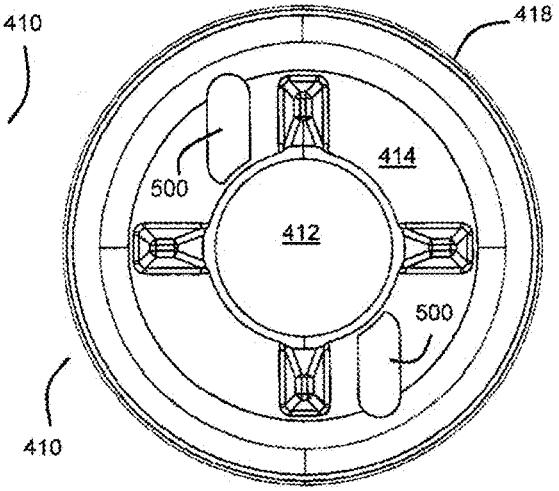
Figure 5C:
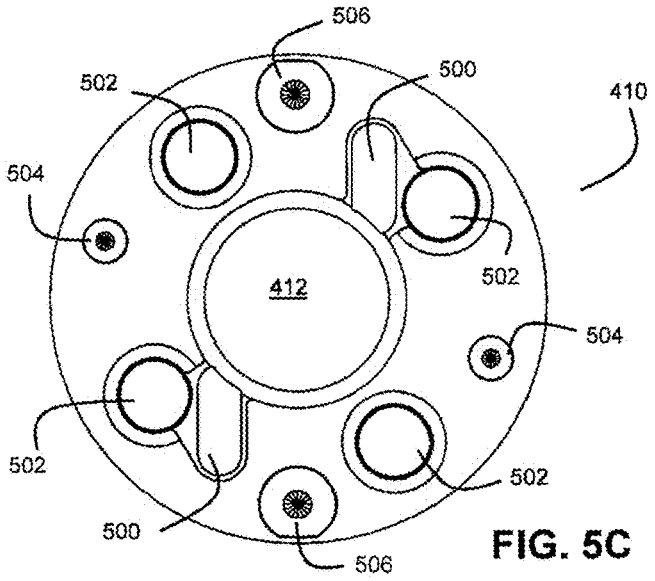
Figure 5D:
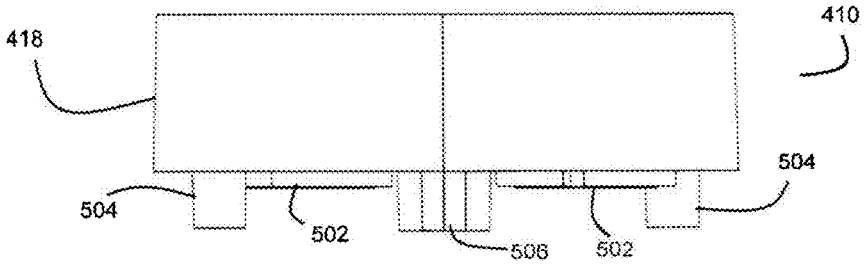

FIGS. 5A-5D show four different view of the riser cup 410. The riser cup 410 can include a central aperture 412 through which the tether 110 and at least a portion of the tether connector 304 can be extended. Riser cup may also include a floor 414 and a peripheral sidewall 418 that define the recess 302 in which a lower portion of the puck assembly 102 can be received when the puck assembly 102 is in the rest position. Riser cup 410 can be formed of a plastic or composite material. FIG. 5A provides a perspective view of an example riser cup 410. FIG. 5B shows a top view of the example riser cup 410. FIG. 5C shows a bottom view of the example riser cup 510. FIG. 5D shows a side view of the example riser cup 410. FIGS. 5A-5C show that the riser cup floor 414 can include apertures 500 for permitting the contacts 416, shown in FIG. 6, to pass through when the riser cup is located on the second circuit board 422. The bottom view of FIG. 5C shows that magnets 502 can be disposed at desired locations within recesses along the bottom of the riser cup 410 to facilitate guiding the puck assembly 102 to a desired orientation when seated in the recess 302 in the rest position. FIG. 5D also shows various extensions 504 and 506 that project downward from the bottom surface of the riser cup 410. Extensions 504 can include screw holes for facilitating a connection between the riser cup 410 and the metal crosspiece 402. Extensions 506 can include screw holes for facilitating a connection between the riser cup 410 and the vertical arms 404 and 406 (see also FIG. 5C).

Returning to FIG. 6, the second circuit board 422 has a central aperture through which the tether 110 and at least a portion of the tether connector 304 can pass. The second circuit board 422 also includes apertures for screws 602 to pass through to facilitate a connection between the metal crosspiece 402 and the riser cup 410. FIG. 6 shows lock sensor circuitry 604 and 606 that detect the state of a lock that is capable of locking the puck assembly 102 to the base assembly 104 as discussed below. The second circuit board 422 includes apertures through which movable extension tabs 1140 and 1142 from the lock can extend. Based on whether the lock is in the locked state, the unlocked state, and/or whether the tether connector 304 is collared by the lock, the lock sensor circuits 604 and 606 are able to detect where the extension tabs 1140 and 1142 are positioned so that the base assembly 104 can track the state of the lockdown, as discussed further below.

Figure 7A:
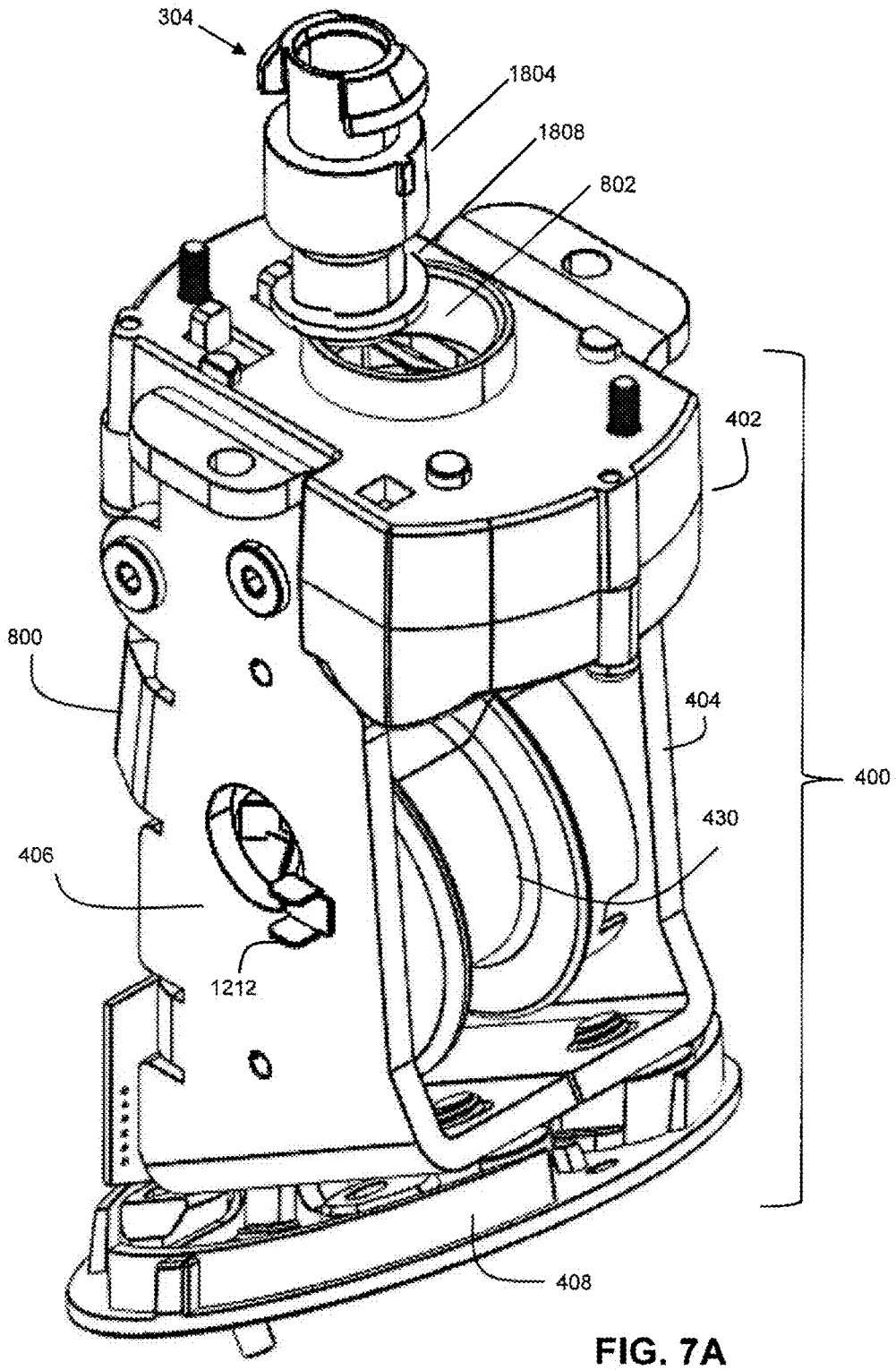
FIG. 7A shows the example base assembly and tether assembly of FIG. 3 with various components removed to show a metal frame for the base assembly.
Figure 7B:
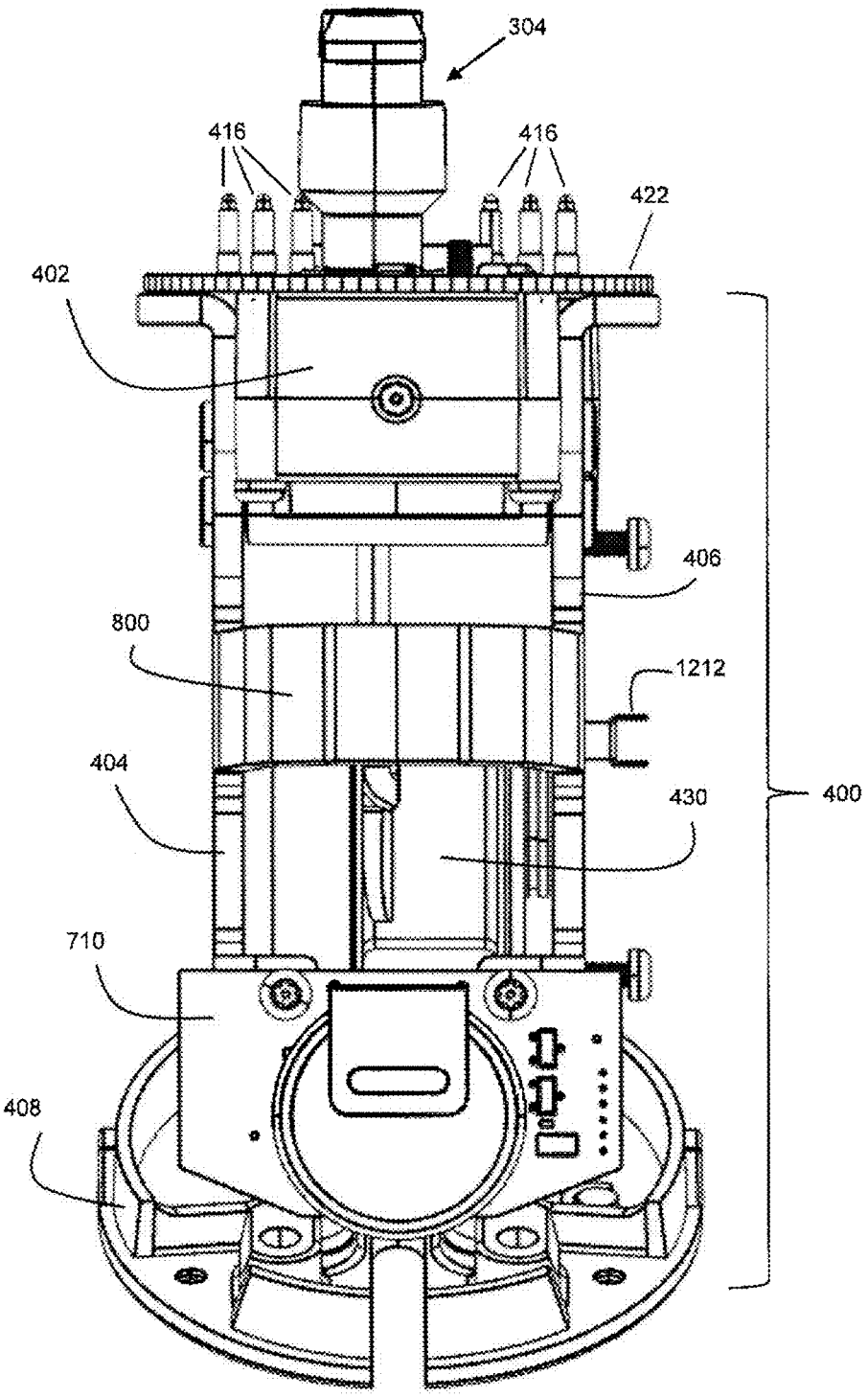
FIG. 7B shows a back view of the base assembly shown in FIG. 7A.

FIG. 7A shows a perspective view of the base assembly 104 with the first and second circuit boards 420 and 422 removed to reveal the metal crosspiece 402 and how the tether 110 and a portion of the tether connector 304 extend through the aperture 802. FIG. 7B shows a side elevation view of the base assembly with the second circuit board 422 located on metal crosspiece 402 and a third circuit board 710. This circuit board 710 can include a battery for battery backup operations for the base assembly 104. Circuit board 710 is secured to the vertical arms 404 and 406 across a lower portion of the metal frame 400.

Figure 9:
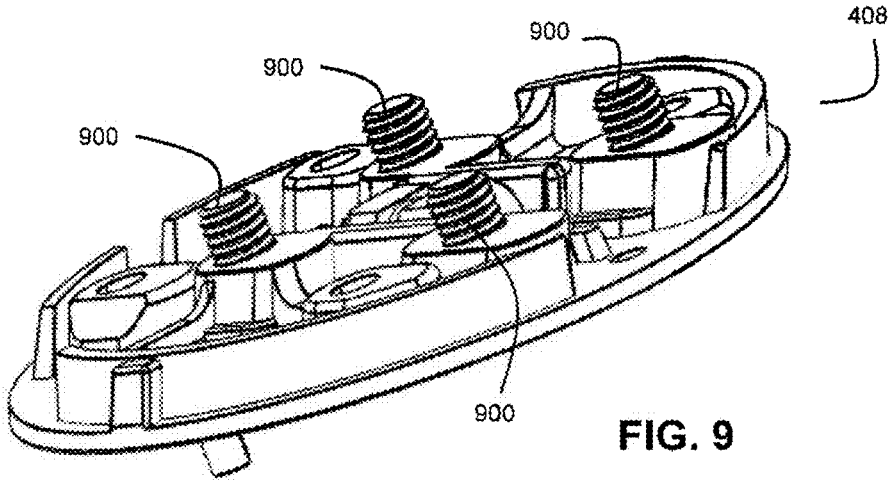
FIG. 9 shows a perspective view of an example metal base plate of the base assembly.

FIG. 9 shows an example metal base plate 408 for use with the metal frame 400. FIG. 9 also shows screws 900 that extend upward from the metal base plate 408. When the metal base plate 408 is attached to the flanges 414 and 416 of the vertical metal arms 404 and 416, the screws 900 pass through screw holes 418, as shown in FIGS. 4, 6, 7A, and 8A.

Figure 10A:
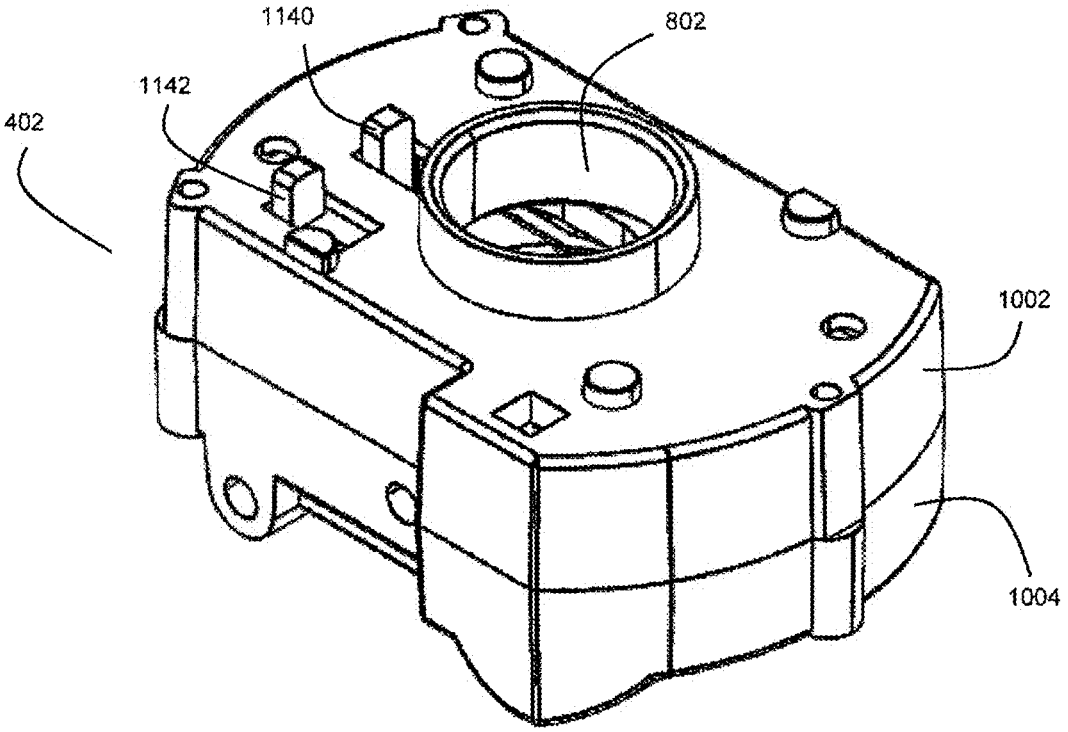
FIG. 10A shows a perspective view of example metal crosspiece of the base assembly of FIG. 8A.
Figure 10B:
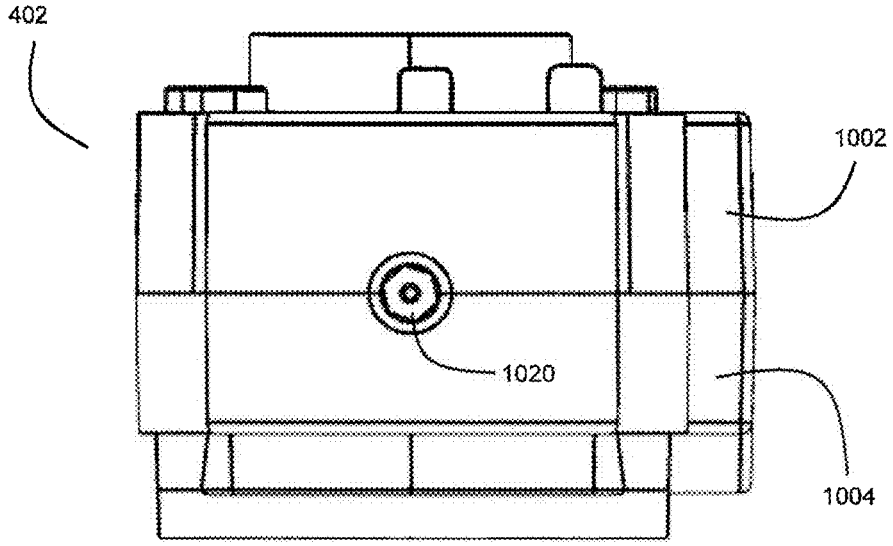
FIG. 10B shows a side view of the metal crosspiece shown in FIG. 10A.

FIG. 10A shows a perspective view of an example metal crosspiece 402. FIG. 10B shows a side view of the metal crosspiece 402 of FIG. 10A. The metal crosspiece 402 can be formed from an upper piece 1002 and a lower piece 1004. When joined together, the upper and lower pieces 1002, 1004 form interior chamber for the metal crosspiece 402. A lock can be positioned in this interior chamber. The lock provides a lockdown of the puck assembly 102 to the base assembly 104 so that the puck assembly 102 cannot be lifted from the rest position to the lift position. FIG. 10A show the contact extension tabs 1140 and 1142 extend above a surface of the metal crosspiece 402 to operate in connection with the lock sensor circuitry 604 and 606 to facilitate detection of the lockdown state of the base assembly 104. FIG. 10B shows a tool interface 1020 that can be located on an outer surface of the metal crosspiece 402 (such as a back side surface). Tool interface 1020 can receive a tool for operating the lock shown in FIG. 11.

Figure 11A:
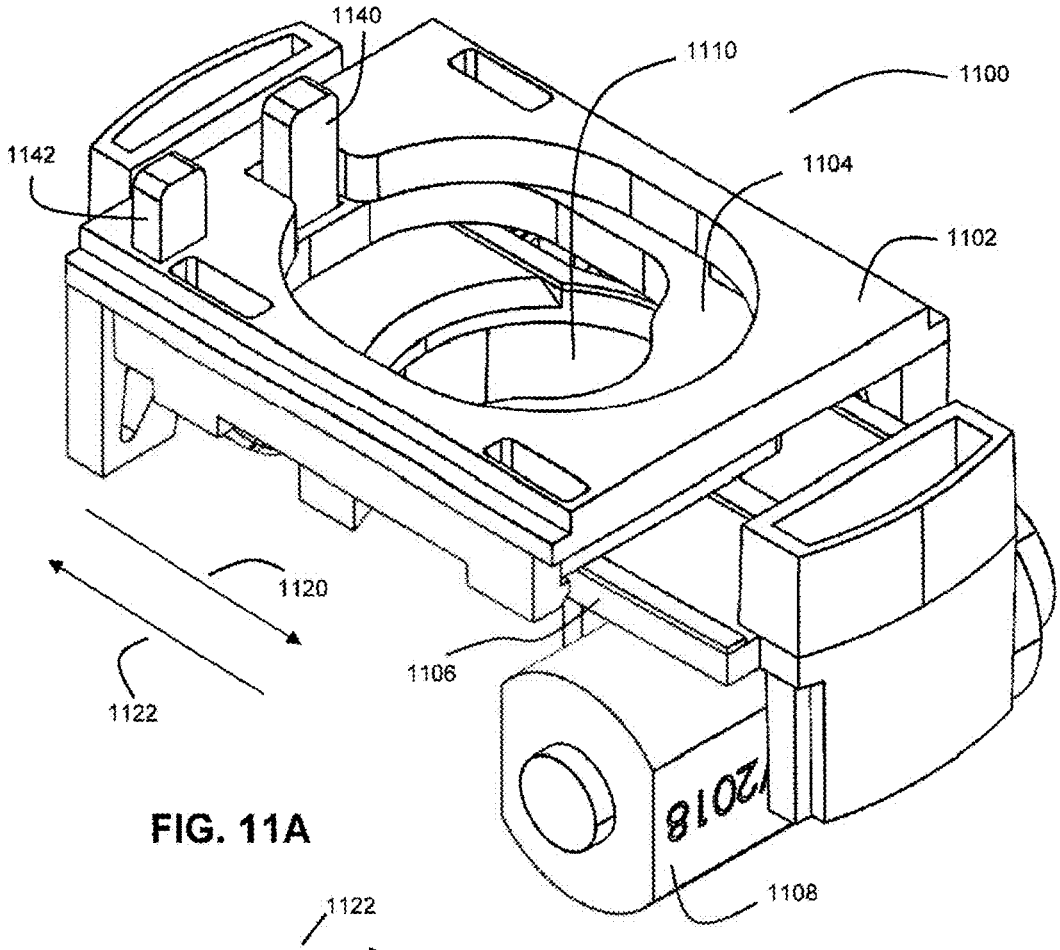
FIG. 11A shows an example lock for locking a puck assembly to a base assembly.

FIG. 11A shows an example lock 1100 located within the metal crosspiece 402 for locking the puck assembly 102 to the base assembly 104. The lock 1100 collars a neck of the tether connector 304 to prevent upward movement of the tether connector 304 (and its connected puck assembly 102) even if someone pulls on the puck assembly 102.

Lock 1100 can be switched between a locked state and an unlocked state in response to operation of a tool on tool interface 1020 and/or a wireless signal received by the product display assembly 100 from a remote source. For the latter case, the product display assembly 100 can include a wireless transceiver that provides wireless connectivity with a remote computer system that can monitor the product display assembly 100 and remotely provide control and command instructions to the product display assembly 100 (such as a command to lock or unlock the lock 1100) and operate motor 1108. Lock 1100 provides the lockdown capability via a slidable collar 1104 that collars a neck portion of the tether connector 304 that may pass through common aperture 1110. The common aperture 1110 is formed from an aperture 1150 in the slidable collar 1104, an aperture 1152 in the shuttle 1102, and an aperture 1154 in the rail 1106 as shown in exploded view of FIG. 11C. As shown in FIG. 11A, slidable collar 1104 is capable of sliding in directions 1120 and 1122. The slidable collar 1104 can be moved along directions 1120 and 1122 between a locked position and an unlocked position. FIG. 11A shows the slidable collar 1104 in a locked position.

The lock 1100 can include a shuttle 1102 that facilitates control over where the slidable collar 1104 is positioned. Shuttle 1102 is also capable of sliding in directions 1120 and 1122 indicated by FIG. 11A. The rail 1106 serves as the base on which the shuttle 1102 and collar 1104 can slide. In the example of FIG. 11A, the rail 1106 is located below the shuttle 1102 and the collar 1104, and the collar 1104 is located between the shuttle and the rail 1106. For strength, the shuttle 1102, collar 1104, and rail 1106 may be formed from metal. Examples of suitable metals include aluminum, zinc alloys, or steel (e.g., stainless steel).

Figure 11B:
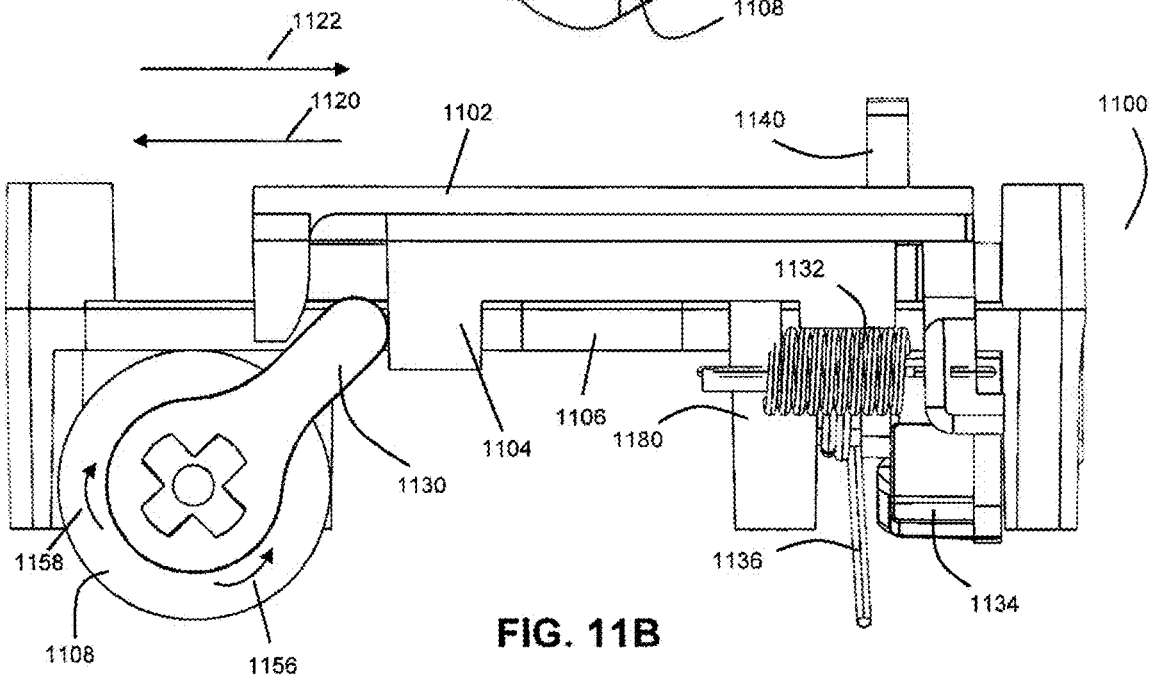
FIG. 11B shows a side view of the lock shown in FIG. 11A.

FIG. 11B shows side view of the lock 1100. The lock 1100 includes a bias spring 1132 that connects the collar 1104 with the rail 1102 and biases the collar 1104 to a locked position. The innovative lock design shown by FIGS. 11A-11H is capable of moving the collar 1104 into an unlocked position in two ways.

Figure 11C:
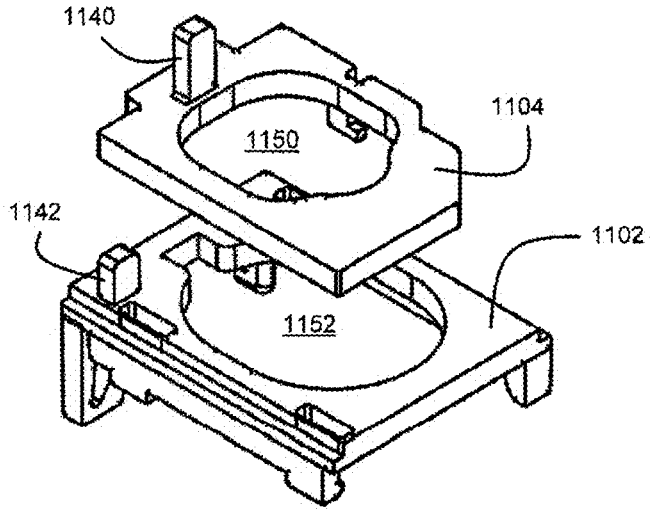
FIG. 11C shows an exploded view of the lock shown in FIG. 11A.
Figure 11C:
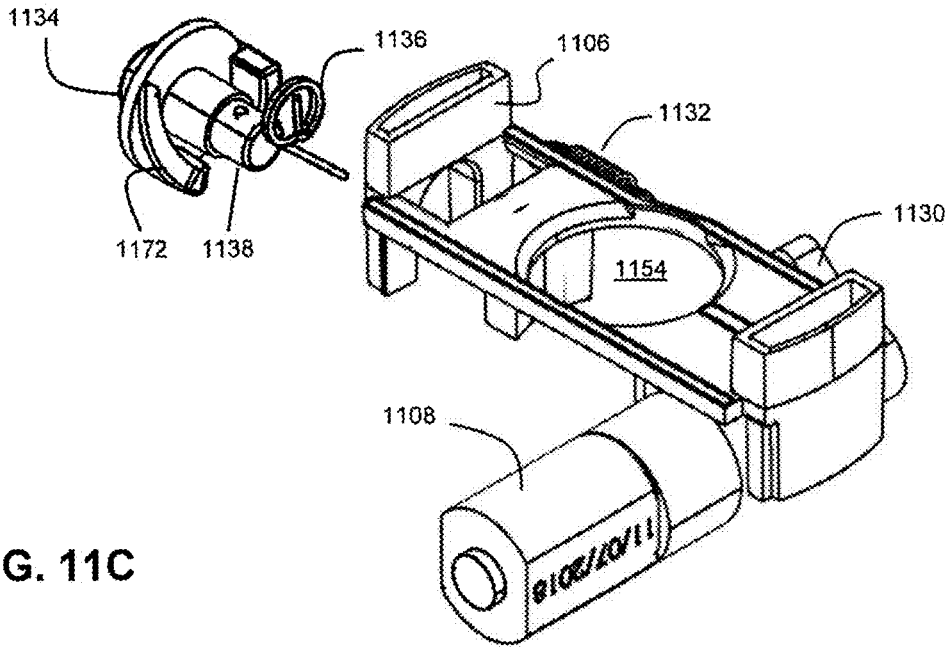

FIG. 11C shows an exploded view of the lock 1100. The collar aperture 1150 of the slidable collar 1104 can be clearly seen, as can the shuttle aperture 1152 of the shuttle 1102 and the rail aperture 1154 of the rail 1106. Together, these apertures define the common aperture 1110. The dimensions of apertures 1150, 1152, and 1154 need not each be the same, so long as there is a common aperture 1110 between them that will accommodate the tether 110 and tether connector 304. The dimensions of the collar aperture 1150 should be sufficient to permit passage of the tether 110 and tether connector 304 when the collar 1104 is in the unlocked position while blocking upward movement of the tether connector 304 when the collar 1104 is in the locked position (where the part of the collar 1104 by a periphery of the collar aperture 1150 will engage with a head or shoulder region of the tether connector to restrict upward movement of the tether connector 304.

Figure 11D:
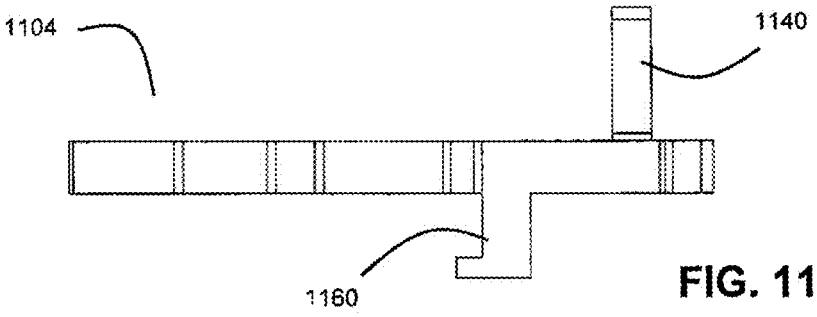
FIG. 11D shows a side view of an example collar component of the lock shown in FIG. 11A.
Figure 11E:
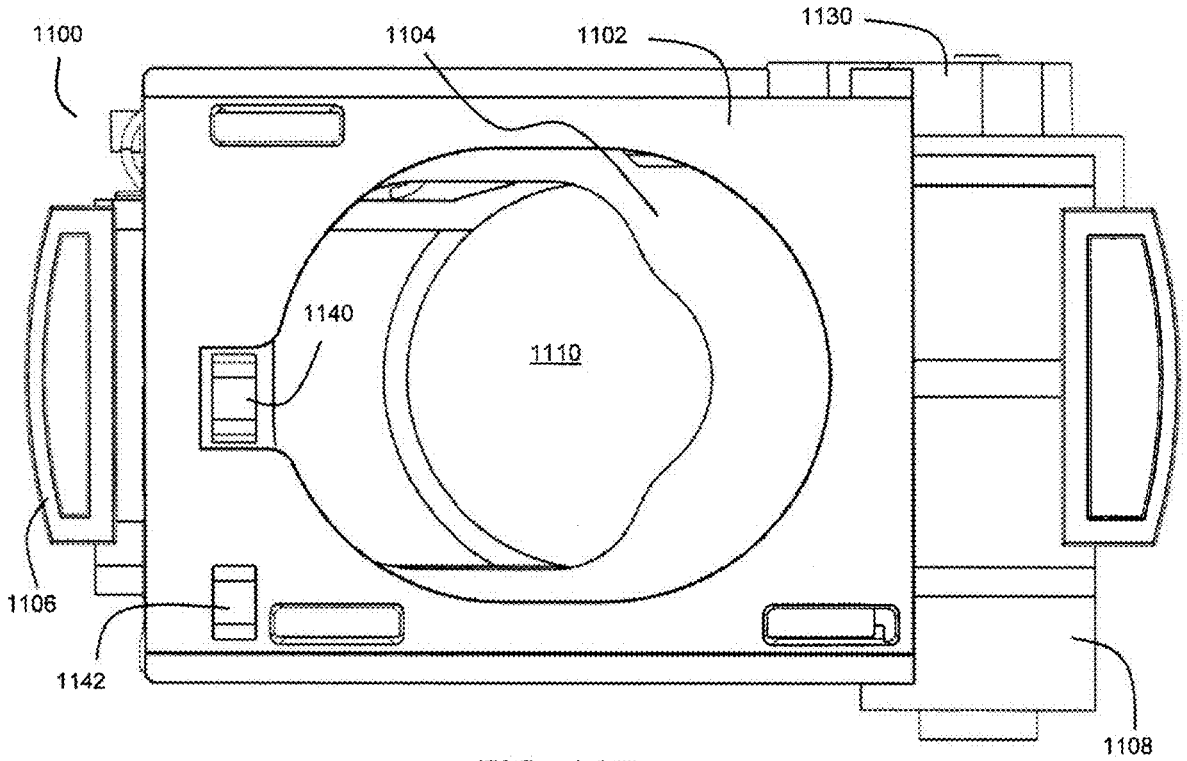
FIG. 11E shows a top view of the lock shown in FIG. 11A.
Figure 11F:
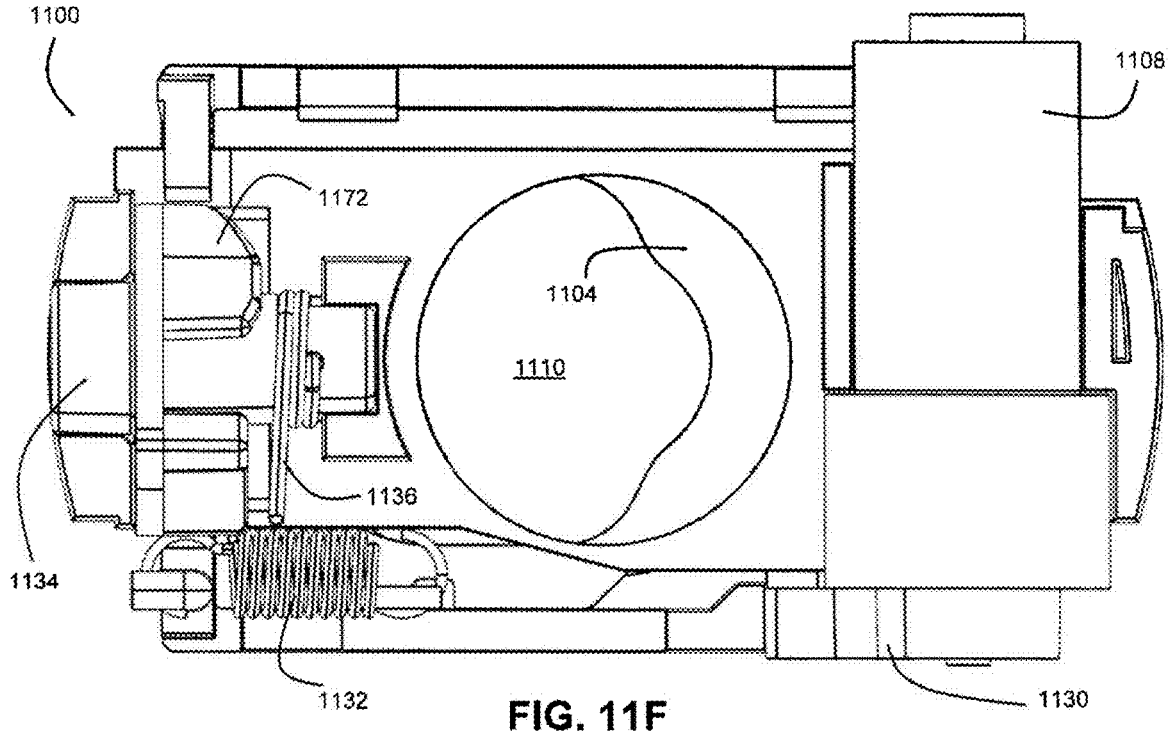
FIG. 11F shows a bottom view of the lock shown in FIG. 11A.

FIG. 11D shows a side view of the collar 1104. In this side view, a downward extension 1160 from the bottom surface of the collar 1104 can be seen. An end of the bias spring 1132 can be connected to this extension 1160 in order to connect the bias spring 1132 between the collar 1104 and rail. The rail 1106 can also include an aperture for connecting with the opposite end of the bias spring 1132.

One way to unlock the lock 1100 is to activate the motor 1108 to rotates the lever arm 1130 that drives the shuttle 1102 in the direction indicated by 1120. As shown by FIG. 11A, shuttle 1102 will then catch the collar 1104 via collar extension tab 1140 and force the collar 1104 to also move in direction 1120. This movement driven by the motor 1108 overcomes the bias force of the spring 1136 so that the collar 1104 can move to the unlocked position. When collar 1104 slides to the unlocked position, the periphery of the collar 1104 aperture 1150 (see FIG. 11C) will no longer collar the neck of the tether connector 306, thereby permitting an unwinding extension of the tether 110 in response to a pulling force applied to the puck assembly 102. Motor 1108 can force such movement of the shuttle 1102 via the lever an arm 1130 that is rotated when the motor 1108 is activated. Thus, with reference to the example of FIG. 11B, the motor 1108 can rotate the arm 1130 counterclockwise 1156 so that arm 1130 drives the shuttle 1102 in the direction indicated by arrow 1120, which stretches the bias spring 1132 and the collar 1104 moves with the shuttle 1102 via engagement between the shuttle 1102 and extension tab 1140. As shown in FIG. 11B, to return the collar 1104 to the locked position, the motor 1108 can be activated to rotate the lever arm 1130 clockwise 1158, which drives the collar 1104 in the direction indicated by arrow 1122 and releases the extension tab 1140 from the shuttle 1102. Once the collar 1104 is released from the shuttle 1102 in this manner, the bias spring 1132 compresses, which forces the collar 1104 to the locked position. Activation of the motor 1108 can be made contingent on receipt by the product display assembly 100 of an unlock command from a remote computer system.

Figure 11G:
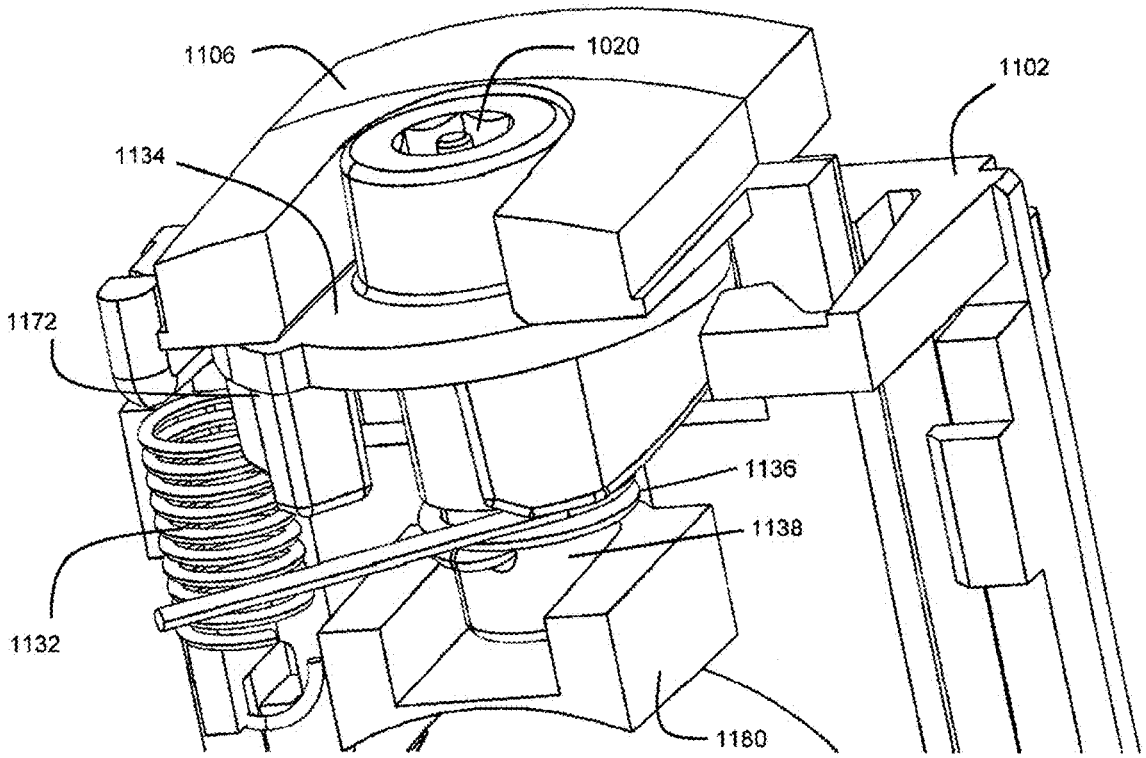
FIGS. 11G and 11H show different perspective views of the lock shown in FIG. 11A.
Figure 11H:
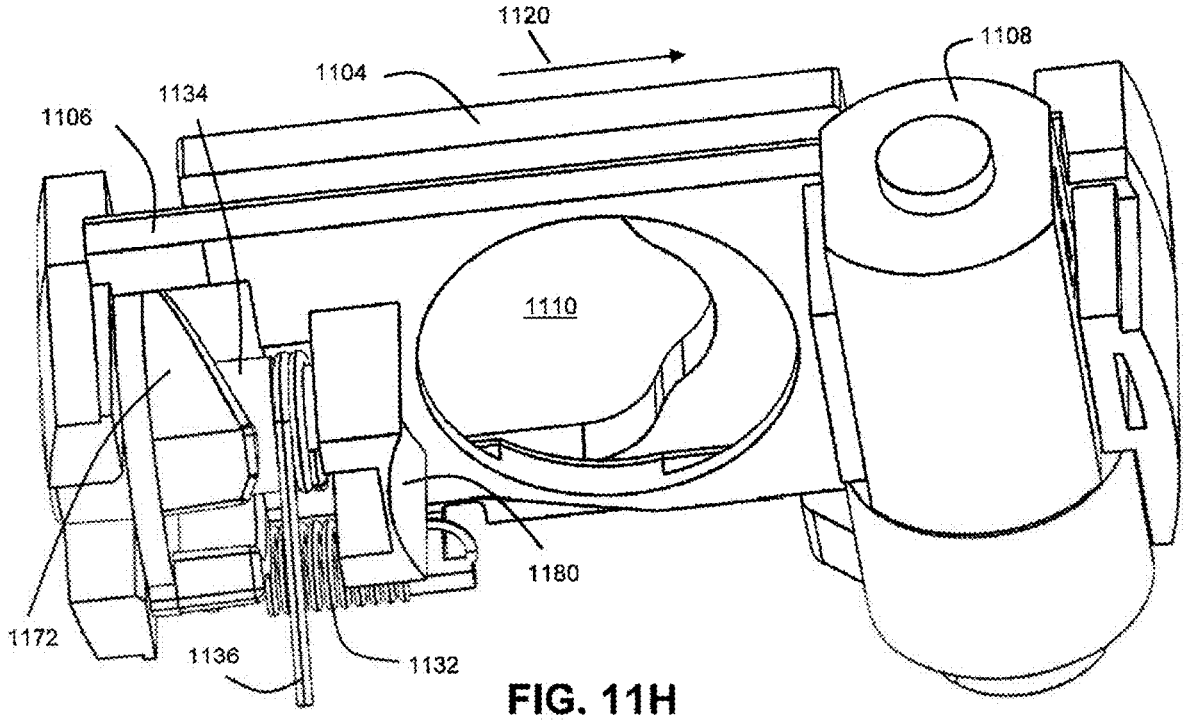

The lock 1100 includes an actuator 1134 that may be used to mechanically lock and unlock the lock 110 using a tool that engages the tool interface 1020 as now described with reference to FIGS. 11C and 11F-11H. In response to engagement of the tool with the tool interface 1020 of the actuator 1134, the actuator 1134 can force the collar 1104 to move in the direction indicated by arrow 1120. For example, in FIG. 11G, the actuator 1134 can rotate clockwise in response to operation of a tool on tool interface 1020. In this example, the tool interface 1020 can be shaped to accept a hexagonal head on a tool that a user can then rotate clockwise. However, it should be understood that tool interface 1020 can be designed to accommodate more complex shapes that are harder for thieves to use, such as keys that operate on interfaces with complex dimensions at different depths. The actuator 1134 includes a round plate that is capable of rotating in response to rotational force applied by the tool, and this will cause a sloped extension 1172 to move toward the collar 1104. The sloped extension 1172 projects from an outer periphery of the plate on actuator 1134 on the actuator side opposite the tool interface 1020. When the sloped extension 1172 rotates sufficiently far, the sloped extension 1172 will engage the collar 1104 via a wedging action (where the narrow part of the slope first hits the collar 1104 followed by the wider parts of the slope as rotation continues). The nature of this interaction is shown in FIG. 11H where the underside of the lock 1100 can be seen. This wedging action will apply force to the collar 1104 that overcomes the bias force of spring 1132 and moves the collar 1104 in the direction of arrow 1120 to the unlocked position. The actuator 1134 can also include a bias spring 1136 that wraps around a cylindrical extension 1138 of the actuator 1134. Bias spring 1136 is biased to rotate the actuator 1134 back to a default position where the sloped extension 1172 does not engage with the collar 1104 (see FIG. 11G). When the tool is removed from the tool interface 1020, and rotational force is no longer being applied to actuator 1134, the bias spring 1136 will return the actuator 1134 to its default position, which allows the collar 1104 to return the locked position, provided the motor 1108 has not been activated to rotate the arm 1130 to unlock the collar 1104. As shown in FIGS. 11B, 11G, and 11H, the rail 1106 includes an extension 1180 that holds the actuator 1134.

Note that the lock 1100 provides for both electronic locking via the motor 1108 and for dual, independent electronic and mechanical unlocking via the motor 1108 and the actuator 1134, respectively. The puck assembly 102 may be locked to the base assembly 104 via a signal sent to the product display assembly 100 that will cause activation of the motor 1108 in a manner that drives the collar 1104 into the locked position. While locked, there are two options for unlocking the puck assembly 102: Frist, a wireless unlock signal can be sent to the product display assembly to electronically unlock the lock 1100. Second, a tool can be inserted into the tool interface 1020 to mechanically unlock the lock 1100.

Another innovative aspect of the lock 1100 is that the slidable of collar 1104 permits a downward insertion of the tether connector 304 from above the lock 1100 into locking position inside the lock 1100, even if the lock 1100 is already in the locked state on the tether 110. As the tether connector 304 is pushed downward through the common aperture 1110, the tapered ring 1808 of the tether connector 304 can temporarily displace the collar 1104 to an unlocked position to thereby permit further downward passage of the tether connector 304 through the common aperture 1110 until a neck region of the tether connector 304 is aligned with the collar 1104. When the neck region of the tether connector 304 is so aligned, the bias force of spring 1132 will cause the collar 1104 to return the collar 1104 to the locked position, thereby locking the tether connector 304 and the connected puck assembly 102 in place. In the example of FIGS. 11A-11H, the collar 1104 can have a flat upper surface, and the bottom portion of the tapered ring 1808 of tether connector 304 provides a wedging action that displaces the collar 1104 when the tether connector 304 is pushed downward on the collar 1104. In an alternative implementation, the collar 1104 may have a sloping surface along the periphery of the collar aperture 1150 that enables and the tether connector 304 to displacing the collar 1104 in response to a downward force applied to the tether connector 304.

As noted above, collar extension tab 1140 and shuttle extension tab 1142 can interact with lock sensory circuitry 604 and 606, respectively, of the second circuit board 422 to permit the base assembly 104 to detect and track whether the lock 1100 is in the locked state, detect and track whether the lock is in the unlocked state, and detect and track whether the collar 1104 has been physically moved to an unlocked position while the position of shuttle 1102 would otherwise indicate that the lock 1100 should be in the locked state. For example, returning to FIG. 6, if the lock 1100 is in the locked state with collar 1104 in the locked position, the collar extension tab 1140 will contact the lock sensor circuitry 604, which can serve as a data point tracked by the second circuit board 422 and the shuttle extension tab 1142 will not contact the lock sensor circuitry 606, which can serve as another data point tracked by the second circuit board 422. If the lock 1100 has been electronically unlocked and the collar 1104 is in the unlocked position, the collar extension tab 1140 will not contact the lock sensor circuitry 604, which can serve as a data point tracked by the second circuit board 442 and the shuttle extension tab 1142 will contact the lock sensor circuitry 606, which can serve as another data point tracked by the circuit. If the lock 1100 has been electronically unlocked but the collar 1104 has been physically moved to the unlocked position (via either operation of a tool on tool interface 1020 or downward insertion of the tether connector 304 through the common aperture 1110 as noted above), the collar extension tab 1140 will not contact the lock sensor circuitry 604, which can serve as a data point tracked by the second circuit board 422 and the shuttle extension tab 1142 will not contact the lock sensor circuitry 606, which can serve as another data point tracked by the circuit. Accordingly, a logic table such as that shown below maps the state of lock sensor circuitry 604 and 606 to track the locked or unlocked state of the lock 1100.

Logic Table

| State of Lock Sensor Circuitry 604 | State of Lock Sensor Circuitry 606 | Lock/Unlocked State of the collar 1104 |
|---|---|---|
| 0 (open) | 0 (open) | Unlocked via mechanical or physical operation |
| 0 (open) | 1 (closed) | Unlocked via electronic operation |
| 1 (closed) | 0 (open) | Locked |
| 1 (closed) | 1 (closed) | NA-Unused State |

In the logic table, open states for lock sensor circuitry 604 and 606 indicates that the corresponding extension tabs 1140 and 1142 are not in contact with the applicable lock sensor circuitry 604 and 606 and the collar 1104 is unlocked. A closed state for lock sensor circuitry 604 and 606 indicates that the corresponding extension tabs 1140 and 1142 contact the applicable lock sensor circuitry 604 and 606. Furthermore, when combined with other data points that are available with the system (such as data indicating that the puck assembly 102 is in the rest position—in which case the contacts 416 will be in circuit with corresponding contacts on the puck assembly 102), the product display assembly 100 is capable of tracking whether the puck assembly 100 has actually been locked down to the base assembly 100 and whether a mechanical/physical unlock event has happened). An open state of the lock sensor circuitry 604 and a closed state of the lock sensor circuitry 606 indicates the collar 1104 is unlocked. A closed state of the lock sensor circuitry 604 and an open state of the lock sensor circuitry 606, as shown in FIG. 6, indicates the collar 1104 is locked.

Also, while the discussion herein for lock 1100 mentions using the lock 1100 to collar a neck of tether connector 304, it should be understood that the lock 1100 can collar neck portions of other items if desired. For example, a lower portion of the puck assembly 102 can include a neck that is collared by collar 1104 when the collar 1104 is in the locked position. In such a case, a separate tether connector 304 can be omitted from the product display assembly 100.

FIGS. 12A-20 show various examples of tether assemblies with enhanced security features.

Figure 12A:
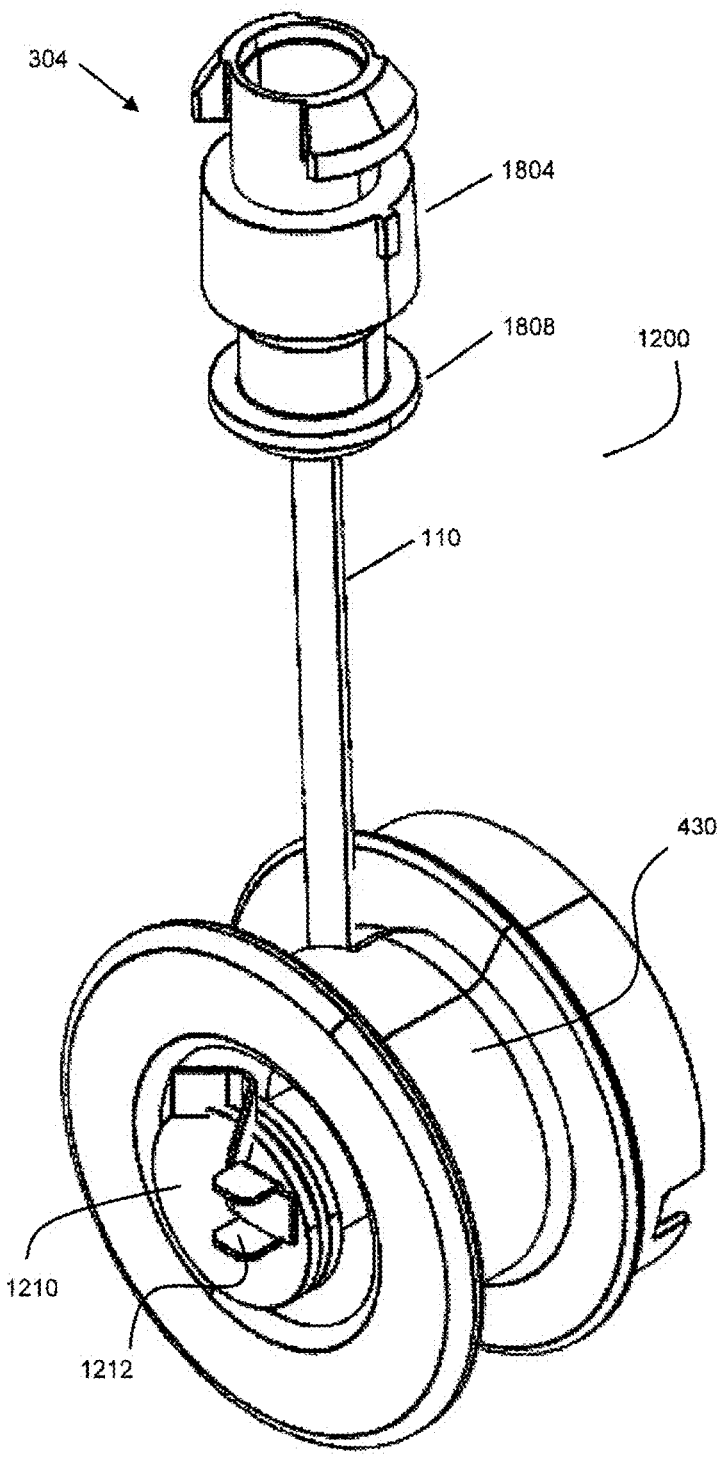
FIG. 12A shows an example tether assembly for use with the base assembly shown in FIG. 3.
Figure 12B:
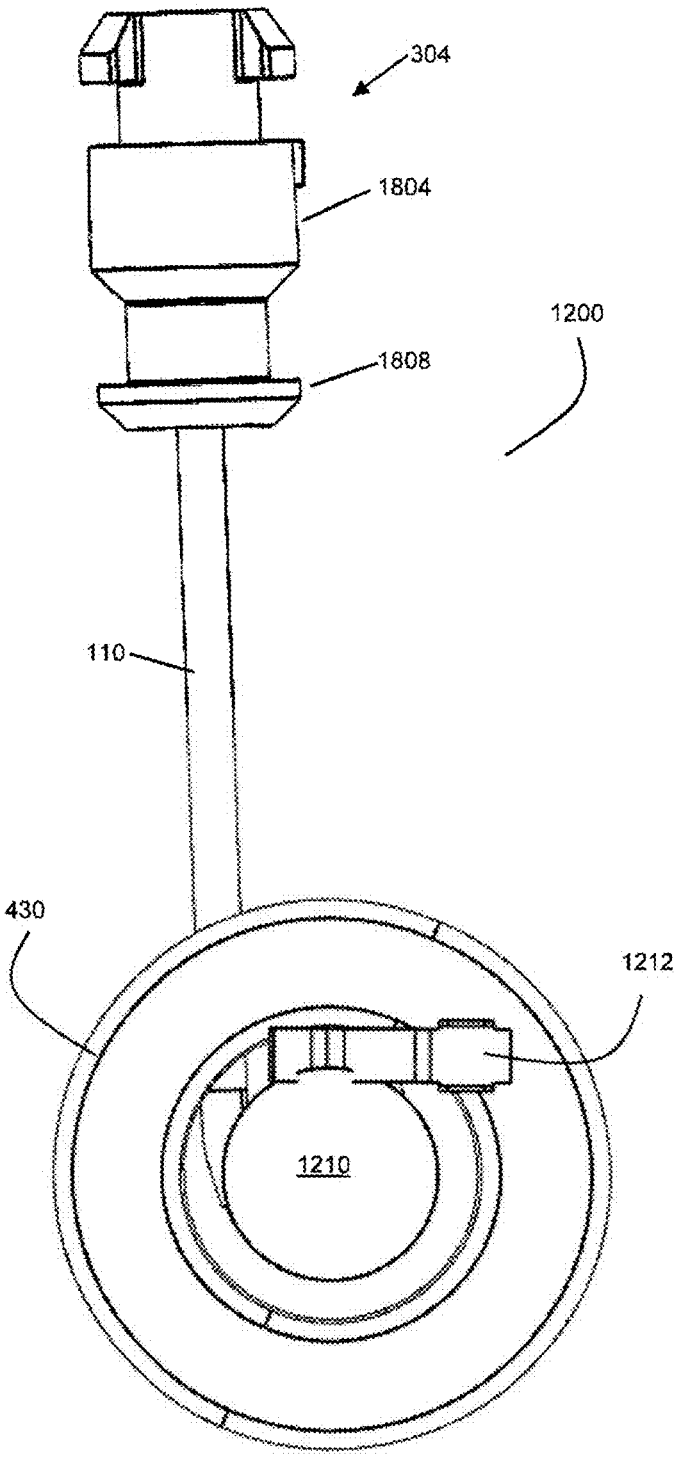
FIG. 12B shows a side view of the tether assembly shown in FIG. 12A.
Figure 12C:
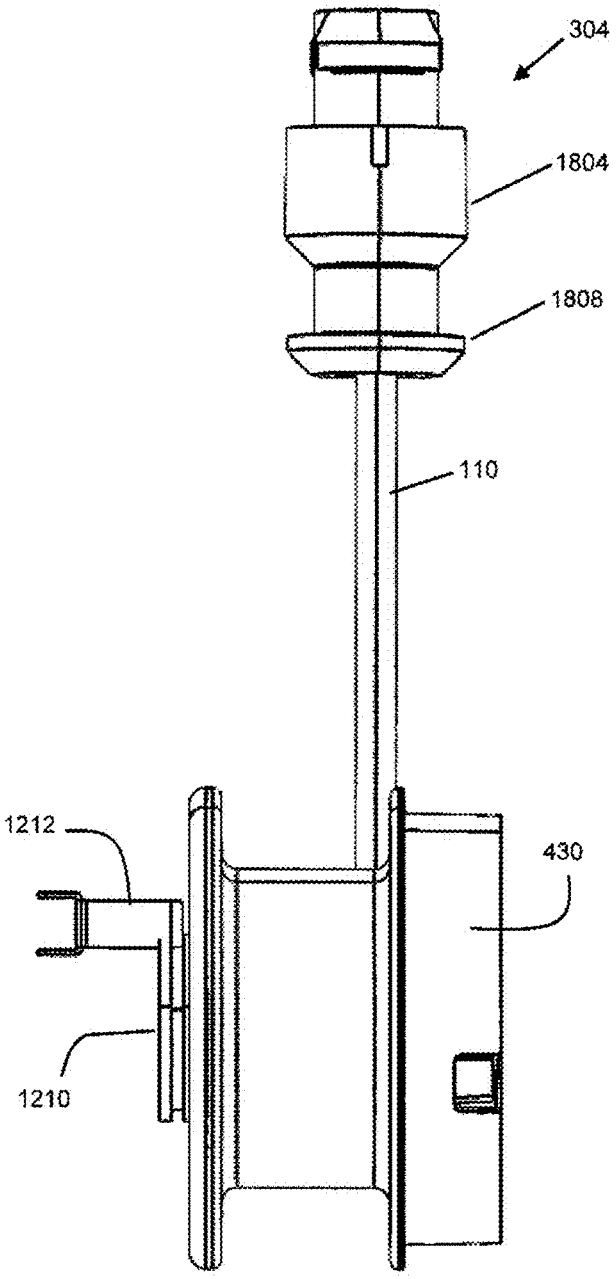
FIG. 12C shows a front view of the tether assembly shown in FIG. 12A.

FIG. 12A shows a perspective view of an example tether assembly 1200 that can be used with the base assembly 104. FIG. 12B shows a side view of the tether assembly 1200 of FIG. 12A. FIG. 12C shows a front view of the tether assembly 1200 of FIG. 12A. The tether assembly 1200 includes a reel 430, tether 110 (which is windable and un-windable around the reel 430), and tether connector 304 which is connected to the end of the tether 110 opposite the reel 430. Room inside the base assembly 104 is limited. These considerations encourage the use of smaller and smaller reels 430. However, there is a desire for the tether 110 to be long enough to give a pull range that accommodates lifts of the puck assembly 102 by customers of various heights. However, because of the limited space in the metal frame recess 810 there is a physical constraint on how much tether 110 can be wound around the reel 430. While more relative space can be gained by using thinner and thinner tethers 110, this can lead to strength problems for the tether 110. A relatively thin tether 110 is susceptive to breakage when high tensile forces are applied to the tether 110, In an effort to increase room for a relatively long and thick strong tether 110, the reel 430 does not have a reel housing that encloses the reel 430. The open reel 430 provides more space to accommodate a longer and thicker tether 110 than is used in a conventional tether assembly.

The tether assembly 1200 can also be used in a continuity circuit that is capable of detecting whether the puck assembly 102 is connected to the tether 110, whether the tether 110 has been cut, and/or whether the tether assembly 1200 has been disconnected from the base assembly 104. The tether 110 can include a conductor that serves as an antenna for signals generated by the puck assembly 102 and/or base assembly 104. Continuity is maintained by virtue of the puck assembly 102 remaining connected to the tether 110, the tether 110 being intact, and the tether assembly 1200 remaining connected to the base assembly 104. Continuity is maintained with conductive elements included in the tether assembly 1200 in order to pass a continuity signal derived from the signal(s) present on the tether antenna to circuitry in the base assembly 104 (e.g., circuit board 420). As shown by FIG. 12A, this continuity path comprises a conductive element 1210 that is included as a component of the reel 430 and a conductive spring contact 1212 that maintains a connection between circuit board 420 and conductive element 1210 (see FIGS. 4, 6, and 7A which show how an end of the conductive spring contact 1212 can connect with the circuit board 420).

Figure 13A:
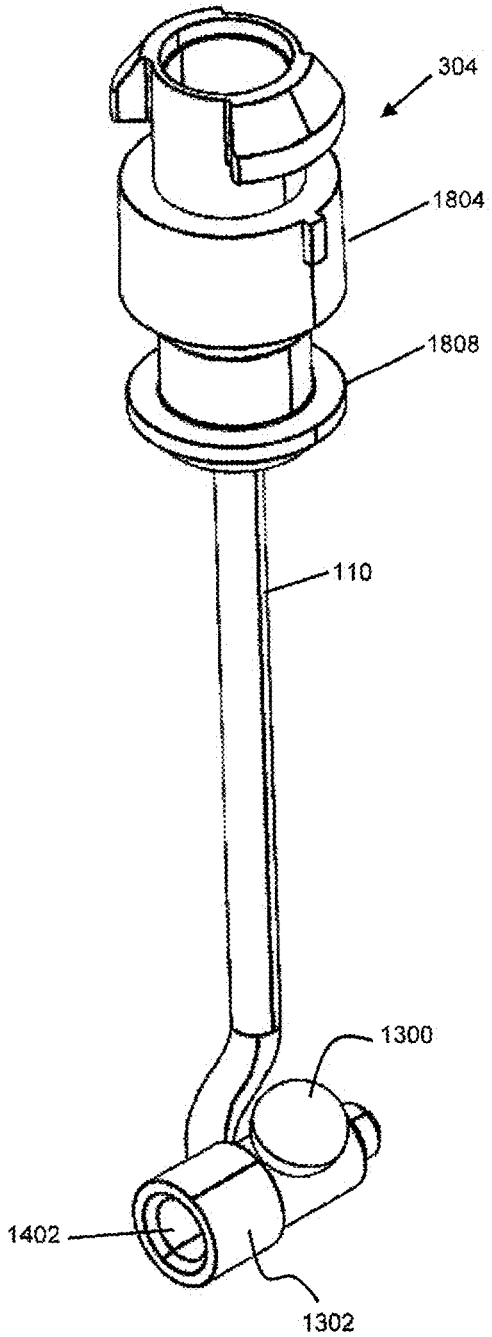
FIGS. 13A-13C show different views of a tether, tether connector and internal components of a reel.
Figure 13B:
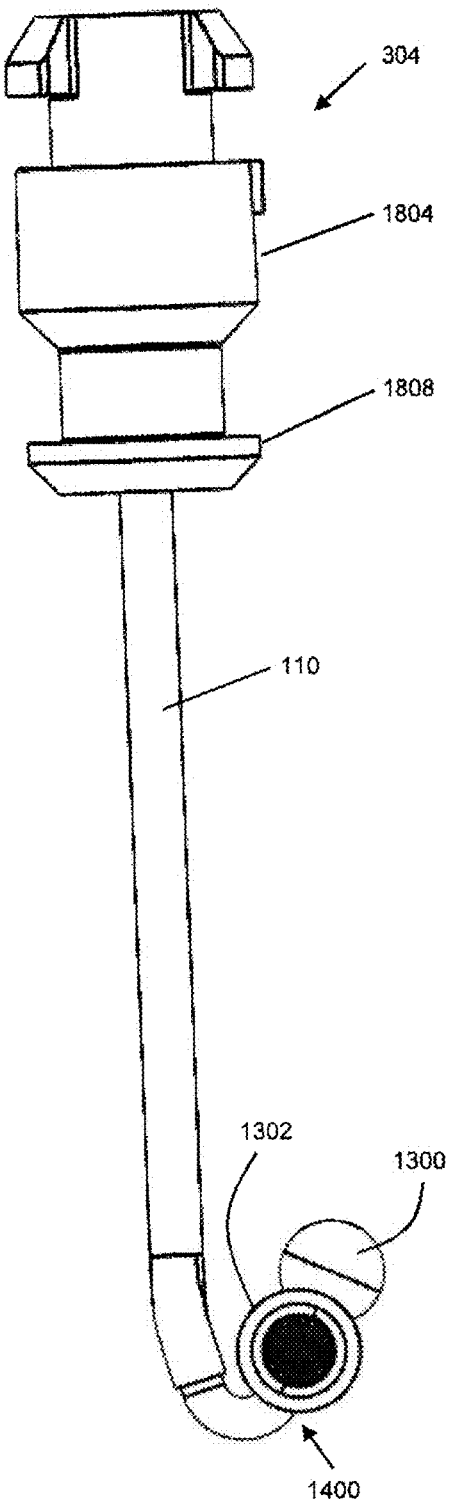
Figure 13C:
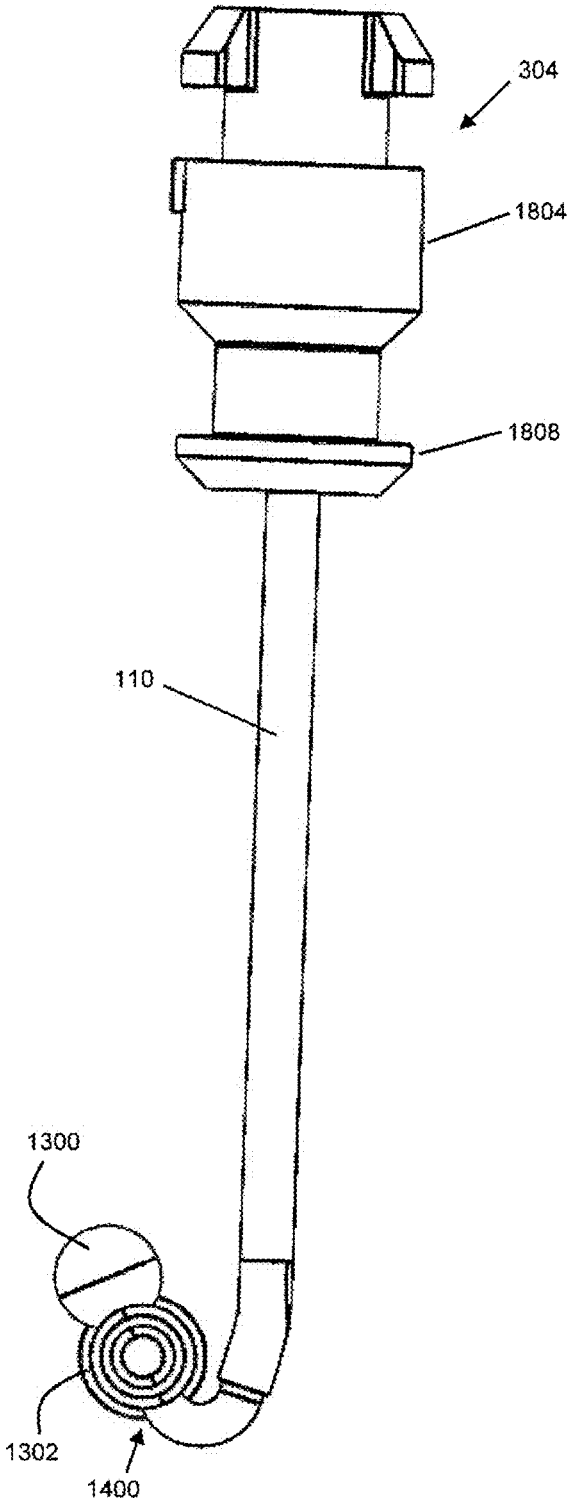
Figure 14:
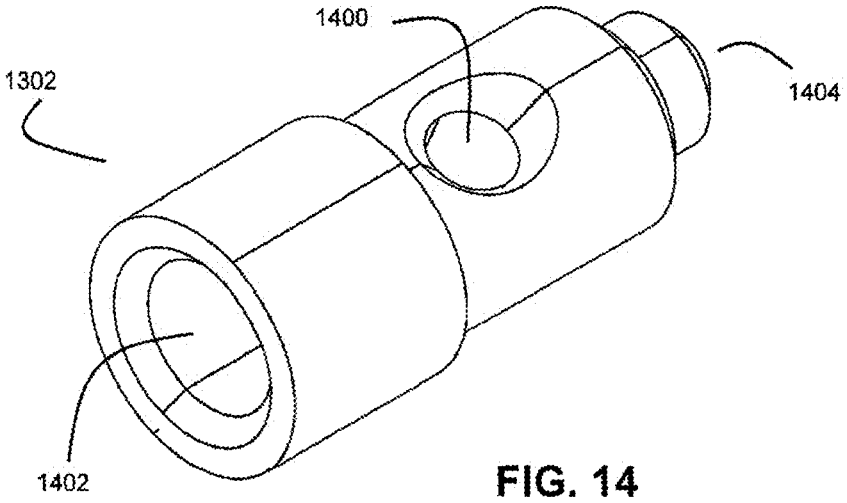
FIG. 14 shows a perspective view of an example conductive reel axle of the reel shown in FIG. 12A.

FIG. 13A shows the tether assembly 1200 with the reel 430 and the conductive element 1210 omitted to provide a view of interior components of the reel 430. FIGS. 13B and 13C show different side views of the tether assembly 1200 shown in FIG. 13A. These figures show how the tether 110 can be secured to the reel 430. The end of the tether 110 that is opposite the end of tether 110 connected to the tether connector 304 passes through a lateral aperture 1400 in a conductive reel axle 1302. (see FIG. 14 for a perspective view of the conductive element 1302). The reel axle 1302 can take the form of a ferrule with a barrel shape as shown in FIG. 14. A structure 1300 attached to the end of tether 110 that passes through the lateral aperture 1400 has a wider dimension than the lateral aperture 1400 to prevent removal of the tether 110 from the reel axle 1302. The structure 1300 can be a ball shank with a wider diameter than the diameter of the lateral aperture 1400.

Figure 19A:
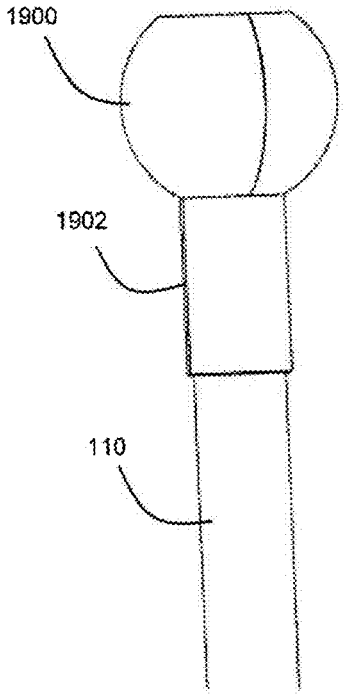
FIG. 19A shows an example ball shank located at an end of a tether.
Figure 19B:
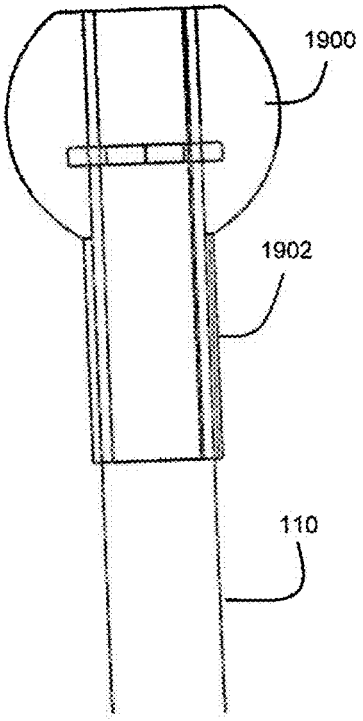
FIG. 19B shows a cross-sectional view the ball shank and tether shown in FIG. 19A.

The ball shank can have a central cavity through which the tether 110 extends and a crimp structure is applied to secure this connection. The ball shank can have a swaged connection with the tether 110—a wire cable from the tether 110 can be inserted into the ball shank 1300. The ball shank 1300 is placed in a compression die-set and pressed under high force to a smaller size, thereby securely attaching the ball shank to the end of the tether 110. The process is repeated so the formed ball is consistent in shape and the ball shank diameter is significantly smaller than its initial size. The material can thus be compressed repeatedly into the wire strands to create a high retention force when pulled axially. The ball shank need not be spherical. In other implementations, the shape the ball shank may have a flat planar surface as shown in FIGS. 19A and 19B.

FIG. 14 shows a perspective view of an example reel axle 1302, which as noted can be a ferrule with the shape shown by FIG. 14. The reel axle 1302 has a central axis about which the reel 430 rotates when the tether 110 is wound on and unwound from the reel 430. As shown in FIGS. 13A and 14, the reel axle 1302 has a cylindrical interior chamber accessed through longitudinal aperture 1402 and lateral aperture 1400. As noted, lateral aperture 1400 is used for receiving and securing the tether 110.

Figure 15:
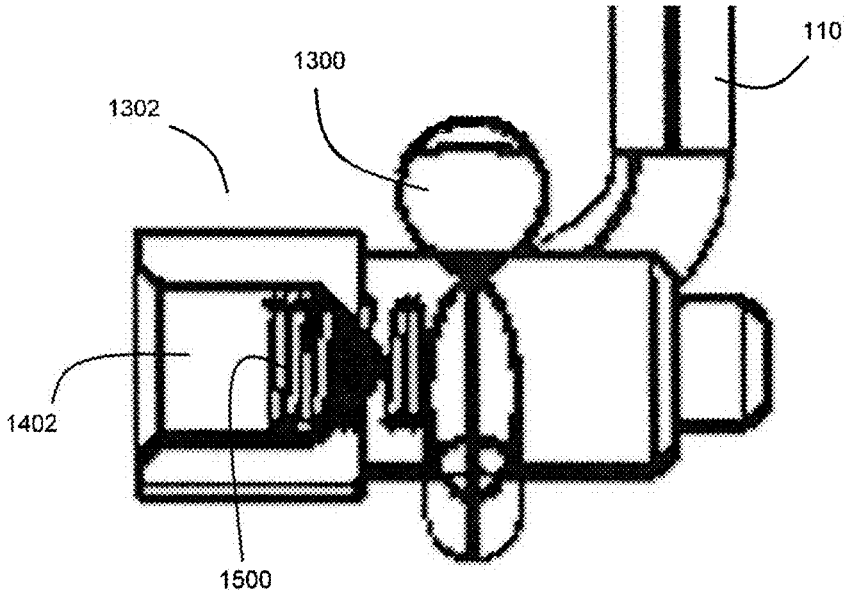
FIG. 15 shows a cross-sectional view of the conductive reel axle shown in FIG. 14.

FIG. 15 shows a cross-sectional view of the reel axle 1302 where a conductive spring 1500 can be located inside the interior chamber that is accessed via apertures 1400 and 1402. The conductive element 1210 is inserted into the longitudinal aperture 1402 of reel axle 1302 to establish a continuity path for a signal from the tether antenna. This continuity path includes a connection between the conductive element 1210 and the conductive spring 1500 and a connection between the conductive spring 1500 and the reel axle 1302 and a conductor, such as a wire, located within the tether 110 that serves as the antenna. The spring 1500 maintains an electrical connection with the conductive element 1210. The spring 1500 constantly touches the conductive element 1210 to maintain the continuity path even as the reel 430 rotates and the tether 110 shifts inside the reel axle 1302. Accordingly, the spring 1500 helps reduce the risk of false alarms that might arise from losses in continuity that are not due to security events such as tether cuts.

Figure 16A:
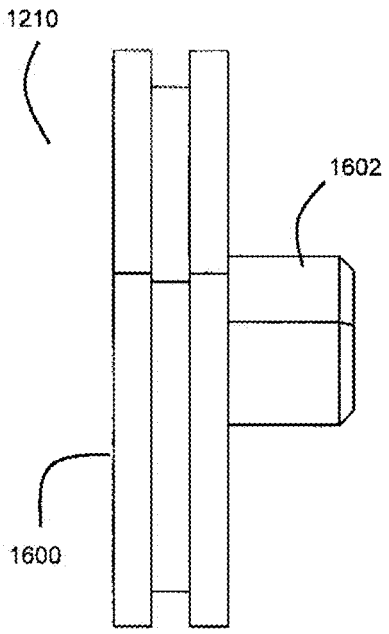
FIGS. 16A and 16B show side and perspective views of an example conductive element of the tether assembly shown in FIG. 12A.
Figure 16B:
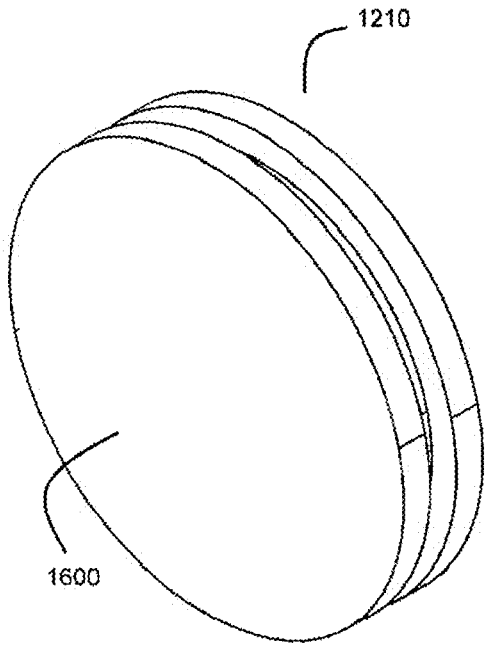
Figure 17:
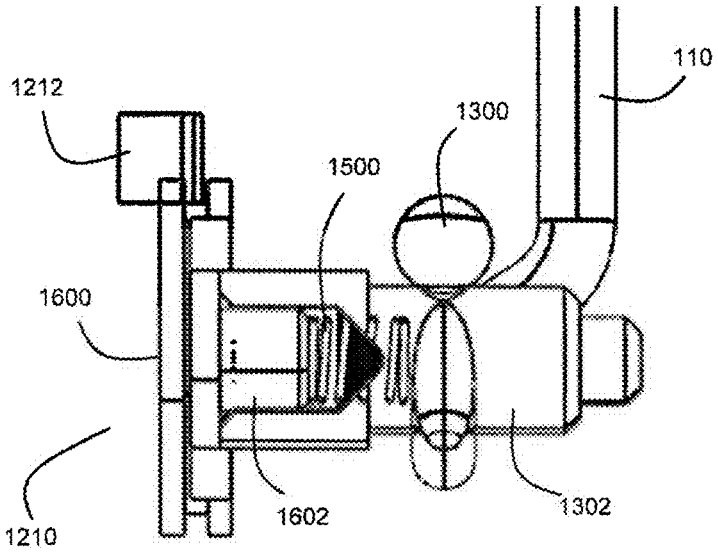
FIG. 17 shows a cross-sectional view of the conductive element and the conductive reel axle.

FIG. 16A shows a side view of the conductive element 1210. FIG. 16B shows a perspective view of the conductive element 1210. The conductive element 1210 includes a circular-shaped cap 1600 and a cap extension 1602 that extends outwardly from one side of the cap 1600. Cap extension 1602 is inserted inside aperture 1402 of the reel axle 1302 to establish the connection with the conductive spring 1500. FIG. 17 provides a cross-sectional view of the conductive element 1210 attached to the reel axle 1302 with the cap extension 1602 inserted into the aperture 1402 of the reel axle 1302 and contacting the conductive spring 1500.

Thus, when the tether assembly 1200 is inserted into the metal frame recess 810, the external surface of conductive cap 1600 engages with the conductive spring contact 1212 to provide a path for the continuity electrical signal to be received by the circuit board 420 via a connection between outer end of spring contact 1212 and circuit board 420 (see FIGS. 4 and 6).

Figure 18A:
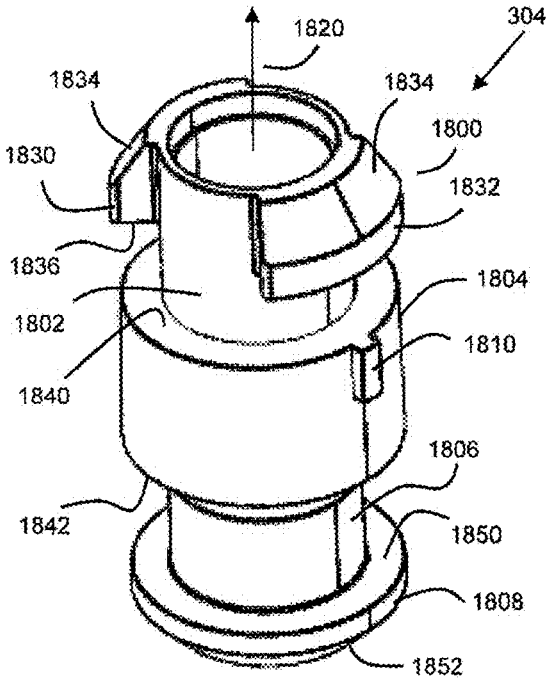
FIG. 18A shows an example tether connector.
Figure 18B:
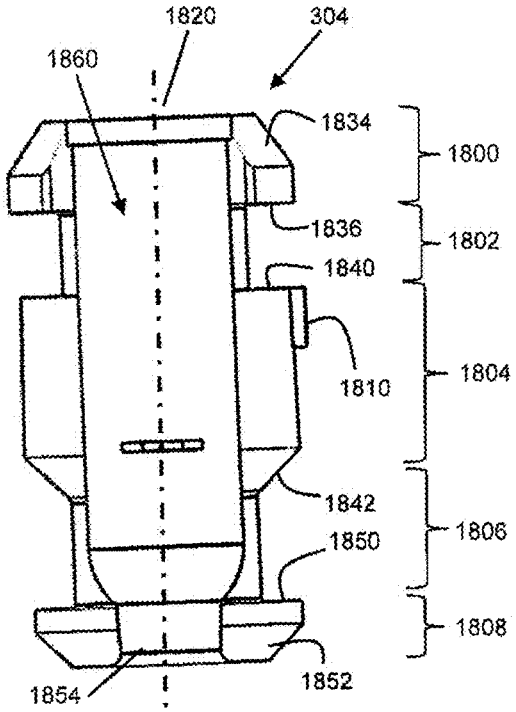
FIG. 18B shows a cross-sectional view of the tether connector shown in FIG. 18A.

FIG. 18A shows an example tether connector 304 that can be used for the tether assembly 1200. FIG. 18B shows a cross-sectional view of the tether connector 304 of FIG. 18A. The tether connector 304 can operate as a ferrule for one end of the tether 110. The tether connector 304 has an upper head 1800, an upper neck 1802 below the upper head, a shoulder ring 1804 below the upper neck 1802, a lower neck 1806 below the shoulder ring 1804, and a tapered ring 1808 below the lower neck 1806. Lower neck 1806 can interact with the lock 1100 as explained above to provide a collaring action with respect to collar 1104 of lock 1100. Upper neck 1802 can serve a similar role with respect to a lock in the puck assembly 102 to provide for detachability with respect to the puck assembly 102. The tether connector 304 may also include a tabbed extension 1810 that extends laterally outward from the shoulder 1804 and serves as a catch that provides keying with respect to an aperture of the puck assembly 102 into which the tether connector 304 slidingly fits, as discussed below.

Upper head 1800 has a tapered upper surface 1834 that slopes so that the upper surface 1834 has a small diameter at an upper portion of the upper head 1800 than at a lower portion of the upper head 1800.

Upper head 1800 has a lower surface 1836 that may be flat. Alternatively, the lower surface 1836 may be sloped so that its outer portion is lower than its inner portion. Such sloping can serve as a French cleat that promotes engagement with a lock in the puck assembly 102.

Upper head 1800 may also be separated into disconnected upper head portions that are laterally spaced around the periphery of the tether connector 304. For example, upper head 1800 may include a first upper head portion 1830 and a second upper head portion 1832 (each with a tapered upper surface 1834 as noted above). The gaps between upper head portions 1830 and 1832 can receive a component of a lock in the puck assembly to inhibit rotational unlocking movements when disconnecting with the puck assembly 102, as discussed below.

Upper neck 1802 has a diameter that is less than the maximum diameter of the upper head 1800. Accordingly, neck 1802 can be collared by a lock in the puck assembly 102 as noted below to establish a connection between the puck assembly 102 and tether connector 304.

Shoulder ring 1804 has a diameter that is greater than the diameter of upper neck 1802 and the lower neck 1806. Accordingly, upper surface 1840 of the shoulder ring 1804 can define where neck 1802 ends, and lower surface 1842 of the shoulder ring 1804 define where the neck 1806 ends. As shown by FIG. 18B, lower surface 1842 of shoulder ring 1804 may be sloped or tapered. Furthermore, as noted above, tabbed extension 1810 can extend outwardly from shoulder ring 1804 as shown by FIGS. 18A and 18B.

Lower neck 1806 has a diameter that is less than the maximum diameter of the tapered ring 1808 (and shoulder 1806). Accordingly, neck 1806 can be collared by the collar 1104 of the lock 1100 as discussed above when there is a desire to lockdown the puck assembly 102 to the base assembly 104.

The tapered ring 1808 has a flat upper surface 1850 or has a slope so that its outer portion is higher than its inner portion. Such sloping can serve as a French cleat that promotes engagement with the collar 1104 of lock 1100 when lock 1100 is in the lock state.

The tapered ring 1808 has an annular tapered surface 1852 that slopes so that the tapered surface 1852 has a smaller diameter at a lower portion of the lower tapered ring 1808 than at an upper portion of the tapered ring 1808. The tapered surface 1852 provides a wedging action as discussed above that permits insertion of the tether connector 304 through lock aperture 1110 even if the lock 1100 is in a locked state.

Tether connector 304 has a central longitudinal axis 1820 that can serve as the central axis of a hollow interior chamber 1860 that extends along a length (optionally the full length) of the tether connector 304 and has an opening 1854. The cross-sectional view of FIG. 18B shows that the interior chamber 1860 has a diameter at an upper portion that is larger than the diameter of the opening 1854.

FIG. 19A shows that the end of the tether 110 for connection with tether connector 304 can include a structure 1900 with a larger diameter than the diameter of tether 110. FIG. 19B shows a cross-sectional view of the tether end shown by FIG. 19A. As an example, structure 1900 can take the form of a ball shank as discussed above with regard to the opposite end of tether 110. Ball shank 1900 can also have a diameter that within wider part of chamber 1860 but not pass through the lower aperture 2000 (see FIG. 20) leading to the narrower lower part of chamber 1860. As noted above, ball shank 1900 can have a central cavity through which the tether 110 extends, and a crimp structure 1902 be applied to secure this connection. The ball shank can have a swaged connection with the tether 110 as discussed above. In the example of FIGS. 19A and 19B, the ball shank 1900 has a flat plane at its upper surface: but it should be understood that the ball shank 1900 could have a more spherical shape if desired.

Figure 20:
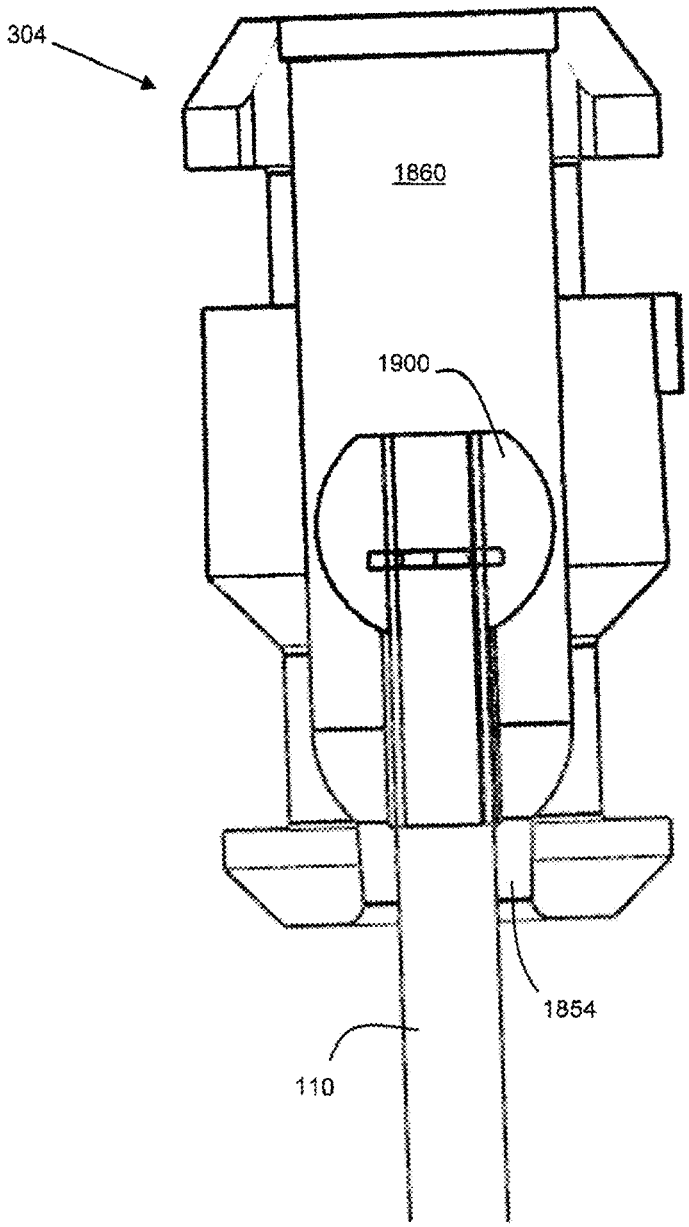
FIG. 20 shows a cross-sectional view of the ball shank and tether connector shown in FIGS. 19A and 19B.

FIG. 20 shows a cross-sectional view of the ball shank 1900 and tether assembly 304. The ball shank 1900 is inserted into the interior chamber 1860 of the tether connector 304. The opening 1854 is large enough to permit passage of the tether 110 but is smaller than the diameter of the ball shank 1900, thereby the tether 110 is attached to the tether assembly 304.

FIGS. 21A-31B show various examples of puck assemblies with enhanced security features.

Figure 21A:
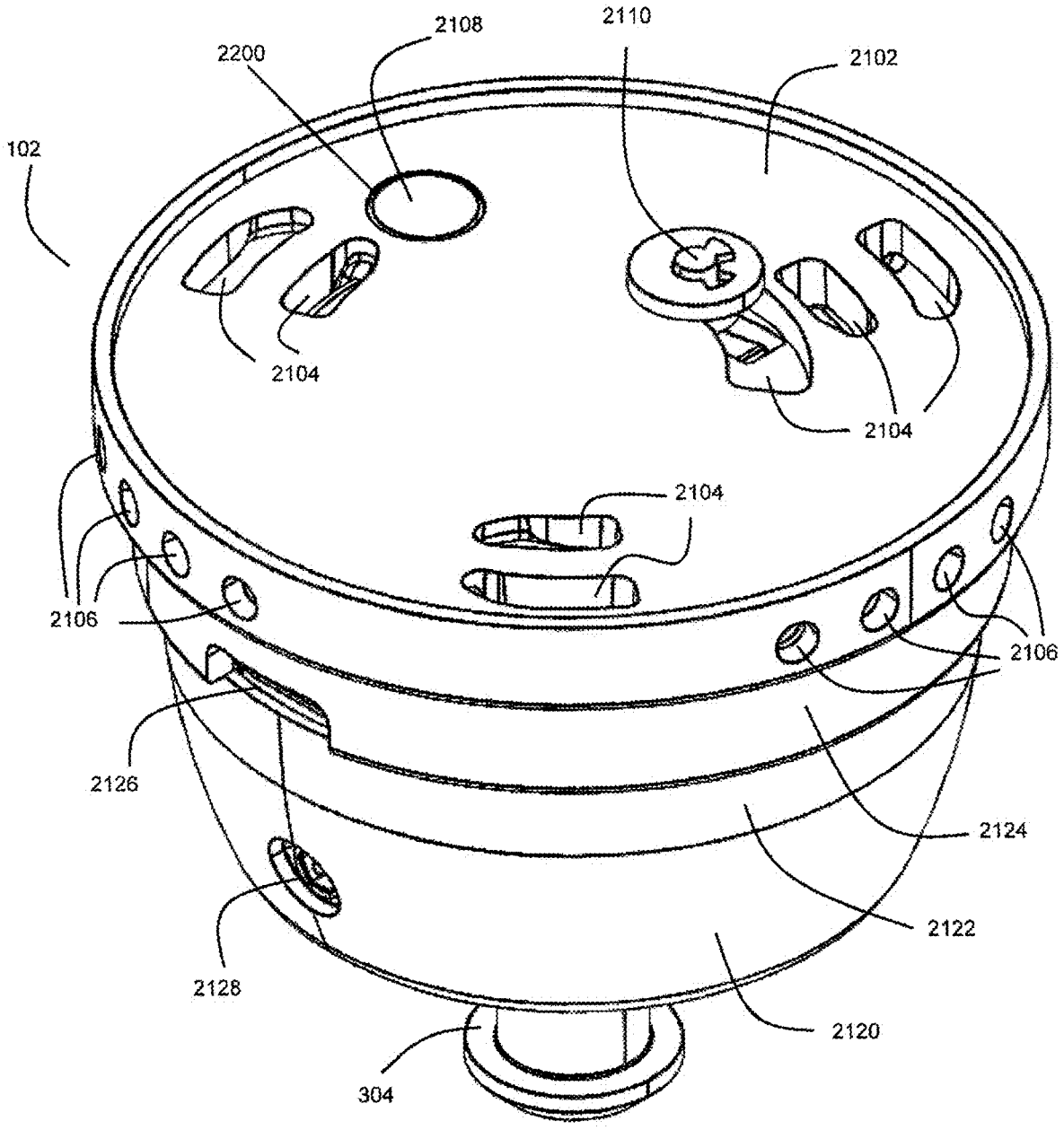
FIGS. 21A-21E show various views of an example puck assembly.

FIG. 21A shows a perspective view of an example puck assembly 102. The puck assembly 102 includes an upper portion that is detachable from a lower portion. When mounting a product to the puck assembly 102, an adhesive such as a very high bond (VHB) material may applied to the surface of the puck assembly 102 on which the product is mounted. The puck assembly 102 includes several functional components that may be relatively expensive, such as electronics. In order to increase the longevity of these expensive components of the puck assembly 102, the puck assembly 102 is designed so that the upper portion, which may have the adhesive applied thereto, includes low cost items that can be replaced at very low cost, while the lower portion houses the relatively more expensive functional components of the puck assembly 102. For example, if adhesive builds up on the upper surface of the upper portion, the upper portion can be detached from the lower portion and discarded and a new upper portion can be attached to the lower portion. In this fashion, the system can avoid unnecessary replacements of the internal components of puck assembly 102. With such an approach, the upper portion does not include a circuit board or any electronics. The electronics for the puck assembly 102 are housed in the lower portion. For example, the upper portion can be a disk formed from a plastic or other suitable material.

In the example of FIG. 21A, the upper portion of puck assembly 102 comprises an upper plate 2102, wherein the product (e.g., an electronic device such as a smart phone) can be mounted on the upper surface of the upper plate 2102. The lower portion of the puck assembly 102 comprises components shown in FIG. 21A that are below the upper plate 2102. For example, the lower portion may include an outer housing 2120 that serves as a shell. The lower portion may also include a metal carrier 2122 that provides strength and structural integrity for the puck assembly 102. The outer housing 2120 covers at least a portion of the metal carrier 2122. The lower portion may also include a cap assembly 2124 for the metal carrier 2122, where the cap assembly 2124 may also be composed of metal to enhance the structural integrity of the puck assembly 102. Upper plate 2102 can be detachably connectable with the cap assembly 2124 as discussed below.

The upper plate 2102 may also include an outer rim with apertures 2106 that facilitate the passage of sound from an alarm located inside the puck assembly 2102. In this manner, the sound produced by the alarm can be efficiently propagated to nearby people.

A cable interface 2126 provides connects for a cable to a circuit board located inside the puck assembly 102 and can be accessible from an outer surface of the puck assembly 102. The cable provides an electrical connection for electrically connecting the circuit board to a product, such as an electronic device, mounted to the upper plate 2102. Through the cable, power can be supplied from the puck assembly 102 to the electronic device and/or data can be transmitted between the electronic device and the puck assembly 102. In the example of FIG. 21A, the cable interface 2126 is accessible via an outer surface of the cap 2124. Also, as an example, the cable interface 2126 can be a physical connector, such as a USB connector or other appropriate connector type, for cable connections with the relevant electronic device.

A tool interface 2128 for a lock that provides a locking connection between the puck assembly 102 and tether connector 304 can be accessible from an outer surface of the puck assembly 102. For example, the lock can be located inside the metal carrier 2122 as discussed below and the tool interface 2128 for interacting with the lock via a tool can be accessible from an outer surface of the housing 2120 as shown in FIG. 21A.

In the example of FIG. 21A, the upper plate 2102 can be detached or connected to the cap assembly 2124 via a rotational movement of the upper plate 2102 relative to the cap assembly 2124, which provides engagement between tongues and grooves on the upper plate 2102 and cap assembly 2124, as discussed below. The upper plate 2102 can include various recesses 2104 that accommodate tongues on the cap assembly 2124 during such rotational movement.

A lock located within the puck assembly 102 forces and holds a peg 2108 in an aperture 2200 within the upper plate 2102 in order to prevent rotational movement of the upper plate 2102 that could cause a detachment of the upper plate 2102 from the cap assembly 2124. FIG. 21A shows peg 2108 in an upward position within the aperture 2200 where the peg 2108 blocks rotation of the upper plate 2102 relative to the cap assembly 2124. As discussed below, the lock in the puck assembly 102 can force the peg 2108 downward so that it disengages from the upper plate 2102, thereby permitting rotation of the upper plate 2102 relative to the cap assembly 2124 for detaching the upper plate 2102 from the cap assembly 2124.

The puck assembly 102 can also include a product presence sensor that is connected to the circuit board of the puck assembly 102 so that the circuit board can track whether a product is mounted on the upper plate 2102. FIG. 21A shows a plunger pin 2110 of the presence sensor. A spring in the presence sensor pushes the plunger pin 2110 upward. When a product is mounted on the upper surface of the upper plate 2102, the plunger pin 2110 is pressed downward by the product. If the product is removed from the upper surface of the upper plate 2102 an alarm circuit in the circuit board of the puck assembly 102 detects the plunger pin 2110 has moved upward, which triggers an alarm in response to an authorized removal of the product from the puck assembly 102. One of the grooves 2104 of the upper plate 2102 can accommodate rotational movement of the plunger pin 2110 relative to the upper plate 2102 when connecting and disconnecting the upper plate 2102 to and from the cap assembly 2124.

Figure 21B:
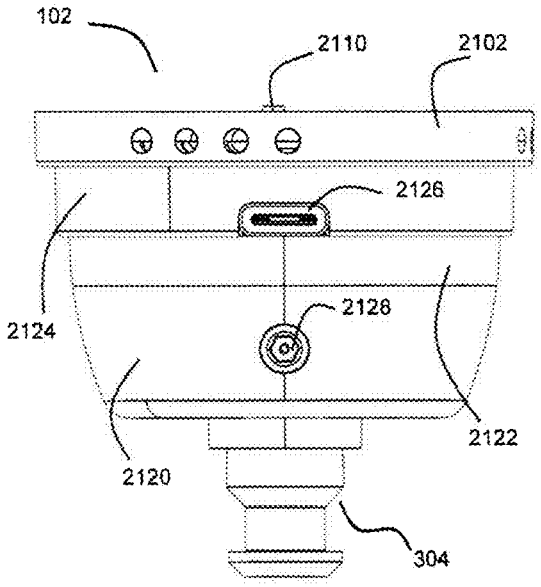
Figure 21C:
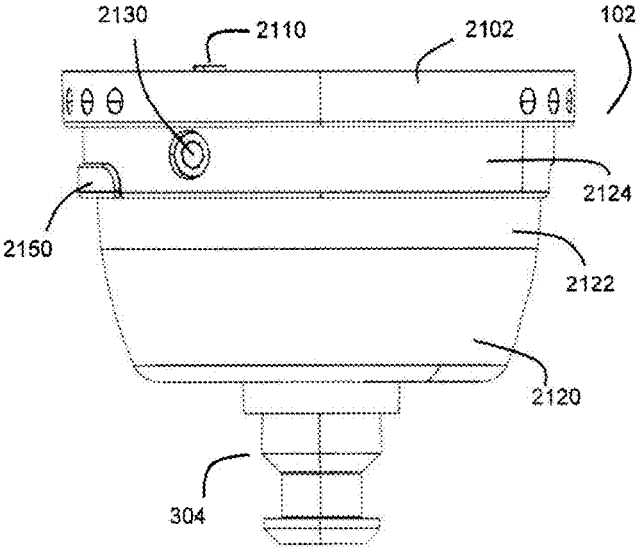
Figure 21D:
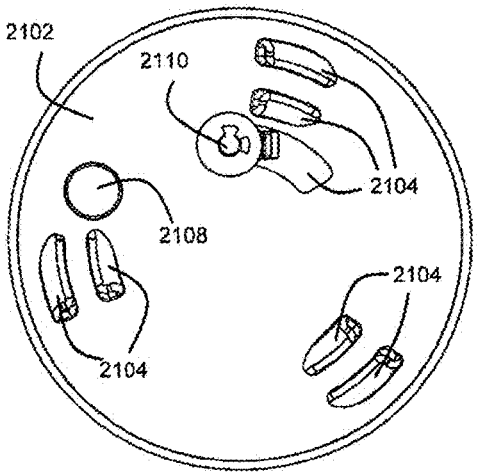
Figure 21E:
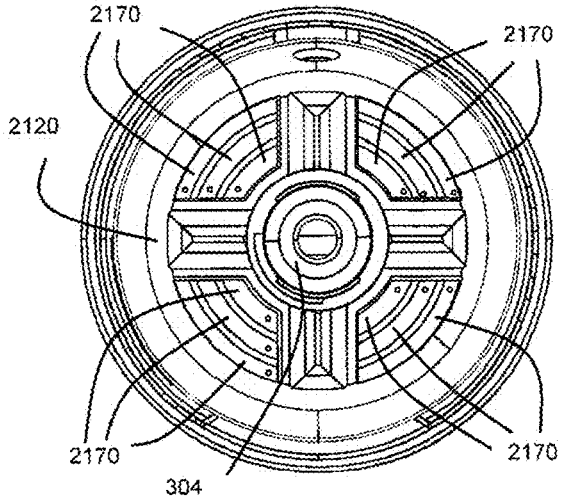

FIG. 21B shows a first side view of the puck assembly 102 of FIG. 21A. FIG. 21C shows a second side view of the puck assembly 102. FIG. 21C shows a tool interface 2130 for operating the lock that provides a locking connection via the peg 2108 between the upper plate 2102 and the metal cap 2124. In the example of FIG. 21C, tool interface 2130 can be accessible via an opening in an outer surface of the cap assembly 2124. FIG. 21D shows a top view of the puck assembly 102 of FIG. 21A. FIG. 21E shows a bottom view of the puck assembly 102. FIG. 21E shows a plurality of conductive contacts 2170 that can be disposed on the lower outer surface of the puck assembly 102. These contacts 2170 come into contact with complementary contacts 416 on the base assembly 104 when the puck assembly 102 is in the rest position on the base assembly 104. For example, contacts 2170 can establish electrical contact with the contacts 416 described above for the base assembly 104 in FIGS. 4 and 6. The contacts 2170 and 416 provide transmission of power and/or data between the base assembly 104 and puck assembly 102. For example, the three contacts 2170 can serve as a power contact, ground contact, and data contact for the apparatus. In the example of FIG. 21E, contacts 2170 are arranged as unconnected conductive arcs arranged in a concentric pattern at three radii from a center point. In the example of FIG. 21E, these conductive arcs are arranged in four quadrants so that for angular orientations of the puck assembly 102 at 90/180/270/360 degrees, there will always be diametrically opposite incoming and outgoing paths for current and data between the puck assembly 102 and base assembly 104. However, it should be understood that alternate spatial arrangements are possible. For example, the contacts 2170 can be continuous concentric rings around the center point. Furthermore, the power and/or data transfer between the puck assembly 102 and base assembly 104 need not rely on conductive contacts; for example, inductive coils in the puck assembly 102 and base assembly 104 could instead be used to inductively couple the puck assembly 102 with the base assembly 104 for transfer of power and/or data.

Figure 21F:
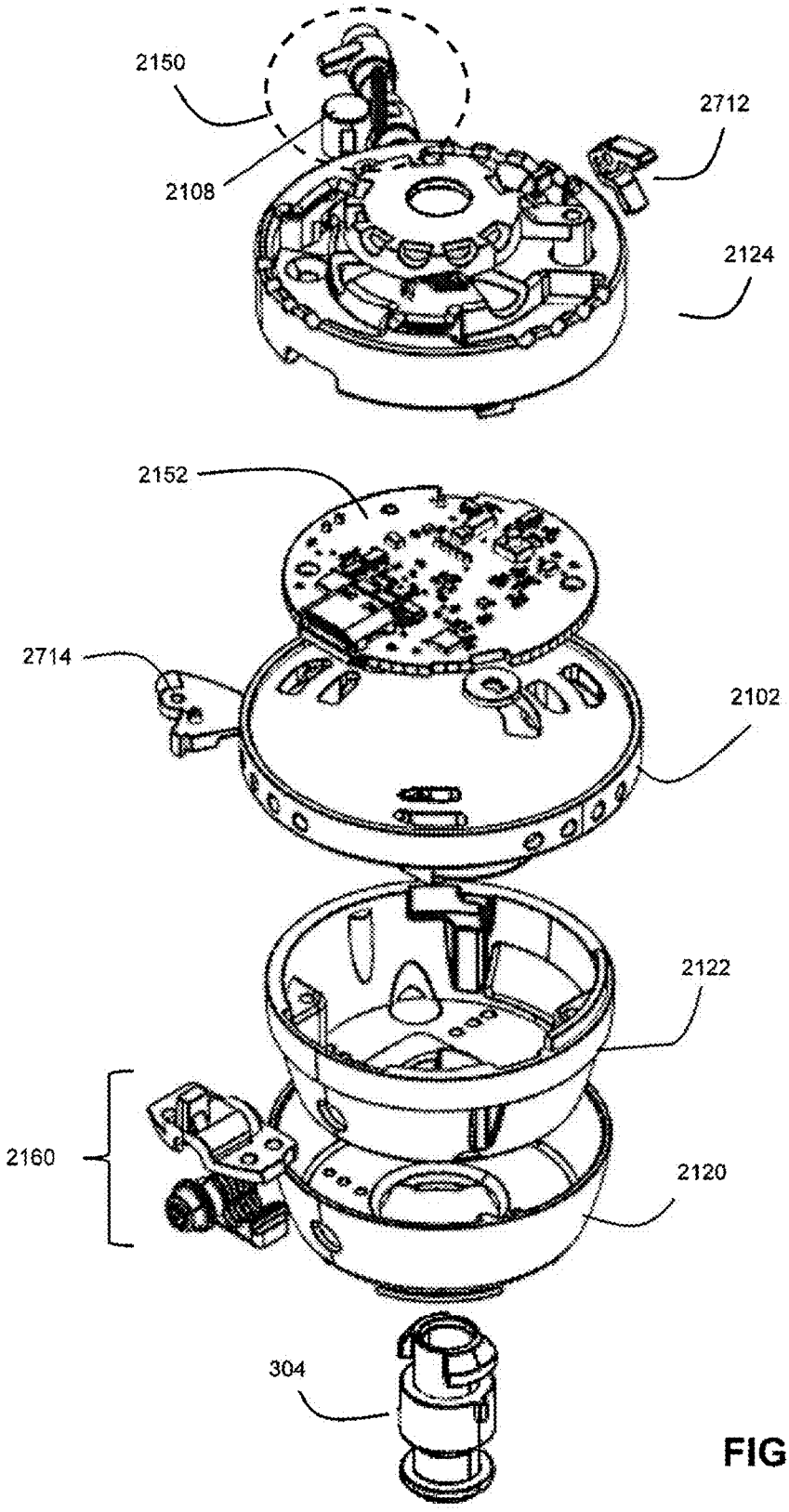
FIG. 21F shows an exploded view of a puck assembly.

FIG. 21F shows an exploded view of the puck assembly 102. In this view, a lock 2150 that locks the upper plate 2102 to the cap 2124 can be seen. The lock 2150 can be secured to the cap assembly 2124. FIG. 21F also shows a circuit board 2152 positioned inside the puck assembly 102. In an example embodiment, the circuit board 2152 can be positioned toward the top of the metal carrier 2122, and cap assembly 2124 can sit above and cover the circuit board 2124. Circuit board 2152 can provide circuitry for any of a number of different puck functions. For example, the circuit board 2152 can include a wireless transceiver for establishing wireless connectivity with remote computer systems. Furthermore, the circuit board 2152 can include circuitry for detecting alarm conditions such as unauthorized removal of the product from the upper plate 2102 which caused the plunger pin 2110 to move upward. As another example, circuit board 2152 can include circuitry for passing power to an electronic device mounted on the upper plate 2102 via a cable connected to cable interface 2126 and for sending/receiving data to/from the electronic device via such cable and cable interface 2126. Power can be received by the circuit board 2152 via contacts 2170 and conductive connections between contacts 2170 and circuit board 2152. Further still, the circuit board 2152 can include circuitry for imparting and detecting a continuity signal passes by tether 110 in order to support detection of events such as tether cuts.

FIG. 21F also shows lock 2160 that provides a locking connection between the puck assembly 102 and tether connector 304. Lock 2160 can be secured inside the metal carrier 2122. Circuit board 2152 can be located between the lock 2160 and the lock 2150. Housing 2120 can serve as a shell that covers a lower outer surface of the metal carrier 2122. Both housing 2120 and metal carrier 2122 can include apertures on their lower surfaces for receiving at least a portion of the tether connector 304 when the puck assembly 102 is connected to the tether connector 304. It should be understood that while these apertures will have a common area of overlap for accommodating passage of the tether connector 304, these apertures need not have the same shape as each other.

Figure 22A:
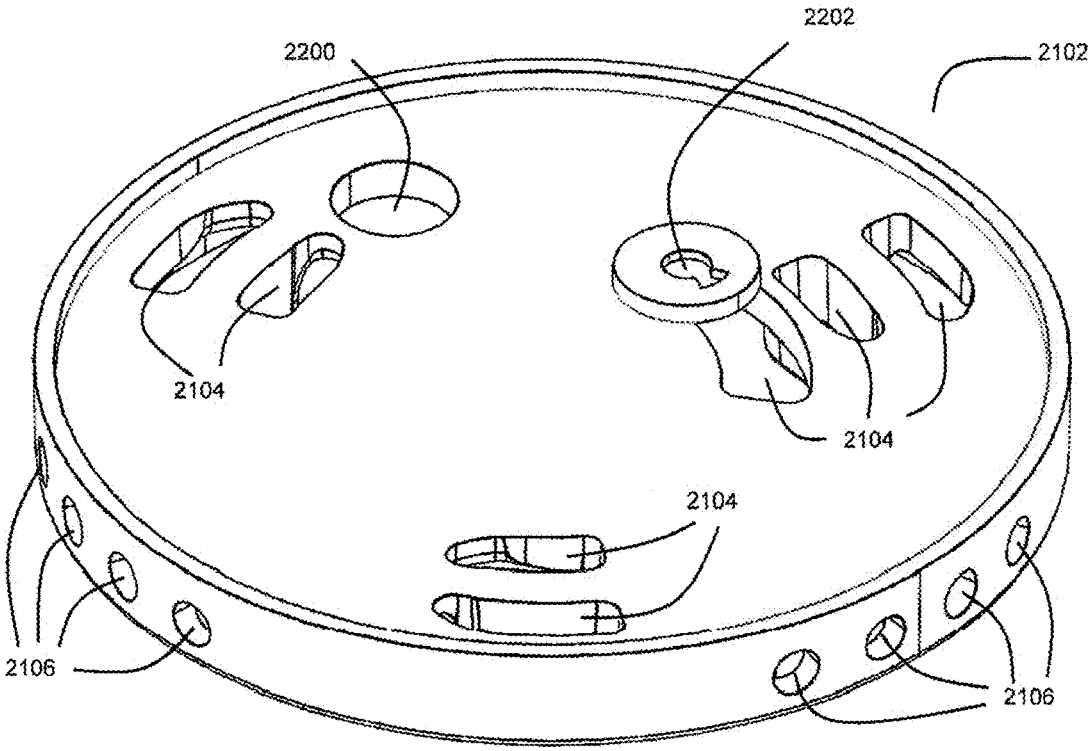
FIGS. 22A-22C show various views of an example upper plate of the puck assembly shown in FIGS. 21A-21F.

FIG. 22A shows an example embodiment of the upper plate 2102. The product being merchandised can be secured to the upper surface 2210 of upper plate 2102. Upper plate 2102 includes the aperture 2200 that receives the peg 2108 of lock 2150. While the example of FIG. 22A shows that aperture 2200 extends through the entirety of upper plate 2102, in other implementations, this aperture 2200 can be a recess on the undersurface of the upper plate 2102, where the recess is shaped to receive the peg 2108 of lock 2150. In other words, in this implementation, the peg 2108 does not pass through the surface of the upper plate 2102. The upper plate 2102 can also include an aperture 2202 through which the sensor 2110 passes.

Figure 22B:
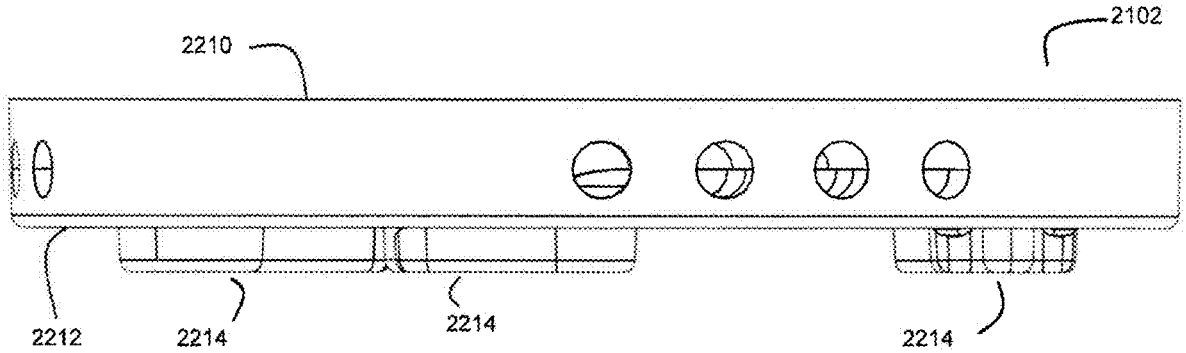

FIG. 22B shows a side view of the upper plate 2102 of FIG. 22A. In this side view, tongues 2214 that extend downwardly from the bottom surface 2212 of the upper plate 2102 can be seen. The tongues 2214 latch onto corresponding grooves of the cap assembly 2124 when the upper plate 2102 is twisted into place for connection with the cap assembly 2124.

Figure 22C:
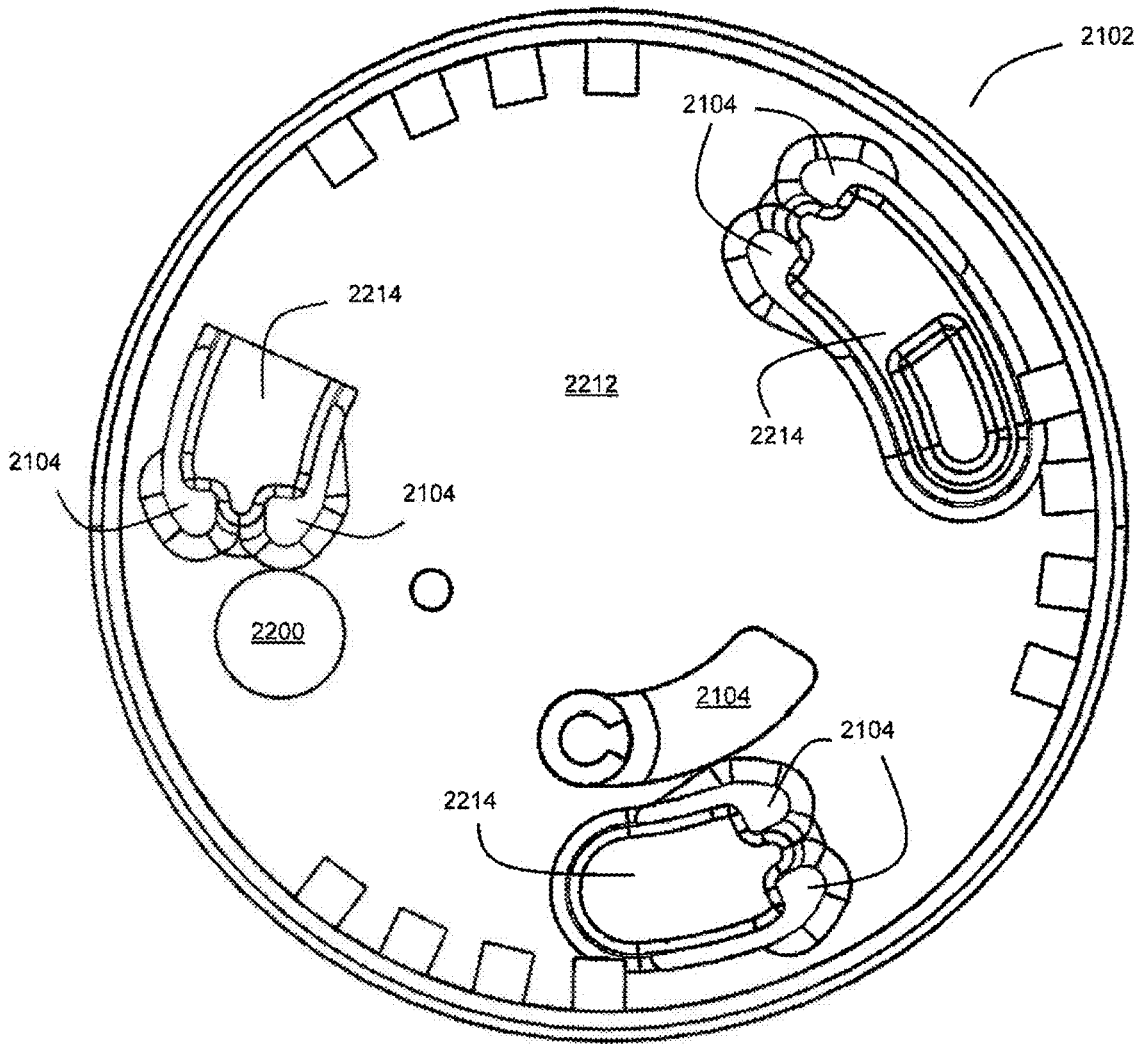

FIG. 22C shows a bottom view of the upper plate 2102 where an example spatial distribution of the tongues 2214 and grooves 2104 across the bottom surface of the upper plate 2102 can be seen. In this example, there are three tongues 2214. In other implementations, more or fewer tongues 2214 at different relative spacings may be used.

Figure 23A:
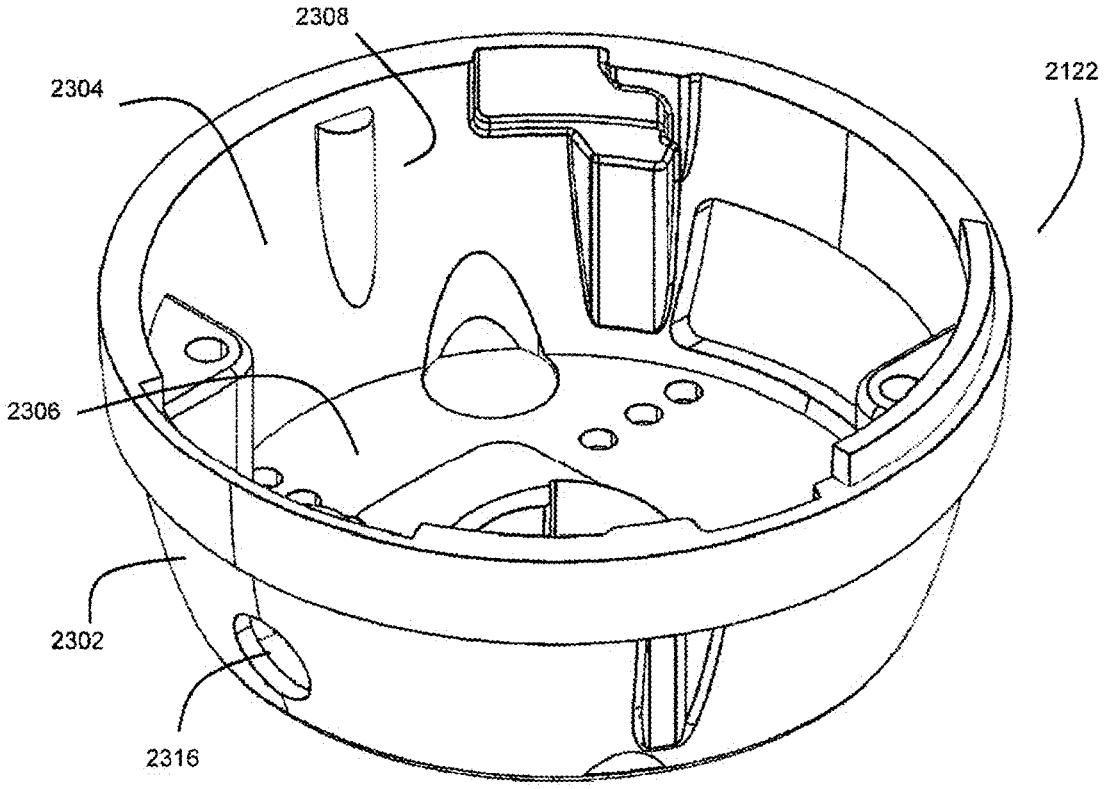
FIGS. 23A-23C show various views of an example metal carrier of the puck assembly shown in FIGS. 21A-21F.

FIG. 23A shows a perspective view of the metal carrier 2122. Metal carrier 2122 can be formed from metals such as aluminum, zinc alloys, or steel (e.g., stainless steel). The metal carrier 2122 improves the strength of the puck assembly 102 in the event of a brute force attack where a thief applies a strong pulling force to pull the puck assembly 102 away from the base assembly 104 and place the tether 110 in high tension.

The metal carrier 210 may have an outer surface 2302 (which need not be continuous and may include various gaps as shown by FIG. 23A) and an interior chamber or cavity 2304 defined by floor 2306 and wall 2308. Floor 2306 can have a central aperture 2310 as shown by the top view of FIG. 23B. The metal carrier 2122 bears the force that is experienced by the puck assembly 102 and tether 110 when a strong pulling force is applied to pull the puck assembly 102 away from the base assembly 104. With such a brute force attack, the force stack (or force chain) of the product display assembly includes the tether 110, the connection between the tether 110 and the base assembly 104 or other surface such as a table or floor anchor, the connection between the tether 110 and the reel 430 of a tether assembly 1200, and the connection between the tether 110 and the puck assembly 102. A break in any of these links in the force stack/chain will result in the puck assembly 102 (and its attached product) being ripped away from the product display assembly 100. The metal carrier 2122 can greatly improve the robustness of the connection between the puck assembly 102 and the tether 110.

As discussed below, lock 2160 can be secured inside the metal carrier 2122, and aperture 2316 through the outer surface 2302 of the metal carrier 2122 can accommodate tool interface 2128 of the lock 2160.

Figure 23B:
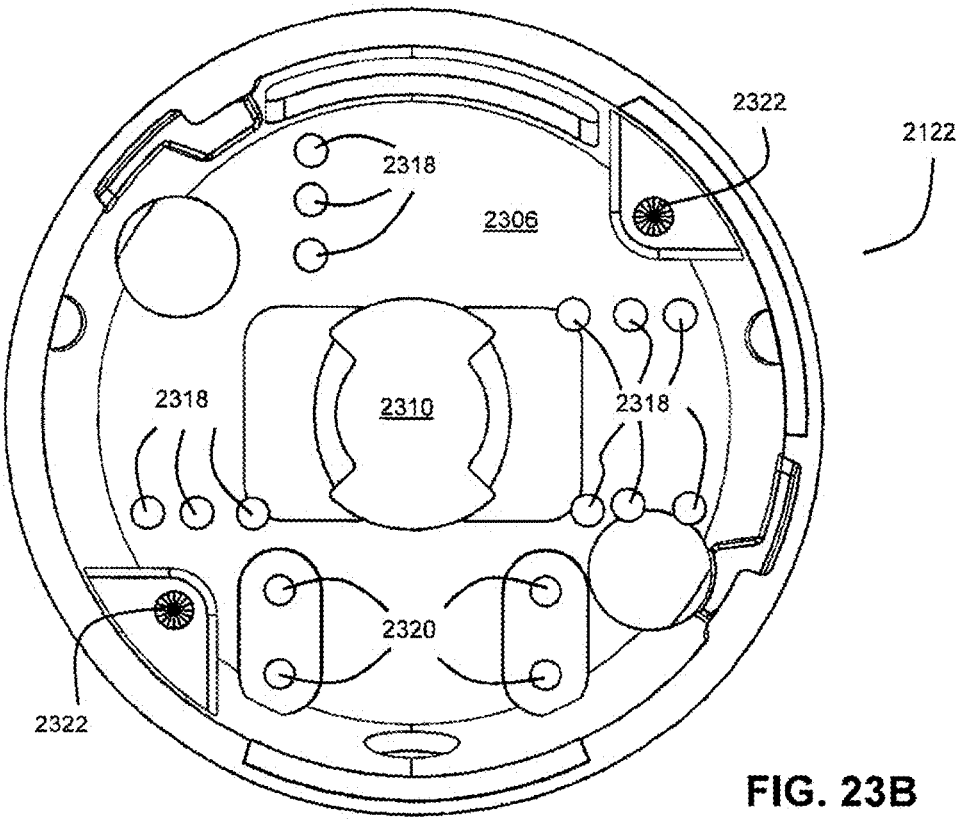

FIG. 238 also shows a top view of apertures 2318 through the floor 2306 of the metal carrier 2122 and through which conductors can pass for connecting contacts 2170 with circuit board 2152. Also shown by FIG. 23B are screw holes 2320 for securing lock 2160 to the metal carrier 2122 via screws or the like and screw holes 2322 for securing cap assembly 2124 and circuit board 2152 to supporting ledges of the metal carrier 2122.

Figure 23C:
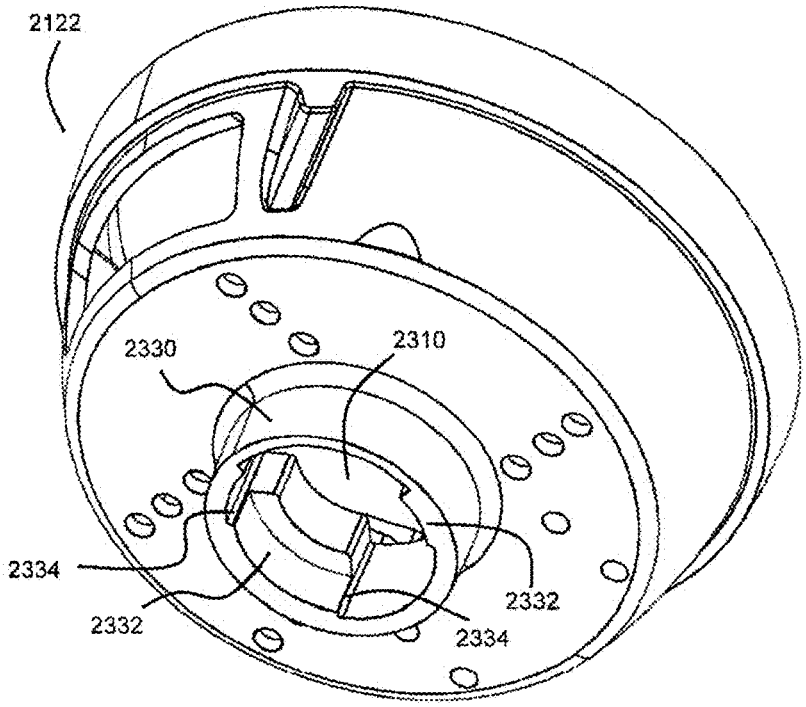

FIG. 23C shows a perspective view of the underside of the metal carrier 2122 to provide a view of aperture 2310. In this example, the underside of the metal carrier 2122 includes a downwardly extending boss 2330 that surrounds the aperture 2310. In other implementations, the boss 2330 may be omitted. The aperture 2310 can have differing dimensions at different elevations that provide keying with complementary portions of the tether connector 304 to facilitate appropriate alignment between the tether connector 304 and the lock 2160 for the lockable connection between the tether connector 304 and puck assembly 102 as discussed below. For example, separate ledges 2332 can be located around the periphery of the aperture 2310, where these ledges 2332 can have different dimensions at different elevations in the aperture 2310. At a lowest elevation, ledges 2332 can be shaped to permit insertion of the upper head 1800 of the tether connector 304 and partial rotation of the tether connector 304 relative to the metal carrier 2122 to the extent permitted by lateral extension 1810 of the tether connector 304, where the rotational extent of the tether connector 304 is defined by where lateral extension 1810 engages catch walls 2334 of the ledges 2332. At the next higher elevation, ledges 2332 can extend farther into the aperture 2310 to engage with the shoulder ring 1804 of the tether connector 304 as the tether connector 304 is inserted into the aperture 2310. This engagement between bottom surface of ledges 2332 and the upper surface 1840 of the shoulder ring 1804 defines the uppermost extent of insertion of the tether connector 304 into the aperture 2310. At this point, the innermost portion of the ledges 2332 collars neck 1802 of the tether connector 304. When in this position, the tether connector 304 is capable of partial rotation to the extent permitted by lateral extension 1810 and catches 2334 of the ledges 2332. To facilitate rotation of the tether connector 304 into a position of lockable alignment with the lock 2160, the spatial relationships of catches 2334, the lateral extension 1810, and the gaps between separate upper heads 1830 and 1832 of the upper head 1800 of the tether connector 304 can be made to provide alignment of either or both of the gaps between separate upper heads 1830 and 1832 with the member of lock 2160 extending outward into a locking position for engagement with the tether connector 304.

In order to move the tether connector 304 into lockable alignment position for the lock 2160, the tether connector 304 is inserted upward into the aperture 2310 until shoulder ring 1804 abuts ledge 2332, while rotating the tether connector 304 relative to the puck assembly 102 via a rotational force as necessary to achieve maximum upward insertion of the tether connector 304 into aperture 2310. At this point, the tether connector 304 is rotated relative to the puck assembly 102 until lateral extension 1810 abuts one of the catches 2334. At this point, the lock 2160 is aligned with one of the gaps between separate heads 1830 and 1832. Lock 2160 can then be actuated to prevent any further rotation of the tether connector 304 relative to the puck assembly 102. In this case, the upper surface of ledges 2332 abuts the bottom surface 1836 of the upper head portions 1830 and 1832 to block downward removal of the tether connector 304 from the aperture 2310.

In order to disconnect the puck assembly 102 from the tether connector 304, a user would actuate the lock 2610 to disengage from the gap between upper head portions 1830 and 1832. Once lock 2160 disengages, the tether connector 304 can once again be rotated relative to the puck assembly 102 in a counter direction so that the lateral extension 1810 no longer abuts one of the catches 2334. This rotation brings the upper head portions 1830 and 1832 into alignment with the aperture 2310 to permit downward sliding movement of the tether connector 304 out of aperture 2310 in response to a downward force on the tether assembly 304 relative to the puck assembly 102.

It should be understood that when discussing these movements of the tether connector 304 relative to the puck assembly 102, these movements can by a movement of the tether connector 304 with the puck assembly 102 remaining stationary, a movement of the puck assembly 102 with the tether connector 304 remaining stationary, or movements by both but at different velocities so that there is relative movement between the two. Thus, it should be understood that the puck assembly can be rotated on the tether connector 304 while holding the tether connector 304 relatively steady or the tether connector can be rotated 304 while holding the puck assembly 102 relatively steady. Similarly, the tether connector 304 can be inserted upward into the aperture 2310, or the puck assembly 102 can be moved downward onto the tether connector 304 with the tether connector 304 in appropriate alignment with aperture 2310.

Figure 23D:
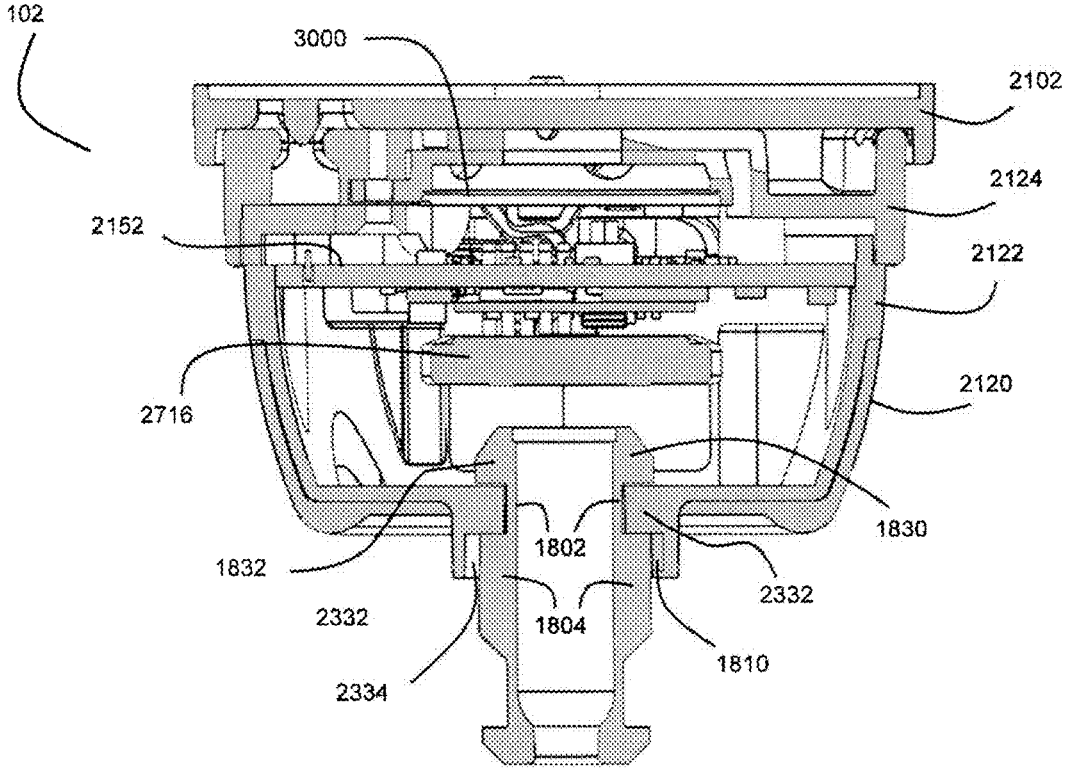
FIG. 23D shows a cross-sectional view of the puck assembly of FIGS. 21A-21F.

FIG. 23D shows a cross-sectional view of the puck assembly 102. In this view, the relationships between the lateral extension 1810, ledges 2332, catches 2334, upper head portions 1830 and 1832, neck 1802, and shoulder ring 1804 are shown.

Figure 24A:
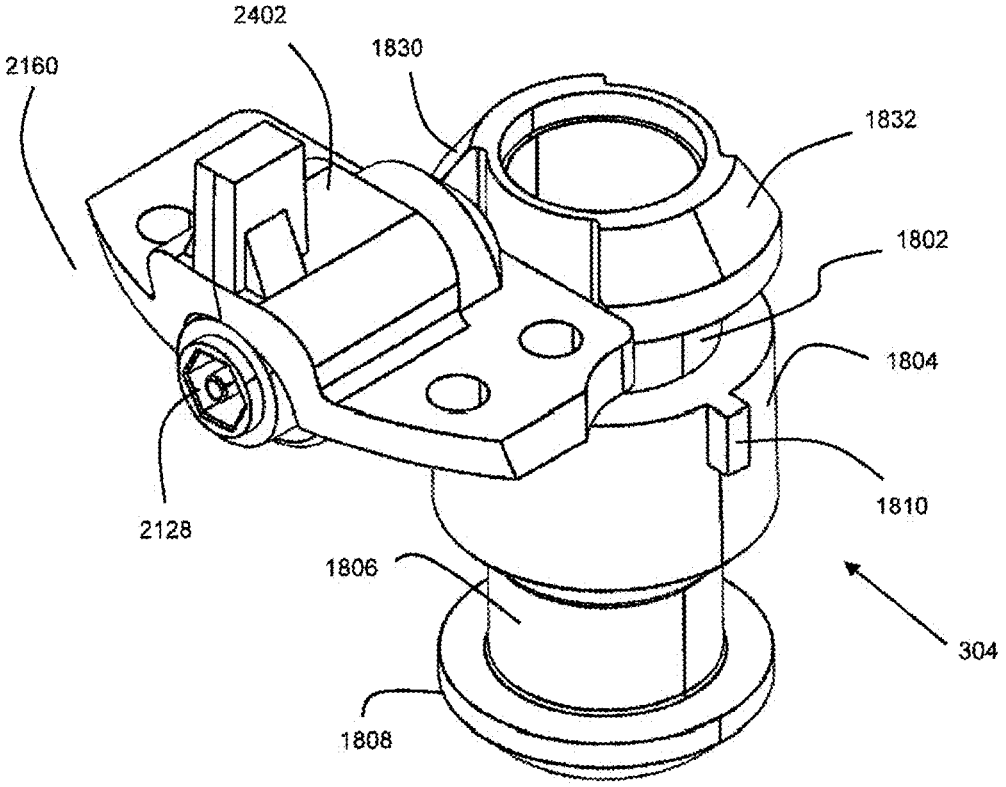
FIGS. 24A and 24B show a perspective view and a side view of a lock and a tether connector.
Figure 24B:
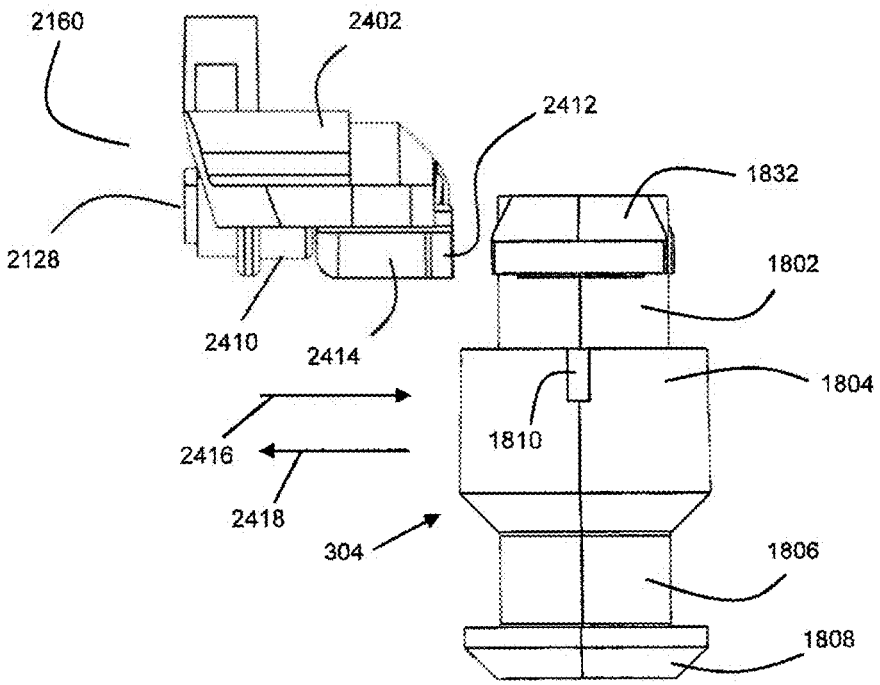

FIG. 24A shows an example lock 2160 in combination with the tether connector 304. FIG. 24B shows a side view of the lock 2160 and the tether connector 304. The lock 2160 provides releasable engagement with the tether connector 304. Lock 2160 includes a rotatable shaft 2410 and lock member 2414. Rotation of the shaft 2410 in a first rotational direction causes lateral outward movement 2416 of the lock member 2414 into a locking position for engagement with the tether connector 304, thereby preventing the tether connector 304 from rotating in the aperture 2310 by forcing the lock member 2414 against the upper head portions 1830 and 1832. Counter-rotation of the shaft 2410 opposite the first rotational direction causes lateral inward movement 2418 of the lock member 2414 into an unlocked position that disengages the lock member 2414 from the tether connector 304. When lock member 2414 is in the unlocked position, upper head portions 1830 and 1832 are freed to rotate into spatial alignment with the aperture 2310 for downward movement of the tether connector 304 relative to the puck assembly 102 and out of the aperture 2310, The lock 2610 includes a cover 2402 that provides a fixed base for the shaft 2410 and lock member 2414. Cover 2402 include screw holes for securing the lock 2160 to the metal carrier 2122.

While the example of FIG. 24A shows that tool interface 2128 exhibits a hexagonal shape for receiving a hexagon head of a tool, it should be understood that the tool interface 2128 could be designed to accommodate different tool shapes—such as more complex shapes that would be more difficult for thieves to access (e.g., keyed shapes that require different key elements at different depths within the tool interface 2128).

Figure 25:
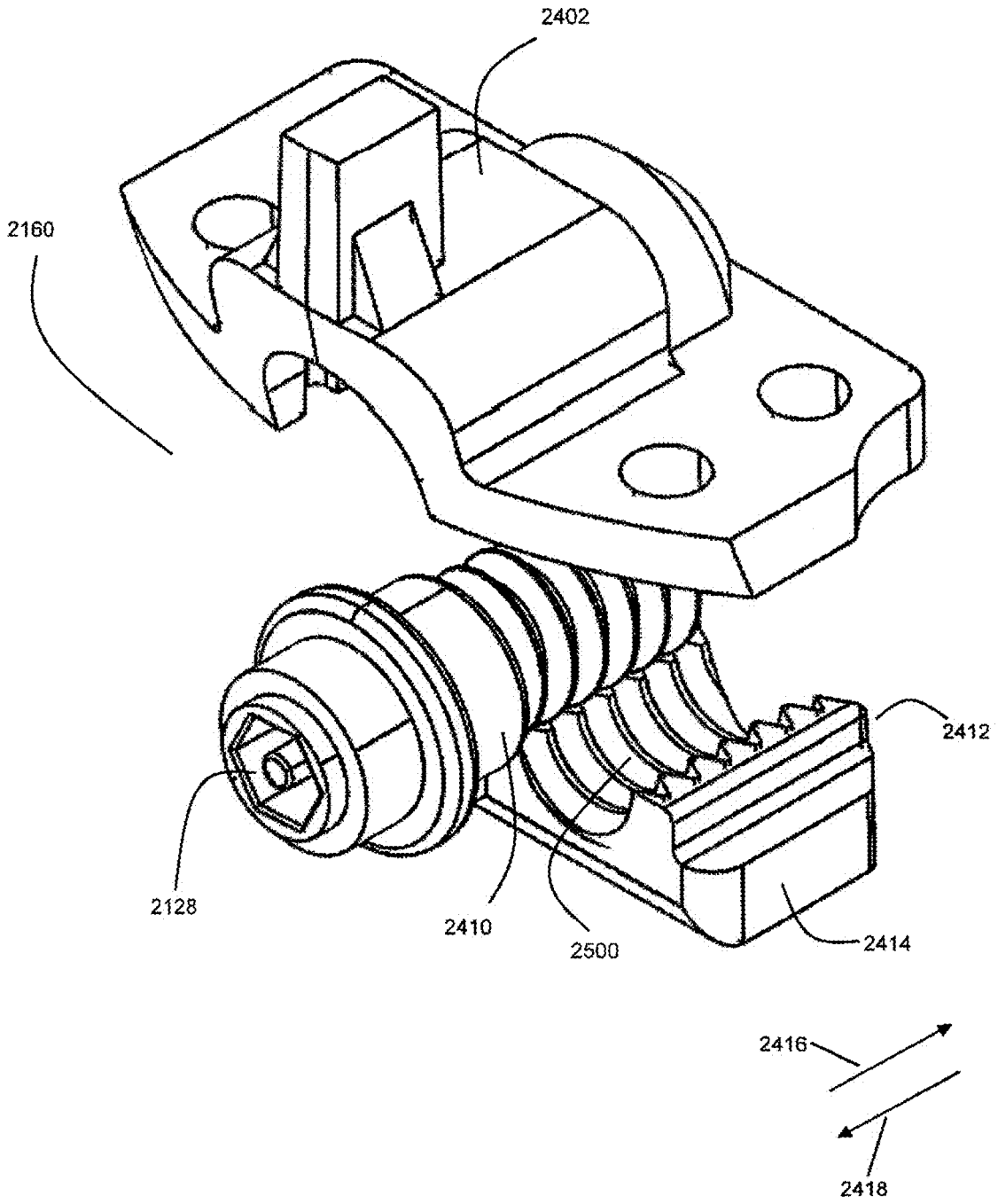
FIG. 25 shows an exploded view of the lock of FIGS. 24A and 24B.

FIG. 25 shows an exploded view of the lock 2610. In this view, the shaft 2410 is threaded shaft and lock member 2414 has complementary threading 2500 so that as shaft 2410 rotates the engagement of the complementary threading causes lock member 2414 to move laterally outward 2416 or inward 2418, depending on the direction of rotation. For example, rotation of the shaft 2410 in a first rotational direction causes the head 2412 of lock member 2414 to move outward 2416 into the locking position. While counter-rotation of the shaft 2410 in a direction opposite the first rotational direction causes the head 2412 of lock member 2414 to retract inward 2418 away from the locking position.

Figure 26A:
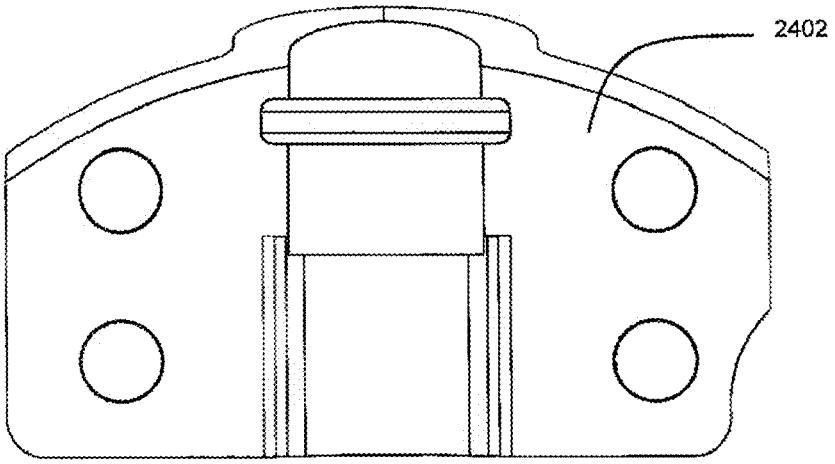
FIGS. 26A and 26B show a top view and a side elevation view of a cover of the lock shown in FIG. 25.
Figure 26B:
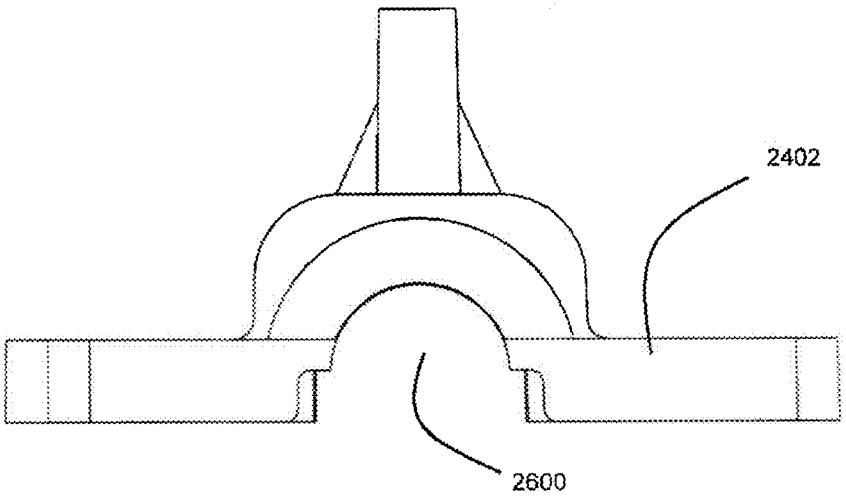

FIG. 26A shows a top view of the cover 2402. FIG. 26B shows a front side view of the cover 2402. The bottom surface of cover 2402 can be contoured to provide a recess 2600 for accommodating the shaft 2410.

Figure 27A:
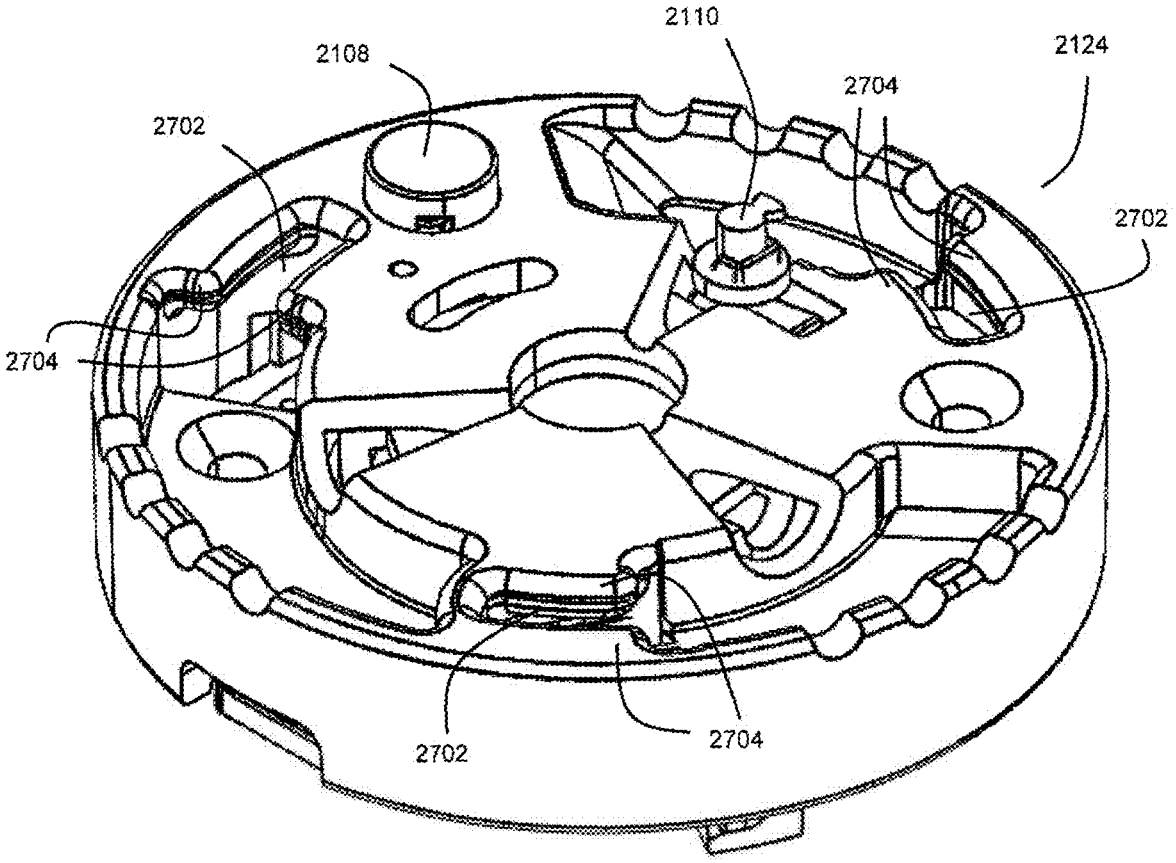
FIG. 27A shows a perspective view of a cap assembly of the puck assembly.

FIG. 27A shows a perspective view of example cap assembly 2124 of the puck assembly 102 shown in FIGS. 21A-21C. Upper surface of cap assembly 2124 includes grooves 2702 for receiving corresponding tongues 2214 on the upper plate 2102, as well as tongues 2704 for receipt by grooves 2104 on the upper plate 2102 to facilitate connection between upper plate 2102 and cap assembly 2124. Peg 2108 of the lock 2150 can also extend from an upper surface of cap assembly 2124 for receipt within aperture 2200 of upper plate 2102 when locking the upper plate 2102 to the cap assembly 2124.

Figure 27B:
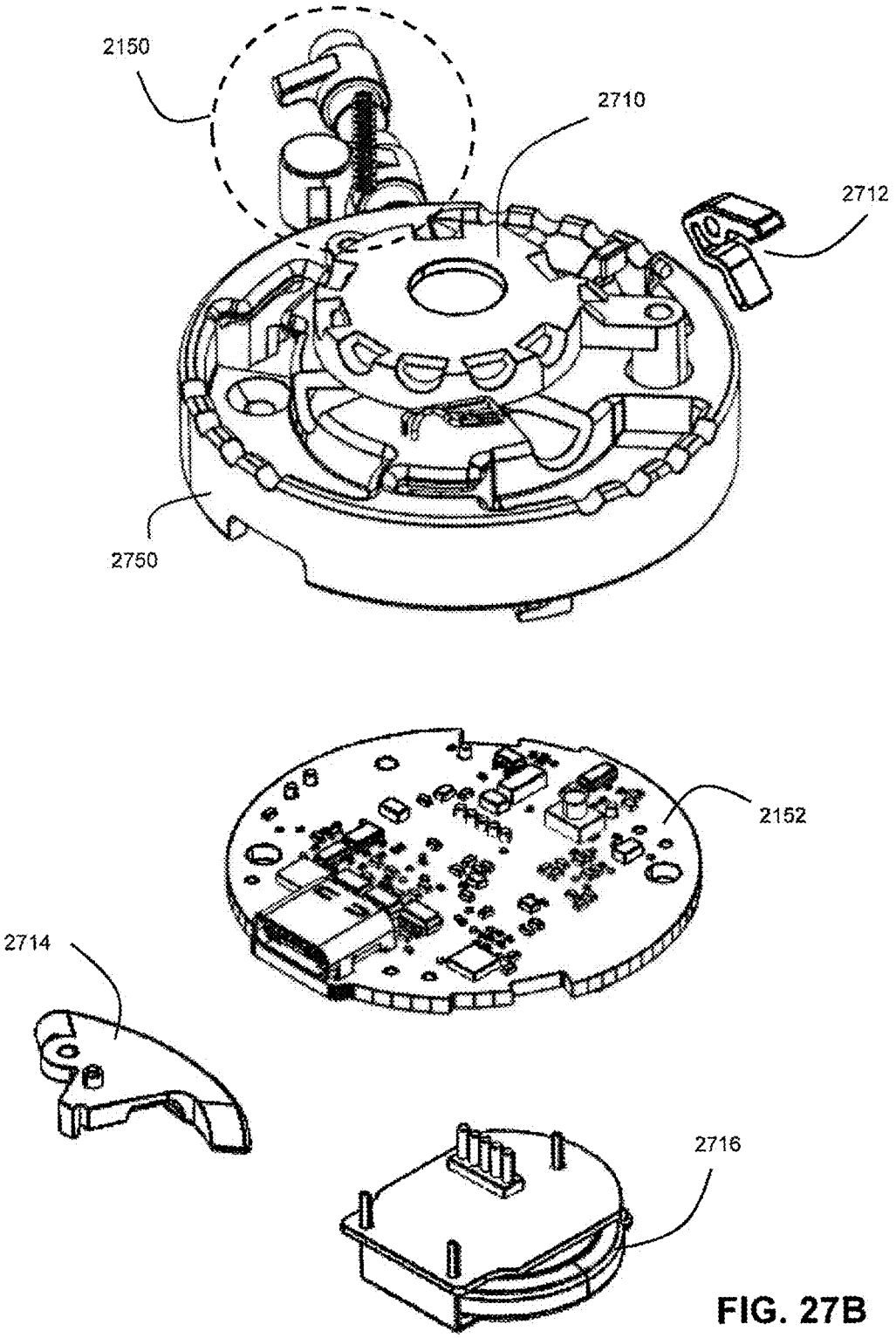
FIG. 27B shows an exploded view of the cap assembly shown in FIG. 27A.

FIG. 27B shows an exploded view of cap assembly 2124, where the cap assembly 2212 include cap 2750 and an alarm assembly 2710, where the cap 2750 covers the alarm assembly 2710.

Cap 2750 covers a circuit board 2152 located near the top of metal carrier 2122 on supporting ledges of the metal carrier 2122. Rechargeable battery 2716 is electrically connected with the circuit board 2152 to be charged with power passed by circuit board 2152 and provide backup operational power for circuit board 2152. Battery 2716 can be positioned below circuit board 2152 inside the interior chamber of metal carrier 2122.

Cap assembly 2124 includes a lock 2150, which can also be covered by cap 2750 when located inside the puck assembly 102. Cap assembly 2124 includes a support structure 2714 for supporting the plunger pin 2110 and presence sensor and contact element 2712 that serves to communicate the position of plunger pin 2110 to circuit board 2152. Thus, in the example, the plunger pin 2110 contacts element 2712 to contact a detector on the circuit board 2152 when the product is mounted on upper plate 2102. Upward movement of the plunger pin 2110 causes a shift of the contact element 2712 to lose contact with the detector on the circuit board 2152, thereby permitting the circuit board 2152 to detect removal of the product from the upper plate 2102 and generate an alarm.

Figure 28:
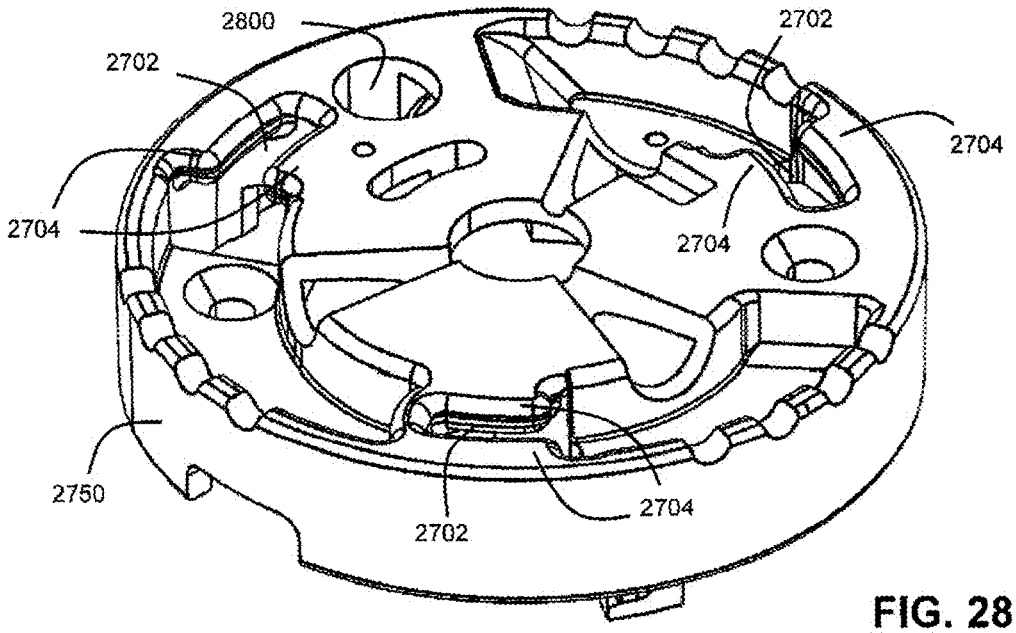
FIG. 28 shows a perspective view of example cap of the cap assembly shown in FIGS. 27A and 27B.

FIG. 28 shows a perspective view of an example cap 2750. The cap 2750 can be formed from metals such as aluminum, zinc alloys, or steel. The upper surface of cap 2750 includes an aperture 2800 that permits passage of peg 2108 and an aperture 2702 that permits passage of the plunger pin 2110. Furthermore, as noted, the upper surface of cap 2750 can include grooves 2702 and tongues 2704 for engaging with complementary tongues 2214 and grooves 2104 of upper plate 2102.

Figure 29:
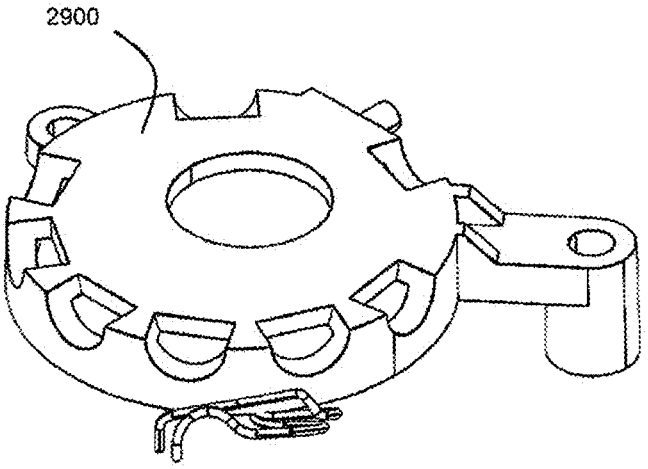
FIGS. 29 and 30 show example components of an alarm assembly shown in FIG. 27B.
Figure 30:
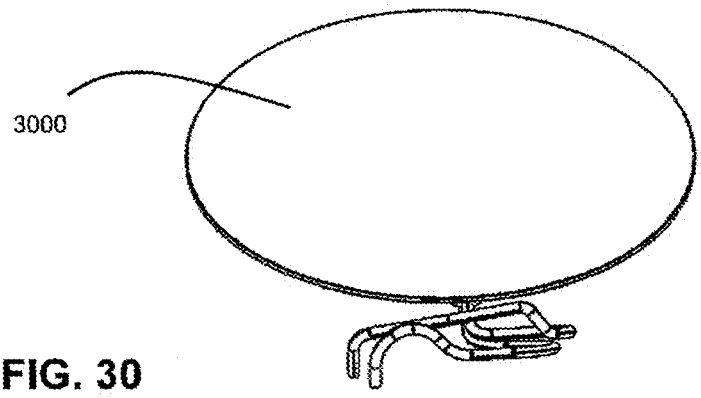

FIGS. 29 and 30 show example components of the alarm assembly 2710 shown in FIG. 27B. FIG. 29 shows a cover 2900 of the alarm 3000. The cover 2900 can be formed from metals such as aluminum, zinc alloys, or steel (e.g., stainless steel). The alarm 3000 can be a piezoelectric element that produces audible sound in response to energization by an electrical signal from the circuit board 2152. Cover 2900 can cover the alarm 3000 when combined to form the alarm assembly 2710.

Figure 31A:
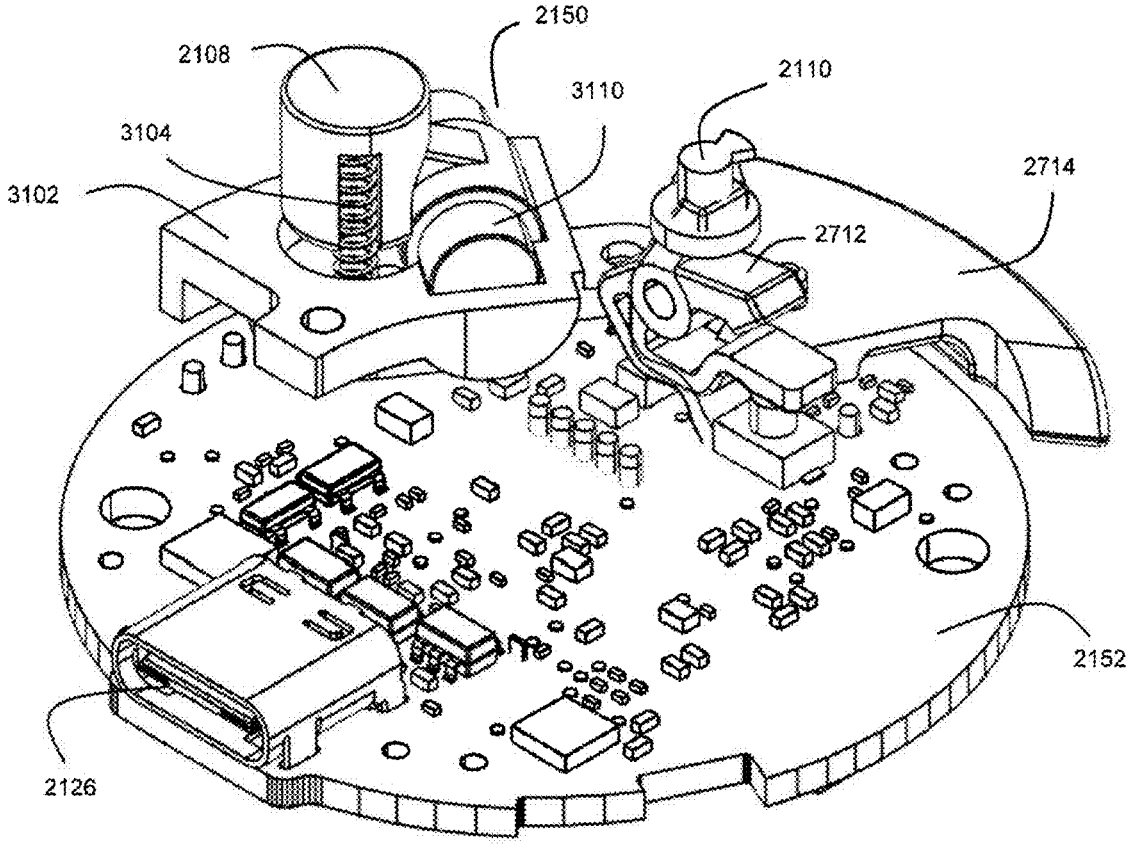
FIG. 31A shows a perspective view of a lock and presence sensor attached to a circuit board.
Figure 31B:
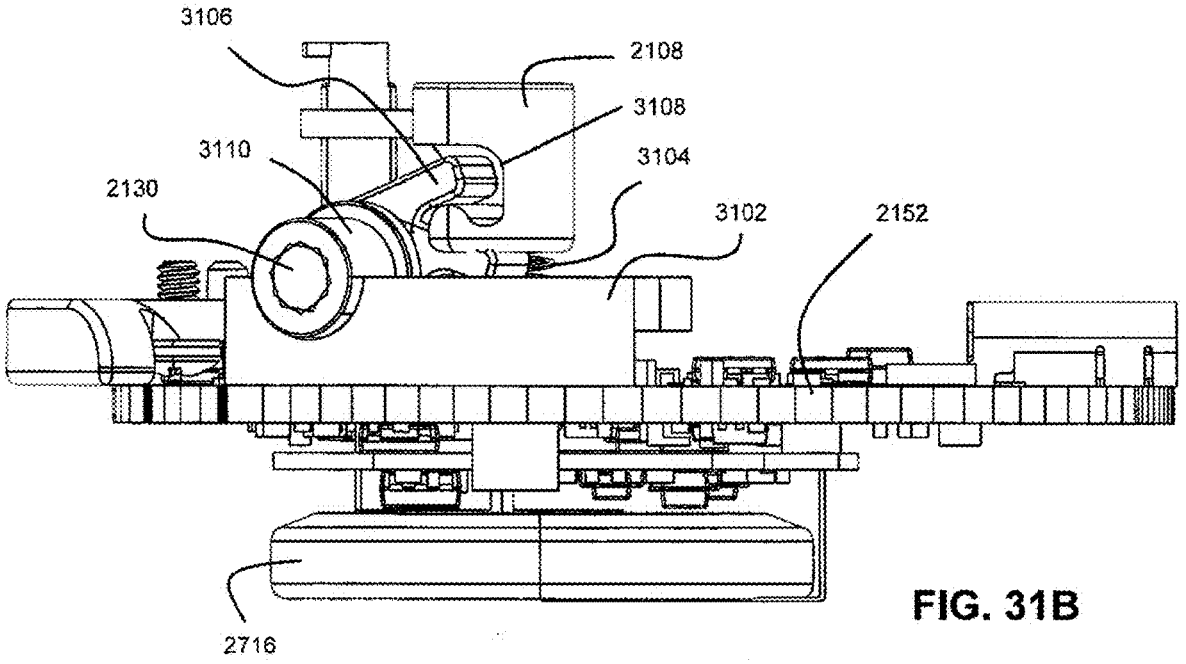
FIG. 31B shows a side view of the lock and the circuit board shown in FIG. 31A.

FIGS. 31A and 31B show the lock 2150 and the presence sensor connected to the circuit board 2152. The lock 2150 includes a lock support 3102 for connection with cap assembly 2124. The lock 2150 includes peg 2108, spring 3104, and rotatable shaft 3110. Presence sensor includes a sensor support 2714 that supports the plunger pin 2110 and connects with cap assembly 2124 while positioning contact element 2712 of the sensor 2110 relative to corresponding detector circuitry on the circuit board 2152.

FIG. 31B shows a side view of the lock 2150 located on the circuit board 2152. The rotatable shaft 3110 includes a lever arm 3106. Peg 2108 can take the form of a button that is biased by the spring 3104, shown in FIG. 31A, into an upward position. As described above, the upward position for the peg 2108 corresponds to a locking position in which the peg 2108 is inserted into the hole 2200, preventing rotation of the upper plate 2102 that would permit the plate and a device mounted on the plate from being disconnected from the cap assembly 2124. As shown in FIG. 31B, the peg 2108 includes a recess for receiving the lever arm 3106. A tool inserted into tool interface 2130 enables a user to rotate the shaft 3110 in a direction that will cause the lever arm 3106 to drive the peg 2108 upward to a lock position or downward to an unlock position. With reference to FIG. 31B, clockwise rotation of the shaft 3110 causes downward movement of arm 3106, which in turn causes lever arm 3106 to apply a downward force on peg 2108 that overcomes the bias force of spring 3104 and retract from the aperture 2200 of upper plate 2102, thereby permitting rotation of the upper plate 2102 relative to cap assembly 2124 so that upper plate 2102 can be disconnected from the cap assembly 2124. To return the lock 2150 to a locking position, counterclockwise rotation of the shaft 3110 causes the arm 3106 to press upward on peg 2108 and the spring 3104 returns the peg 2108 to its upward position and into the aperture 2200 of the upper plate, thereby preventing rotation of the upper plate 2102 relative to the cap assembly 2124. In another implementation, the act of removing the tool from the tool interface 2130 can cause the bias force of spring 3104 to counter-rotate the shaft 3110 to an unlocked position so that the peg 2108 returns to its upward position and into the aperture 2200 of the upper plate, thereby preventing rotation of the upper plate 2102 relative to the cap assembly 2124.

While the example of FIG. 31B shows that tool interface 2130 exhibits a multi-pointed star shape for receiving a complementary multi-pointed star head of a tool, it should be understood that the tool interface 2130 could be designed to accommodate different tool shapes—such as more complex shapes that would be more difficult for thieves to access (e.g., keyed shapes that require different key elements at different depths within the tool interface 2130).

Note that FIGS. 2-31B show example implementations and that other shapes, dimensions, and configurations for the product display assembly 100 could be employed. For example, while the puck assembly 102 may exhibit other shapes than shown in FIG. 21A. In other implementations, the tether connector 304 can be integral to the puck assembly 102 (rather than a separate component) for the purpose of locking the puck assembly 102 to the base assembly 104 via lock 1100. With such an embodiment, the tether connector 304 would not need, for example, the upper head 1800 and neck 1802 for connection with the puck assembly 102. In other implementations where the lock 1100 may be omitted from base assembly 104, the tether connector 304 could omitted, for example, the tapered ring 1808 and lower neck 1806.

It is appreciated that the above description of the disclosed embodiments is provided to enable any person skilled in the art to make or use the present disclosure. Various modifications to these embodiments will be apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A system for displaying a product, the system comprising:

a puck assembly having a surface on which the product is mountable;

a base assembly on which the puck assembly is restable, the base assembly including an interior metal frame, the metal frame including a first metal arm, a second metal arm, a metal cross-brace that connects the first metal arm to the second metal arm, and a metal crosspiece having a metal crosspiece aperture; and a tether assembly having a tether, a reel and a tether connector, wherein the tether is connected at a first end to the reel located within a recess formed between the first metal arm and the second metal arm, extends through the metal crosspiece aperture, and is connected at a second end to the tether connector that is attached to the puck assembly.

2. The system of claim 1 wherein the base assembly comprises a metal base plate connected to a first flange of the first metal arm and a second flange of the second metal arm.

3. The system of claim 1 wherein the metal crosspiece encloses a lock comprising:

a shuttle having a first aperture;

a rail having a second aperture;

a slidable collar located between the shuttle and the rail, the slidable collar having a third aperture, the first, second, and third apertures forming a common aperture for passage of the tether; and a spring that connects the slidable collar to the rail and when released slides the slidable collar to lockdown the tether connector.

4. The system of claim 1 wherein the metal crosspiece encloses a lock comprising:

a shuttle having a first aperture;

a rail having a second aperture;

a slidable collar located between the shuttle and the rail, the slidable collar having a third aperture, the first, second, and third apertures forming a common aperture for passage of the tether; and a motor attached to a lever arm that drives the slidable collar to lockdown the tether.

5. The system of claim 1 wherein the metal crosspiece encloses a lock comprising:

a shuttle having a first aperture;

a rail having a second aperture;

a slidable collar located between the shuttle and the rail, the slidable collar having a third aperture, the first, second, and third apertures forming a common aperture for passage of the tether;

an actuator having a tool interface, the actuator forces the slidable collar to unlock or lock the tether when operated by a tool that engages the tool interface.

6. A system for displaying a product, the system comprising:

a puck assembly having a surface on which the product is mountable;

a base assembly on which the puck assembly is restable, the base assembly including an interior metal frame, the metal frame including a first metal arm, a second metal arm, a metal cross-brace that connects the first metal arm to the second metal arm, and a metal crosspiece having a metal crosspiece aperture;

a tether assembly having a tether connected at a first end to a reel located within a recess formed between the first metal arm and the second metal arm and connected at a second end to a tether connector that is attached to the puck assembly, the tether passing through the metal crosspiece aperture; and a lock located within the metal crosspiece, the first lock having a common aperture though which the tether passes and is able to lock and unlock the tether and the tether connector.

7. The system of claim 6 wherein the base assembly comprises a riser cup located above the metal crosspiece, the riser cup including a riser cup aperture through which the tether is extendable and a riser cup recess in which a lower portion of the puck assembly is restable when in the rest position.

8. The system of claim 6 wherein the lock switches between a locked state and an unlocked state in response to an operation of a key and/or a wireless signal received by the apparatus from a remote source.

9. The system of claim 6 wherein the lock comprises:

a shuttle having a first aperture:

a rail having a second aperture;

a slidable collar located between the shuttle and the rail, the slidable collar having a third aperture, the first, second, and third apertures forming a common aperture for passage of the tether; and a motor that slides the slidable collar into a locked position that locks down the tether or tether connector in response to a wireless signal received from a remote source.

10. The system of claim 6 wherein the base assembly comprises a circuit board located above the metal crosspiece, the circuit board to cooperate with the lock to detect and track whether the lock is in a locked state, whether the lock is in an unlocked state, and whether the puck assembly is in a rest position.

11. The system of claim 6 wherein the base assembly comprises a second circuit board, the second circuit board attached to an outer side of one of the first and second metal vertical arms.

12. The system of claim 6 wherein the lock comprises:

a spring that biases a slidable collar to a locked position that lockdown the tether of the tether connector; and a shuttle that is moveable between a first position and a second position, the shuttle including a shuttle aperture through which the tether and the tether connector are extendable, wherein movement of the shuttle to the first position overcomes a bias force of the spring and causes movement of the slidable collar to an unlocked position, and wherein movement of the shuttle to the second position permits the spring to cause movement of the slidable collar to the locked position based on the bias force of the spring.

13. A system for displaying a product, the system comprising:

a puck assembly having an upper portion and a lower portion, the upper portion including an upper surface for mounting the product;

a base assembly on which the puck assembly is restable, the base assembly including an interior metal frame, the metal frame including a first metal arm, a second metal arm, a metal cross-brace that connects the first metal arm to the second metal arm, and a metal crosspiece having a metal crosspiece aperture;

a tether assembly having a tether connected at a first end to a reel located within a recess formed between the first metal arm and the second metal arm and connected at a second end to a tether connector that is attached to the puck assembly, the tether passing through the metal crosspiece aperture; and a lock located within the puck assembly and releasably engages the upper portion to restrict detachment of the upper portion from the lower portion.

14. The system of claim 13 wherein the upper portion comprises a recess on a bottom surface of the upper portion; and wherein the lock includes a peg that is movable between an upward position and fits within the recess when the lock is in a locked state and a downward position when the lock is in an unlocked state, wherein the peg in the upward position blocks rotation of the upper portion and the peg permits rotations of the upper portion when the peg is in the downward position.

15. The system of claim 13 wherein the upper portion comprises an aperture and wherein the lock includes a peg that is movable between an upward position and fits within the aperture when the lock is in a locked state and a downward position when the lock is in an unlocked state, wherein the peg in the upward position blocks rotation of the upper portion and the peg permits rotations of the upper portion when the peg is in the downward position.

16. The system of claim 13 wherein the lock comprises a bias spring connected to a peg, wherein the bias spring applies a bias force that biases the peg to the upward position.

17. The system of claim 13 wherein the lock comprises a tool interface for receiving a tool that is used to restrict detachment of the upper portion from the lower portion.

18. The system of claim 13 wherein the lower portion includes a plunger pin that engages with the product when the product is mounted on the upper surface, the plunger pin being connected to a circuit board located within the lower portion; wherein the upper portion includes an aperture through which the plunger pin is positioned when the upper portion is connected with the lower portion; and wherein the circuit board triggers an alarm located within the puck assembly when the product is removed from the plunger pin.

19. The system of claim 13 wherein the puck assembly further comprises a second lock located within the lower portion, the second lock including a tool interface a rotatable shaft, and a lock member, wherein a tool engaged with the tool interface enables rotation of the shaft in a first rotational direction causes a head of lock member to move outward engaging the tether connector in a the locking position and wherein the tool interface enables counter-rotation of the shaft in a direction opposite the first rotational direction causes the head of lock member to retract inward away from the locking position and release of the tether connector from the puck assembly.

* * * * *